US007510813B2

(12) United States Patent
Yano et al.

(10) Patent No.: US 7,510,813 B2
(45) Date of Patent: Mar. 31, 2009

(54) RESIN-COATED CARRIER FOR ELECTROPHOTOGRAPHIC DEVELOPER

(75) Inventors: Tetsuya Yano, Atsugi (JP); Takashi Kenmoku, Fujisawa (JP); Chieko Mihara, Isehara (JP); Tatsuki Fukui, Yokohama (JP); Ako Kusakari, Atsugi (JP); Norikazu Fujimoto, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 348 days.

(21) Appl. No.: 11/165,357

(22) Filed: Jun. 24, 2005

(65) Prior Publication Data

US 2005/0287484 A1 Dec. 29, 2005

(30) Foreign Application Priority Data

Jun. 24, 2004 (JP) ..... 2004-186453

(51) Int. Cl.
*G03G 9/113* (2006.01)

(52) U.S. Cl. ..... 430/111.32; 430/111.35

(58) Field of Classification Search ..... 430/111.35, 430/111.32

See application file for complete search history.

(56) References Cited

U.S. PATENT DOCUMENTS

| | | | | |
|---|---|---|---|---|
| 4,265,247 | A | 5/1981 | Lenz et al. | 128/335.5 |
| 4,876,331 | A | 10/1989 | Doi | 528/361 |
| 5,135,859 | A | 8/1992 | Witholt et al. | 435/135 |
| 5,292,860 | A | 3/1994 | Shiotani et al. | 528/361 |
| 5,334,698 | A | 8/1994 | Witholt et al. | 528/354 |
| 6,521,429 | B2 | 2/2003 | Honma et al. | 435/135 |
| 6,649,380 | B1 | 11/2003 | Yano et al. | 435/135 |
| 6,911,520 | B2 | 6/2005 | Fukui et al. | 528/272 |
| 2001/0029039 | A1 | 10/2001 | Honma et al. | 435/135 |
| 2003/0091922 | A1 * | 5/2003 | Okado et al. | 430/111.33 |
| 2003/0208028 | A1 | 11/2003 | Yano et al. | 528/272 |
| 2004/0005290 | A1 | 1/2004 | Fukui et al. | 528/272 |
| 2005/0260514 | A1 | 11/2005 | Mihara et al. | 430/108.4 |
| 2006/0014921 | A1 | 1/2006 | Mihara et al. | 528/272 |

FOREIGN PATENT DOCUMENTS

| | | |
|---|---|---|
| JP | 59-190945 | 10/1984 |
| JP | 2-3415 | 1/1990 |
| JP | 5-93049 | 4/1993 |
| JP | 5-310721 | 11/1993 |
| JP | 7-14352 | 2/1995 |
| JP | 7-265065 | 10/1995 |
| JP | 8-19227 | 2/1996 |
| JP | 08160674 A * | 6/1996 |
| JP | 2642937 | 5/1997 |
| JP | 2000-166587 | 6/2000 |
| JP | 2001-288256 | 10/2001 |
| JP | 2002-306190 | 10/2002 |
| JP | 2003-319792 | 11/2003 |
| WO | WO 2004061530 A1 * | 7/2004 |

OTHER PUBLICATIONS

Diamond, Arthur S & David Weiss (eds.) Handbook of Imaging Materials, 2nd ed.. New York: Marcel-Dekker, Inc. (Nov. 2001) pp. 209, 210, 220-222, and 228-231.*

Allcock et al., "Reactions of Steroid Salts with Hexachlorocyclotriphosphazene," *J. Org. Chem.*, vol. 46, pp. 13-22 (1981).

Bear et al., "Preparation of a Bacterial Polyester with Carboxy Groups in Side Chains," *Macromolecular Chemistry*, vol. 4, pp. 289-293 (2001).

Braude et al., "1,4-Naphthoquinone*," *Organic Syntheses*, Collective vol. 4, pp. 698-699 (1963).

Parrish et al., "Functional Polyesters by Ring-Opening Polymerization of α-ally (σ-valerolactone)," *Polymaric Materials: Science & Engineering*, vol. 87, pp. 254-255 (2002).

Radano et al., "Synthesis of Novel Biodegradable Copolymers Using Olefin Metathesis," *Polymer Preprints*, vol. 43, No. 2, pp. 727-728 (2002).

Briggs et al., "Degradation of the Lanosterol Side-chain," *J. Chem. Soc.*, Perkin Transactions I, pp. 806-809 (1973).

Ponsart et al., "A Novel Route to Poly (ε-caprolactone)-Based Copolymers via Anionic Derivatization," *Biomacromolecules*, vol. 1, pp. 275-281 (2000).

Saulnier et al., "Lactic Acid-Based Functionalized Polymers via Copolymerization and Chemical Modification," *Macromolecular Bioscience*, vol. 4, pp. 232-237 (2004).

Stille et al., "Tetracyclic Dienes. I. The Diels-Alder Adduct of Norbornadiene and Cyclopentadiene," *J. Am. Chem. Soc.*, vol. 81, pp. 4273-4275 (1959).

Trolisás et al., "Hydrophilic Aliphatic Polyesters: Design, Synthesis, and Ring-Opening Polymerization of Functional Cyclic Esters," *Macromolecules*, vol. 33, pp. 4619-4627 (2000).

Yamaoka et al., "Synthesis and Properties of Malic Acid-containing Functional Polymers," *Int. J. Biolog. Macromol.*, vol. 25, pp. 265-271 (1999).

* cited by examiner

*Primary Examiner*—Christopher RoDee
(74) *Attorney, Agent, or Firm*—Fitzpatrick, Cella, Harper & Scinto

(57) ABSTRACT

To provide a resin-coated carrier for an electrophotographic developer capable of providing an image with excellent image quality; and a two-component developer and a replenishing developer each of which contains the resin-coated carrier as a constituent. A resin-coated carrier for an electrophotographic developer, including: a core; and a resin coating layer containing a polyhydroxyalkanoate containing one or more units each represented by the following chemical formula (1) in a molecule, the resin coating layer being placed on the core:

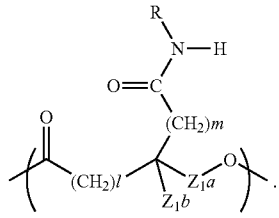

6 Claims, No Drawings

RESIN-COATED CARRIER FOR ELECTROPHOTOGRAPHIC DEVELOPER

BACKGROUND OF THE INVENTION

1. Field of the Invention

The present invention relates to: a resin-coated carrier for an electrophotographic developer constituting a two-component developer used for developing an electrostatic latent image in electrophotography, electrostatic recording, electrostatic printing, or the like; and a two-component developer and a replenishing developer each of which contains the resin-coated carrier as a constituent.

2. Related Background Art

In recent years, biodegradable polymer materials have been finding a wide variety of applications including medical materials, drug delivery systems, and environmentally compatible materials. In recent years, in addition to those applications, the biodegradable polymer materials have been requested to provide new functions, and hence various studies have been made. In particular, the introduction of a chemically modifiable functional group into a molecule of a polyhydroxyalkanoate typified by polylactic acid has been examined. For example, there has been reported a compound into which a carboxyl group or a vinyl group is introduced.

For example, polymalic acid has been known as a polyhydroxyalkanoate having a carboxyl group at a side chain thereof. An α-type represented by the chemical formula (14) and a β-type represented by the chemical formula (15) have been known as polymers of polymalic acid depending on the form of a polymer.

(14)

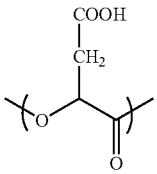

(15)

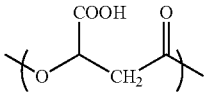

Of those, a polymer obtained by ring-opening polymerization of a benzyl ester of β-malolactone represented by the following chemical formula (16) is disclosed in U.S. Pat. No. 4,265,247 as β-type polymalic acid or a copolymer thereof.

(16)

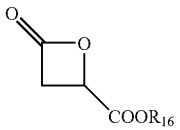

(In the formula, $R_{16}$ represents a benzyl group.)

In addition, a polymer obtained by copolymerization of a six-membered ring diester monomer and a glicolide or lactide as a cyclic diester or a lactone as an intramolecular ring closure reaction ester of ω-hydroxycarboxylic acid represented by the chemical formula (17) is disclosed in Japanese Patent Application Laid-Open No. H02-3415 as a copolymer containing any one of other hydroxyalkanoic acids typified by α-type polymalic acid-glycolic acid copolymer and glycolic acid.

(17)

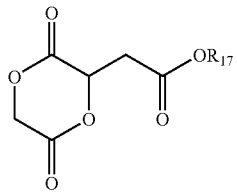

(In the formula, $R_{17}$ represents a lower alkyl group such as a methyl group, an ethyl group, an n-propyl group, an isopropyl group, or a t-butyl group, or a benzyl group.)

"Macromolecules" 2000, vol. 33, No. 13, p. 4619 discloses that 7-oxo-4-oxepancarboxylate is subjected to ring-opening polymerization to produce a polymer having an ester group at a side chain thereof, and the polymer is further subjected to hydrogenolysis to produce a polymer having a carboxylic acid at a side chain thereof as a polyhydroxyalkanoate having a carboxyl group at a side chain thereof.

"Biomacromolecules" 2000, vol. 1, p. 275 discloses a polymer in which a benzyloxycarbonyl group is introduced into a methylene group at position a of a carbonyl group in the main chain of poly(ε-caprolactone), the polymer being obtained by: allowing lithium diisopropylamide to react with poly(ε-caprolactone); and allowing the resultant to react with benzyl chloroformate. "Macromolecular Bioscience" 2004, vol. 4, p. 232 discloses a polymer in which a (benzyloxycarbonyl)methyl group is introduced into a methylene group at position a of a carbonyl group in the main chain of polylactic acid, the polymer being obtained by: allowing lithium diisopropylamide to react with polylactic acid; and allowing the resultant to react with benzyl bromoacetate.

"Polymeric Materials Science & Engineering" 2002, vol. 87, p. 254 discloses, as a polyhydroxyalkanoate having a vinyl group at a side chain thereof, a polymer obtained by ring-opening polymerization of α-allyl(δ-valerolactone).

Similarly, "Polymer Preprints" 2002, vol. 43, No. 2, p. 727 discloses, as a polyhydroxyalkanoate having a vinyl group at a side chain thereof, a polymer obtained by ring-opening polymerization of 3,6-diallyl-1,4-dioxane-2,5-dione as a six-membered ring diester monomer.

There has been reported a polymer having a new function into which a structure providing functional properties for a polyhydroxyalkanoate into which a chemically modifiable functional group is introduced as described above is introduced. "International Journal of Biological Macromolecules" 1999, vol. 25, p. 265 discloses the following. A copolymer of α-type malic acid and glycolic acid is obtained by ring-opening polymerization of a cyclic dimer of α-type malic acid and glycolic acid, and the resultant polymer is deprotected to obtain a polyester having a carboxyl group at a side chain thereof. Tripeptide is chemically modified to the carboxyl group at the side chain, and the resultant polymer is evaluated for cell adhesion. At this time, a good result is obtained.

With regard to a method of obtaining a polyhydroxyalkanoate represented by the chemical formula (21) described below involving oxidation cleavage of a carbon-carbon double bond of a side chain of a polyhydroxyalkanoate represented by the chemical formula (6) described below as a staring material with an oxidizing agent, for example, J.

Chem. Soc., Perkin. Trans., 1973, vol. 1, p. 806 discloses a method involving the use of a permanganate, Org. Synth., 1963, vol. 4, p. 698 discloses a method involving the use of a dichromate, J. Org. Chem., 1981, vol. 46, p. 19 discloses a method involving the use of a periodate, Japanese Patent Application Laid-Open No. S59-190945 discloses a method involving the use of nitric acid, and J. Am. Chem. Soc., 1959, vol. 81, p. 4273 discloses a method involving the use of ozone. In addition, "Macromolecular chemistry" 2001, vol. 4, p. 289-293 has reported a method of obtaining a carboxylic acid involving subjecting a carbon-carbon double bond of a side chain terminal of a polyhydroxyalkanoate produced by using a microorganism to a reaction under an acid condition by means of potassium permanganate as an oxidizing agent.

Meanwhile, electrophotography has been conventionally known, which involves: forming an electrical latent image on the surface of a photoconductive material by means of electrostatic means; and developing the latent image to form an image. A large number of methods based on the electrophotography have been known. That is, the electrophotography generally involves: forming an electrical latent image on a photosensitive member by using a photoconductive substance and various means; allowing a finely pulverized voltage detection material called toner carried and conveyed by a developer carrier to adhere to the latent image to form a toner image corresponding to an electrostatic latent image; transferring the toner image onto the surface of an image support such as paper as required; and fixing the toner image by means of heat, pressure, or solvent vapor to provide a copied product.

Known examples of a method of visualizing an electrical latent image by means of toner include a powder cloud method, a cascade development method, a magnetic brush method, and a method involving the use of conductive magnetic toner. In addition to the above methods, a so-called J/B development method has been known, which involves applying a bias electric field composed of an AC component and a DC component to a space between a developer carrier (developing sleeve) and a photoconductive layer to perform development. A representative method for the development method is the magnetic brush method. The magnetic brush method involves the use of a two-component developer composed of toner and a magnetic carrier. When particles having magnetic properties made of steel, ferrite, and the like are used as a carrier, the developer containing the magnetic carrier is held on a developer carrier having a magnet in it. Thus, the developer is arranged in a brush fashion on the developer carrier by a magnetic field of the magnet. Then, when the magnetic brush contacts the surface of an electrostatic latent image on a photoconductive layer, only the toner in the developer is attracted from the brush to the electrostatic latent image, whereby the electrostatic latent image is developed.

Carriers constituting a two-component developer applicable to the above development method are roughly classified into a conductive carrier and an insulating carrier. Oxidized or unoxidized iron powder is generally used as the conductive carrier. However, in a developer containing the iron powder carrier as a constituent, triboelectric chargeability to toner is unstable. On the other hand, a resin-coated carrier obtained by evenly coating the surface of a carrier core material made of a ferromagnetic substance such as iron, nickel, or ferrite with an insulating resin is a representative example of the insulating carrier. A developer using such an insulating resin-coated carrier has a significantly reduced frequency of fusion of a toner particle to a carrier surface as compared to the conductive carrier described above. In addition, the developer facilitates the control of triboelectric chargeability between toner and the carrier, is excellent in durability, and has a long lifetime, so it is particularly suitable for a high-speed electronic copying machine.

Various properties are requested for an insulating carrier. Of those, examples of particularly important properties include appropriate chargeability, impact resistance, abrasion resistance, good adherence between a core material and a coating material, and uniformity of a charge distribution. In order to prevent a spent carrier such as toner adhesion, a proposal has been made, in which a resin having small surface energy is used as a coating layer material to increase the durability of a developer. That is, it is said that a carrier coated with a silicone resin, a fluorine resin, or the like is hardly spent and has a long lifetime as a developer. As described in Japanese Patent Application Laid-Open No. S62-121462, a resin coating layer has been improved by adding various silane coupling agents to a condensation reaction type silicone resin.

A carrier for electrophotography is also problematic in terms of durability and environmental stability. With regard to the durability, the rise of an initial charge amount is generally slow, so fogging tends to occur in an initial image or an image density tends to be high. In addition, in long-term copy duration, a charge amount reduces, so fogging tends to occur in an image or an image density tends to be high. With regard to the environmental stability, a charge amount tends to reduce in a high-humidity environment, so fogging tends to occur in an image, an image density tends to be high, or toner scattering tends to occur. In a low-humidity environment, a charge amount tends to increase, so an image density tends to reduce.

SUMMARY OF THE INVENTION

An object of the present invention is to provide a resin-coated carrier for an electrophotographic developer; and a two-component developer and a replenishing developer each of which contains the resin-coated carrier as a constituent. More specifically, an object of the present invention is to provide a resin-coated carrier for an electrophotographic developer obtained by allowing a resin coating layer to stably adhere to the surface of a core material, the resin-coated carrier having sufficient charge imparting property, the resin-coated carrier being excellent in environmental stability, the resin-coated carrier having sufficient durability, and the resin-coated carrier being capable of providing an image with excellent image quality in which image deletion or the like hardly occurs; and a two-component developer and a replenishing developer each of which contains the resin-coated carrier as a constituent.

To achieve the above object, according to one aspect of the present invention, there is provided a resin-coated carrier for an electrophotographic developer, including: a core material; and a resin coating layer containing a polyhydroxyalkanoate containing one or more units each represented by the following chemical formula (1) in a molecule, the resin coating layer being placed on the core material.

(1)

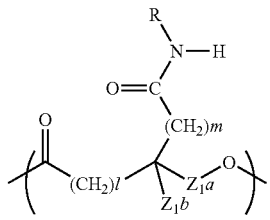

(In the formula:

R represents $-A_1-SO_2R_1$;

$R_1$ represents OH, a halogen atom, ONa, OK, or $OR_{1a}$; and $R_{1a}$ and $A_1$ each independently represent a group having a substituted or unsubstituted aliphatic hydrocarbon structure, a substituted or unsubstituted aromatic ring structure, or a substituted or unsubstituted heterocyclic structure.

In addition, with regard to l, m, $Z_{1a}$, and $Z_{1b}$ in the formula:

when l represents an integer selected from 2 to 4, $Z_{1a}$ represents nothing or a linear alkylene chain having 1 to 4 carbon atoms, $Z_{1b}$ represents a hydrogen atom, and m represents an integer selected from 0 to 8;

when l represents 1 and $Z_{1a}$ represents a linear alkylene chain having 1 to 4 carbon atoms, $Z_{1b}$ represents a hydrogen atom and m represents an integer selected from 0 to 8;

when l represents 1 and $Z_{1a}$ represents nothing, $Z_{1b}$ represents a hydrogen atom and m represents 0;

when l represents 0 and $Z_{1a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{1b}$ represents a hydrogen atom, or a linear or branched alkyl group, aryl group, or aralkyl group which may be substituted by an aryl group, and m represents an integer selected from 0 to 8; and when l represents 0 and $Z_{1a}$ represents nothing, $Z_{1b}$ represents a hydrogen atom, or a linear or branched alkyl group, aryl group, or aralkyl group which may be substituted by an aryl group, and m represents an integer selected from 0 to 8.

In addition, when multiple units exist, R, $R_1$, $R_{1a}$, $A_1$, $Z_{1a}$, $Z_{1b}$, l, and m each independently have the above meaning for each unit.)

According to another aspect of the present invention, there is provided a resin-coated carrier for an electrophotographic developer, including: a core material; and a resin coating layer containing a polyhydroxyalkanoate containing one or more units each represented by the following chemical formula (5) in a molecule, the resin coating layer being placed on the core material.

(5)

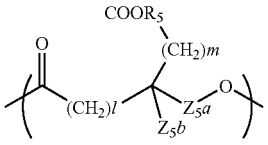

(In the formula, $R_5$ represents hydrogen, a group for forming a salt, or $R_{5a}$, and $R_{5a}$ represents a linear or branched alkyl group having 1 to 12 carbon atoms, or aralkyl group.

In addition, with regard to l, m, $Z_{5a}$, and $Z_{5b}$ in the formula:

when l represents an integer selected from 2 to 4, $Z_{5a}$ represents nothing or a linear alkylene chain having 1 to 4 carbon atoms, $Z_{5b}$ represents a hydrogen atom, and m represents an integer selected from 0 to 8;

when l represents 1 and $Z_{5a}$ represents a linear alkylene chain having 1 to 4 carbon atoms, $Z_{5b}$ represents a hydrogen atom and m represents an integer selected from 0 to 8;

when l represents 1 and $Z_{5a}$ represents nothing, $Z_{5b}$ represents a hydrogen atom and m represents 0;

when l represents 0 and $Z_{5a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{5b}$ represents a hydrogen atom, or a linear or branched alkyl group, aryl group, or aralkyl group which may be substituted by an aryl group, and m represents an integer selected from 0 to 8; and when l represents 0 and $Z_{5a}$ represents nothing, $Z_{5b}$ represents a hydrogen atom, or a linear or branched alkyl group, aryl group, or aralkyl group which may be substituted by an aryl group, and m represents an integer selected from 0 to 8.

In addition, when multiple units exist, $R_5$, $R_{5a}$, $Z_{5a}$, $Z_{5b}$, l, and m each independently have the above meaning for each unit.)

According to another aspect of the present invention, there is provided a two-component developer, including: a resin-coated carrier; and toner containing at least a binder resin and a colorant, in which the resin-coated carrier is the above resin-coated carrier.

According to another aspect of the present invention, there is provided a replenishing developer, including: 1 part by weight of a carrier; and 2 to 50 parts by weight of toner, in which the carrier is the above resin-coated carrier.

According to the present invention, there can be provided: a resin-coated carrier for an electrophotographic developer in which a resin coating layer stably adheres to a carrier core material, which has sufficient property of imparting charge to toner, and which is excellent in environmental stability; a two-component developer containing, as constituents, the resin-coated carrier and toner containing at least a binder resin and a colorant; and a replenishing developer containing a predetermined ratio of toner to the resin-coated carrier.

DESCRIPTION OF THE PREFERRED EMBODIMENTS

Hereinafter, the present invention will be described in detail by way of preferred embodiments. The inventors of the present invention have made extensive studies on the problems of the prior art described above, and have found that a resin-coated carrier for an electrophotographic developer, including: a core material; and a resin coating layer containing a polyhydroxyalkanoate containing one or more units each represented by the following chemical formula (1) or (5) in a molecule, the resin coating layer being placed on the core material, is excellent in durability, is capable of imparting sufficient charge to toner regardless of the environment, and is capable of providing excellent image quality in which image deletion which generally tends to remarkably occur in high humidity does not occur. Thus, the inventors have completed the present invention.

(1)

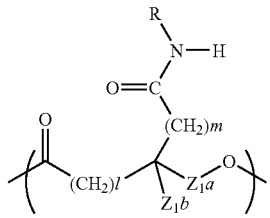

(In the formula:

R represents $-A_1-SO_2R_1$;

$R_1$ represents OH, a halogen atom, ONa, OK, or $OR_{1a}$; and $R_{1a}$ and $A_1$ each independently represent a group having a substituted or unsubstituted aliphatic hydrocarbon structure, a substituted or unsubstituted aromatic ring structure, or a substituted or unsubstituted heterocyclic structure.

In addition, with regard to l, m, $Z_{1a}$, and $Z_{1b}$ in the formula:

when l represents an integer selected from 2 to 4, $Z_{1a}$ represents nothing or a linear alkylene chain having 1 to 4 carbon atoms, $Z_{1b}$ represents a hydrogen atom, and m represents an integer selected from 0 to 8;

when l represents 1 and $Z_{1a}$ represents a linear alkylene chain having 1 to 4 carbon atoms, $Z_{1b}$ represents a hydrogen atom and m represents an integer selected from 0 to 8;

when l represents 1 and $Z_{1a}$ represents nothing, $Z_{1b}$ represents a hydrogen atom and m represents 0;

when l represents 0 and $Z_{1a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{1b}$ represents a hydrogen atom, or a linear or branched alkyl group, aryl group, or aralkyl group which may be substituted by an aryl group, and m represents an integer selected from 0 to 8; and when l represents 0 and $Z_{1a}$ represents nothing, $Z_{1b}$ represents a hydrogen atom, or a linear or branched alkyl group, aryl group, or aralkyl group which may be substituted by an aryl group, and m represents an integer selected from 0 to 8.

In addition, when multiple units exist, R, $R_1$, $R_{1a}$, $A_1$, $Z_{1a}$, $Z_{1b}$, l, and m each independently have the above meaning for each unit.)

(5)

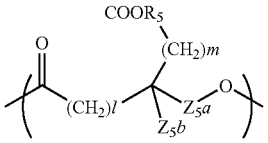

(In the formula, $R_5$ represents hydrogen, a group for forming a salt, or $R_{5a}$, and $R_{5a}$ represents a linear or branched alkyl group having 1 to 12 carbon atoms, or aralkyl group.

In addition, with regard to l, m, $Z_{5a}$, and $Z_{5b}$ in the formula:

when l represents an integer selected from 2 to 4, $Z_{5a}$ represents nothing or a linear alkylene chain having 1 to 4 carbon atoms, $Z_{5b}$ represents a hydrogen atom, and m represents an integer selected from 0 to 8;

when l represents 1 and $Z_{5a}$ represents a linear alkylene chain having 1 to 4 carbon atoms, $Z_{5b}$ represents a hydrogen atom and m represents an integer selected from 0 to 8;

when l represents 1 and $Z_{5a}$ represents nothing, $Z_{5b}$ represents a hydrogen atom and m represents 0;

when l represents 0 and $Z_{5a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{5b}$ represents a hydrogen atom, or a linear or branched alkyl group, aryl group, or aralkyl group which may be substituted by an aryl group, and m represents an integer selected from 0 to 8; and when l represents 0 and $Z_{5a}$ represents nothing, $Z_{5b}$ represents a hydrogen atom, or a linear or branched alkyl group, aryl group, or aralkyl group which may be substituted by an aryl group, and m represents an integer selected from 0 to 8.

In addition, when multiple units exist, $R_5$, $R_5$, $Z_{5a}$, $Z_{5b}$, l, and m each independently have the above meaning for each unit.)

Here, the polyhydroxyalkanoate to be used in the present invention has a basic skeleton as a biodegradable resin, and hence can be used for producing various products by way of melt processing or the like as in the case of conventional plastics. In addition, unlike synthetic polymers derived from petroleum, the polyhydroxyalkanoate has remarkable property with which it is degraded by an organism and taken into cyclical change of materials in the natural environment. Accordingly, there is no need to subject the polyhydroxyalkanoate to combustion treatment, so the polyhydroxyalkanoate is an effective material from the viewpoint of preventing air pollution and global warming. Therefore, the polyhydroxyalkanoate can be used as a plastic enabling environmental conservation.

The polyhydroxyalkanoate represented by the chemical formula (1) as a target in the present invention can be produced by a reaction between a polyhydroxyalkanoate containing a unit represented by the chemical formula (11) used as a starting material and at least one kind of aminosulfonic acid compound represented by the chemical formula (13).

(11)

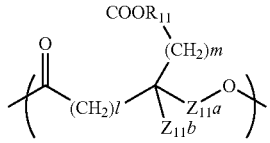

(In the formula, $R_{11}$ represents hydrogen or a group forming a salt.

In addition, with regard to l, m, $Z_{11a}$, and $Z_{11b}$ in the formula:

when l represents an integer selected from 2 to 4, $Z_{11a}$ represents nothing or a linear alkylene chain having 1 to 4 carbon atoms, $Z_{11b}$ represents a hydrogen atom, and m represents an integer selected from 0 to 8;

when l represents 1 and $Z_{11a}$ represents a linear alkylene chain having 1 to 4 carbon atoms, $Z_{11b}$ represents a hydrogen atom and m represents an integer selected from 0 to 8;

when l represents 1 and $Z_{11a}$ represents nothing, $Z_{11b}$ represents a hydrogen atom and m represents 0;

when l represents 0 and $Z_{11a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{11b}$ represents a hydrogen atom, or a linear or branched alkyl group, aryl group, or aralkyl group which may be substituted by an aryl group, and m represents an integer selected from 0 to 8; and when l represents 0 and $Z_{11a}$ represents nothing, $Z_{11b}$ represents a hydrogen atom, or a linear or branched alkyl group, aryl group, or aralkyl group which may be substituted by an aryl group, and m represents an integer selected from 0 to 8.

In addition, when multiple units exist, $R_{11}$, $Z_{11a}$, $Z_{11b}$, l, and m each independently have the above meaning for each unit.)

More specifically, in the compound represented by the chemical formula (11) to be used in the present invention, when 1 represents 0 and $Z_{11a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof. Specific examples thereof include a substituted or unsubstituted cyclohexyl structure, a substituted or unsubstituted phenyl structure, a substituted or unsubstituted phenoxy structure, a substituted or unsubstituted benzoyl structure, a substituted or unsubstituted phenylsulfanyl structure, a substituted or unsubstituted phenylsulfinyl structure, a substituted or unsubstituted phenylsulfonyl structure, a substituted or unsubstituted (phenylmethyl)sulfanyl structure, a (phenylmethyl)oxy structure, a 2-thienyl structure, a 2-thienylsulfanyl structure, and a 2-thienylcarbonyl structure.

In addition, in the compound represented by the chemical formula (11) to be used in the present invention, when 1 represents 0, $Z_{11b}$ represents a hydrogen atom, or a linear or branched alkyl group, aryl group, or aralkyl group which is substituted by an aryl group. Specific examples of the linear or branched alkyl group include a methyl group, an ethyl group, a propyl group, an isopropyl group (2-methylpropyl group), a butyl group, a 1-methylpropyl group, a pentyl group, an isopropyl group (3-methylbutyl group), a hexyl group, an isohexyl group (4-methylpentyl group), and a heptyl group. Examples of the aryl group include a phenyl group and a methylphenyl group. Examples of the aralkyl group include a phenylmethyl group (benzyl group), a phenylethyl group, a phenylpropyl group, a phenylbutyl group, a phenylpentyl group, and a methylbenzyl group. In the present invention, in synthesizing a polymer, $Z_{11b}$ preferably represents a methyl group, an ethyl group, a propyl group, an isopropyl group, a pentyl group, a hexyl group, a phenyl group, or a phenylmethyl group in consideration of productivity.

$$H_2N\text{-}A\text{-}SO_2R_{13} \quad (13)$$

(In the formula:

$R_{13}$ represents OH, a halogen atom, ONa, OK, or $OR_{13a}$; and $R_{13a}$ and $A_3$ each independently represent a substituted or unsubstituted aliphatic hydrocarbon structure, a substituted or unsubstituted aromatic ring structure, or a substituted or unsubstituted heterocyclic structure. In addition, when multiple units exist, $R_{13}$, $R_{13a}$, and $A_3$ each independently have the above meaning for each unit.) More specifically, $R_{13}$ represents OH, a halogen atom, ONa, OK, or $OR_{13a}$. $R_{13a}$ represents a linear or branched alkyl group having 1 to 8 carbon atoms, or a substituted or unsubstituted phenyl group.

$A_3$ represents a liner or branched and substituted or unsubstituted alkylene group having 1 to 8 carbon atoms, a substituted or unsubstituted phenylene group, a substituted or unsubstituted naphthalene group, or a substituted or unsubstituted heterocyclic structure containing one or more of N, S, and O. When $A_3$ represents a ring structure, an unsubstituted ring may be further condensed. In addition, when multiple units exist, $R_{13}$, $R_{13a}$, and $A_3$ each independently have the above meaning for each unit.

When $A_3$ represents a linear and substituted or unsubstituted alkylene group, a compound represented by the following chemical formula (18) is exemplified.

$$H_2N\text{-}A_1\text{-}SO_2R_{18} \quad (18)$$

(In the formula, $R_{18}$ represents OH, a halogen atom, ONa, OK, or $OR_{18a}$. $R_{18a}$ represents a linear or branched alkyl group having 1 to 8 carbon atoms, or a substituted or unsubstituted phenyl group. $A_4$ represents a liner or branched and substituted or unsubstituted alkylene group having 1 to 8 carbon atoms, which may be substituted by an alkyl group, an alkoxy group, or the like having 1 to 20 carbon atoms.)

Examples of the compound represented by the chemical formula (18) include 2-aminoethanesulfonic acid (taurine), 3-aminopropanesulfonic acid, 4-aminobutanesulfonic acid, 2-amino-2-methylpropanesulfonic acid, and alkali metal salts and esterified products of them.

When $A_3$ represents a substituted or unsubstituted phenylene group, an example of the compound represented by the chemical formula (13) includes a compound represented by the following chemical formula (19).

(19)

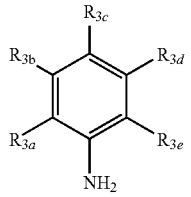

(In the formula, at least one of $R_{3a}$, $R_{3b}$, $R_{3c}$, $R_{3d}$, and $R_{3e}$ represents $SO_2R_{3f}$ ($R_{3f}$ represents OH, a halogen atom, ONa, OK, or $OR_{3f1}$. $R_{3f}$ represents a linear or branched alkyl group having 1 to 8 carbon atoms, or a substituted or unsubstituted phenyl group.), and the others each independently represent a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{3g}$ ($R_{3g}$ represents an H atom, an Na atom, or a K atom.), an acetamide group, an OPh group, an NHPh group, a $CF_3$ group, a $C_2F_5$ group, or a $C_3F_7$ group. In addition, when multiple units exist, $R_{3a}$, $R_{3b}$, $R_{3c}$, $R_{3d}$, $R_{3e}$, $R_{3f}$, $R_{3f1}$, and $R_{3g}$ each independently have the above meaning for each unit.)

Examples of the compound represented by the chemical formula (19) include p-aminobenzenesulfonic acid (sulfanilic acid), m-aminobenzenesulfonic acid, o-aminobenzenesulfonic acid, m-toluidine-4-sulfonic acid, o-toluidine-4-sulfonic acid, p-toluidine-2-sulfonic acid, 4-methoxyaniline-2-sulfonic acid, o-anisidine-5-sulfonic acid, p-anisidine-3-sulfonic acid, 3-nitroaniline-4-sulfonic acid, 2-nitroaniline-4-sulfonic acid, 4-nitroaniline-2-sulfonic acid, 1,5-dinitroaniline-4-sulfonic acid, 2-aminophenol-4-hydroxy-5-nitrobenzenesulfonic acid, 2,4-dimethylaniline-5-sulfonic acid, 2,4-dimethylaniline-6-sulfonic acid, 3,4-dimethylaniline-5-sulfonic acid, 4-isopropylaniline-6-sulfonic acid, 4-trifluoromethylaniline-6-sulfonic acid, 3-carboxy-4-hydroxyaniline-5-sulfonic acid, 4-carboxyaniline-6-sulfonic acid, and alkali metal salts and esterified products of them.

When $A_3$ represents a substituted or unsubstituted naphthalene group, an example of the compound represented by the chemical formula (13) includes a compound represented by the following chemical formula (20A) or (20B).

(20B)

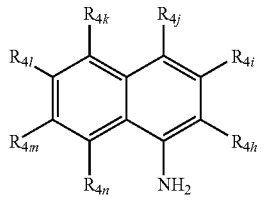

-continued (20A)

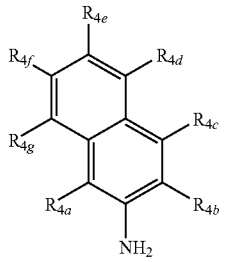

(At least one of $R_{4a}$, $R_{4b}$, $R_{4c}$, $R_{4d}$, $R_{4e}$, $R_{4f}$, and $R_{4g}$ in the formula (20A) or at least one of $R_{4h}$, $R_{4i}$, $R_{4j}$, $R_{4k}$, $R_{4l}$, $R_{4m}$, and $R_{4n}$ in the formula (20B) represents $SO_2R_{4o}$ ($R_{4o}$ represents OH, a halogen atom, ONa, OK, or $OR_{4o1}$. $R_{4o1}$ represents a linear or branched alkyl group having 1 to 8 carbon atoms, or a substituted or unsubstituted phenyl group.), and the others each independently represent a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{4p}$ ($R_{4p}$ represents an H atom, an Na atom, or a K atom.), an acetamide group, an OPh group, an NHPh group, a $CF_3$ group, a $C_2F_5$ group, or a $C_3F_7$ group. In addition, when multiple units exist, $R_{4a}$, $R_{4b}$, $R_{4c}$, $R_{4d}$, $R_{4e}$, $R_{4f}$, $R_{4g}$, $R_{4h}$, $R_{4i}$, $R_{4j}$, $R_{4k}$, $R_{4l}$, $R_{4m}$, $R_{4n}$, $R_{4o}$, $R_{4o1}$, $R_{4p}$, and m each independently have the above meaning for each unit.)

Examples of the compound represented by the chemical formula (20A) or (20B) include: sulfonic acids such as 1-naphthylamine-5-sulfonic acid, 1-naphthylamine-4-sulfonic acid, 1-naphthylamine-8-sulfonic acid, 2-naphthylamine-5-sulfonic acid, 1-naphthyalmine-6-sulfonic acid, 1-naphthylamine-7-sulfonic acid, 1-naphthylamine-2-ethoxy-6-sulfonic acid, 1-amino-2-naphthol-4-sulfonic acid, 6-amino-1-naphthol-3-sulfonic acid, sodium 1-amino-8-naphthol-2,4-sulfonate, sodium 1-amino-8-naphthol-3,6-sulfonate; and alkali metal salts and esterified products of the sulfonic acids.

When $A_3$ represents a substituted or unsubstituted heterocyclic structure containing one or more of N, S, and O, the heterocyclic ring may be any one of a pyridine ring, a piperazine ring, a furan ring, and a thiol ring. Examples of the compound include: sulfonic acids such as 2-aminopyridine-6-sulfonic acid, 2-aminopiperazine-6-sulfonic acid; and alkali metal salts and esterified products of the sulfonic acids.

Examples of a sulfonate include a substituted or unsubstituted aliphatic hydrocarbon structure, a substituted or unsubstituted aromatic ring structure, and a substituted or unsubstituted heterocyclic structure. In particular, a linear or branched alkyl group having 1 to 8 carbon atoms, a substituted or unsubstituted phenyl group, or the like is preferable. From the viewpoint of, for example, ease of esterification, one having a group such as $OCH_3$, $OC_2H_5$, $OC_6H_5$, $OC_3H_7$, $OC_4H_9$, $OCH(CH_3)_2$, $OCH_2C(CH_3)_3$, or $OC(CH_3)_3$ is more preferable.

(Method of Producing Polyhydroxyalkanoate Represented by Chemical Formula (1))

A reaction between a polyhydroxyalkanoate containing a unit represented by the chemical formula (11) and an aminosulfonic acid compound represented by the chemical formula (13) in the present invention will be described in detail.

The amount of the compound represented by the chemical formula (13) to be used in the present invention is in the range of 0.1 to 50.0 times mole, or preferably 1.0 to 20.0 times mole with respect to the unit represented by the chemical formula (11) to be used as a starting material.

An example of a method of producing an amide bond from a carboxylic acid and an amine in the present invention includes a condensation reaction by virtue of heat dehydration. In particular, from the viewpoint of achieving a mild reaction condition under which an ester bond of a polymer main chain is not cleaved, a method is effective, which involves: activating a carboxylic acid portion with an activator to produce an active acyl intermediate; and allowing the intermediate to react with an amine. Examples of the active acyl intermediate include an acid halide, an acid anhydride, and an active ester. In particular, a method of forming an amide bond in an identical reaction field by using a condensing agent is preferable from the viewpoint of simplifying a production process.

If required, the active acyl intermediate may be isolated as an acid halide before being subjected to a condensation reaction with an amine.

A phosphoric acid-based condensing agent used for polycondensation of an aromatic polyamide, a carbodiimide-based condensing agent used for synthesizing a peptide, an acid chloride-based condensing agent, or the like can be appropriately selected as a condensing agent to be used depending on the combination of the chemical formulae (13) and (11).

Examples of the phosphoric acid-based condensing agent include a phosphite-based condensing agent, a phosphorus chloride-based condensing agent, a phosphoric anhydride-based condensing agent, a phosphate-based condensing agent, and a phosphoric amide-based condensing agent.

A phosphite-based condensing agent or the like can be used in the reaction of the present invention. Examples of a phosphite used at this time include triphenyl phosphite, diphenyl phosphite, tri-o-tolyl phosphite, di-o-tolyl phosphite, tri-m-tolyl phosphite, di-m-tolyl phosphite, tri-p-tolyl phosphite, di-p-tolyl phosphite, di-o-chlorophenyl phosphite, tri-p-chlorophenyl phosphite, di-p-chlorophenyl phosphite, trimethyl phosphite, and triethyl phosphite. Of those, triphenyl phosphite is preferably used. A metal salt such as lithium chloride or calcium chloride may be added for improving the solubility, reactivity, and the like of a polymer.

Examples of the carbodiimide-based condensing agent include dicyclohexyl carbodiimide (which may be referred to as DCC), N-ethyl-N'-3-dimethylaminopropyl carbodiimide (which may be referred to as EDC=WSCI), and diisopropyl carbodiimide (which may be referred to as DIPC). DCC or WSCI may be used in combination with N-hydroxysuccinimide (which may be referred to as HONSu), 1-hydroxybenzotriazole (which may be referred to as HOBt), 3-hydroxy-4-oxo-3,4-dihydro-1,2,3-benzotriazine (which may be referred to as HOObt), or the like.

The amount of the condensing agent to be used is in the range of 0.1 to 50 times mole, or preferably 1 to 20 times mole with respect to the compound represented by the chemical formula (11).

A solvent may be used as required in the reaction. Examples of an available solvent include: hydrocarbons such as hexane, cyclohexane, and heptane; ketones such as acetone and methyl ethyl ketone; ethers such as dimethyl ether, diethyl ether, and tetrahydrofuran; halogenated hydrocarbons such as dichloromethane, chloroform, carbon tetrachloride, dichloroethane, and trichloroethane; aromatic hydrocarbons such as benzene and toluene; aprotic polar solvents such as N,N-dimethylformamide, dimethyl sulfoxide, dimethyl acetamide, and hexamethylphosphoramide; pyridine, and pyridine derivatives such as picoline; and N-methylpyrrolidone. Pyridine, N-methylpyrrolidone, or the like is particularly preferably used. The amount of the solvent to be used can be appropriately determined in accordance with kinds of a starting material and a base, a reaction condition, and the like. A reaction temperature is not particularly limited, but is generally in the range of −20° C. to the boiling point of a solvent. However, it is preferable to perform the reaction at an optimum temperature suited for a condensing agent to be used. A reaction time is generally in the range of 1 to 48 hours. The reaction time is particularly preferably in the range of 1 to 10 hours.

A thus produced reaction solution containing a polyhydroxyalkanoate represented by the chemical formula (1) in the present invention can be purified by, for example, distillation as an ordinary method. Alternatively, the reaction solution can be collected by: using a solvent, for example, water, an alcohol such as methanol or ethanol, or an ether such as dimethyl ether, diethyl ether, or tetrahydrofuran; mixing a solvent which does not dissolve the polyhydroxyalkanoate represented by the chemical formula (1) evenly with the reaction solution; and reprecipitating a target polyhydroxyalkanoate represented by the chemical formula (1). The resultant polyhydroxyalkanoate represented by the chemical formula (1) can be subjected to isolation purification as required. A method for the isolation purification is not particularly limited, and a method involving reprecipitation using a solvent that does not dissolve the polyhydroxyalkanoate represented by the chemical formula (1), a method according to column chromatography, dialysis, or the like can be used.

When an R portion in the chemical formula (1) is $-A_1-SO_3CH_3$, a method can be adopted as another production method of the present invention, which involves methyl esterifying the R portion in the chemical formula (1) into $-A_1-SO_3CH_3$ using a methyl-esterifying agent after a condensation reaction with an amine. Examples of an available methyl-esterifying agent include ones used in a methyl esterification method for an aliphatic acid in gas chromatography.

Examples of an acid catalyst method include a hydrochloric acid-methanol method, a boron trifluoride-methanol method, and a sulfuric acid-methanol method. Examples of a base catalyst method include a sodium methoxide method, a tetramethylguanidine method, and a trimethylsilyldiazomethane method. Of those, a trimethylsilyldiazomethane method is preferable because methylation can be performed under a moderate condition.

Examples of a solvent to be used in the reaction include: hydrocarbons such as hexane, cyclohexane, and heptane; alcohols such as methanol and ethanol; halogenated hydrocarbons such as dichloromethane, chloroform, carbon tetrachloride, dichloroethane, and trichloroethane; and aromatic hydrocarbons such as benzene and toluene. Halogenated hydrocarbons and the like are particularly preferably used. The amount of the solvent to be used can be appropriately determined in accordance with a starting material, a reaction condition, and the like. A reaction temperature is not particularly limited in the method of the present invention, but is generally in the range of −20° C. to 30° C. However, it is preferable to perform the reaction at an optimum temperature suited for a condensing agent and a reagent to be used.

In addition, in the present invention, a polyhydroxyalkanoate containing a unit represented by the chemical formula (H) can be produced through the steps of: allowing a polyhydroxyalkanoate having a unit represented by the chemical formula (G) to react with a base; and allowing the compound obtained in the foregoing step to react with a compound represented by the chemical formula (E).

(G)

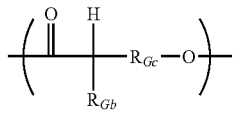

(In the formula, $R_{Gc}$ represents a linear alkylene chain having 0 to 4 carbon atoms. When the linear alkylene chain is a linear alkylene chain having 1 to 4 carbon atoms, the linear alkylene chain may be arbitrarily substituted by a linear or branched alkyl group, or an alkyl group containing a residue having any one of a phenyl structure, a thienyl structure, and a cyclohexyl structure at a terminal thereof. In addition, $R_{Gb}$ represents a hydrogen atom, or a linear or branched alkyl group, aryl group, or aralkyl group which may be substituted by an aryl group. When multiple units exist, $R_{Gb}$ and $R_{Gc}$ each independently have the above meaning for each unit.)

More specifically, in the polyhydroxyalkanoate composed of a unit of a substituted hydroxylic acid represented by the chemical formula (G) to be used in the present invention, when $R_{Gc}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof. Specific examples thereof include a substituted or unsubstituted cyclohexyl structure, a substituted or unsubstituted phenyl structure, a substituted or unsubstituted phenoxy structure, a substituted or unsubstituted benzoyl structure, a substituted or unsubstituted phenylsulfanyl structure, a substituted or unsubstituted phenylsulfinyl structure, a substituted or unsubstituted phenylsulfonyl structure, a substituted or unsubstituted (phenylmethyl)sulfanyl structure, a (phenylmethyl)oxy structure, a 2-thienyl structure, a 2-thienylsulfanyl structure, and a 2-thienylcarbonyl structure. In addition, $R_{Gb}$ represents a hydrogen atom, or a linear or branched alkyl group, aryl group, or aralkyl group which is substituted by an aryl group. Specific examples of the linear or branched alkyl group include a methyl group, an ethyl group, a propyl group, an isopropyl group (2-methylpropyl group), a butyl group, a 1-methylpropyl group, a pentyl group, an isopropyl group (3-methylbutyl group), a hexyl group, an isohexyl group (4-methylpentyl group), and a heptyl group. Examples of the aryl group include a phenyl group and a methylphenyl group. Examples of the aralkyl group include a phenylmethyl group (benzyl group), a phenylethyl group, a phenylpropyl group, a phenylbutyl group, a phenylpentyl group, and a methylbenzyl group. In the present invention, in synthesizing a polymer, $R_{Gb}$ preferably represents a methyl group, an ethyl group, a propyl group, an isopropyl group, a pentyl group, a hexyl group, a phenyl group, or a phenylmethyl group in consideration of productivity.

(E)

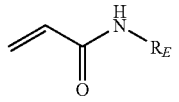

(In the formula, $R_E$ represents $-A_E-SO_2R_{E1}$. $R_{E1}$ represents OH, a halogen atom, ONa, OK, or $OR_{Ea}$. In addition, $R_{Ea}$ and $A_E$ each independently represent a group having a substituted or unsubstituted aliphatic hydrocarbon structure, a substituted or unsubstituted aromatic ring structure, or a substituted or unsubstituted heterocyclic structure. When multiple units exist, $R_E$, $R_{E1}$, $R_{Ea}$, and $A_E$ each independently have the above meaning for each unit.)

(H)

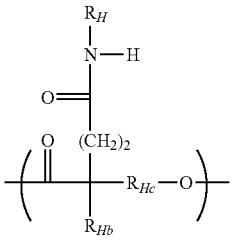

(In the formula, RH represents $-A_H-SO_2R_{H1}$. $R_{H1}$ represents OH, a halogen atom, ONa, OK, or $OR_{Ha}$. $R_{Ha}$ and AH each independently represent a group having a substituted or unsubstituted aliphatic hydrocarbon structure, a substituted or unsubstituted aromatic ring structure, or a substituted or unsubstituted heterocyclic structure. $R_{Hc}$ represents a linear alkylene chain having 0 to 4 carbon atoms. When the linear alkylene chain is a linear alkylene chain having 1 to 4 carbon atoms, the linear alkylene chain may be arbitrarily substituted by a linear or branched alkyl group, or an alkyl group containing a residue having any one of a phenyl structure, a thienyl structure, and a cyclohexyl structure at a terminal thereof. In addition, $R_{Hb}$ represents a hydrogen atom, or a linear or branched alkyl group, aryl group, or aralkyl group which may be substituted by an aryl group. When multiple units exist, $R_H$, $R_{H1}$, $R_{Ha}$, $R_{Hb}$, $R_{Hc}$, and $A_H$ each independently have the above meaning for each unit.)

For example, a polyhydroxyalkanoate containing a unit represented by the chemical formula (F) corresponding to the chemical formula (H) in which the linear alkylene chain represented by $R_{Hc}$ is not substituted and $R_{Hb}$ represents a hydrogen atom can be produced through the steps of: allowing a polyhydroxyalkanoate having a unit represented by the chemical formula (A) as a staring material to react with a base; and allowing the compound obtained in the foregoing step to react with a compound represented by the chemical formula (E).

(F)

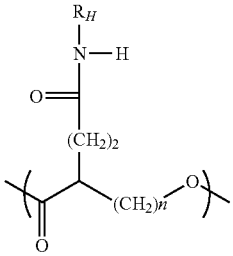

(In the formula, n represents an integer selected from 0 to 4. $R_F$ represents $-A_F-SO_2R_{F1}$. $R_{F1}$ represents OH, a halogen atom, ONa, OK, or $OR_{Fa}$. $R_{Fa}$ and $A_F$ each independently represent a group having a substituted or unsubstituted aliphatic hydrocarbon structure, a substituted or unsubstituted aromatic ring structure, or a substituted or unsubstituted heterocyclic structure. When multiple units exist, RF, $R_{F1}$, $R_{Fa}$, $A_F$, and n each independently have the above meaning for each unit.)

(A)

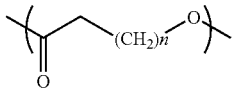

(In the formula, n represents an integer selected from 0 to 4. When multiple units exist, n's each independently have the above meaning for each unit.)

(E)

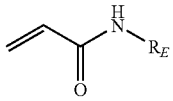

(In the formula, RE represents $-A_E-SO_2R_{E1}$. $R_{E1}$ represents OH, a halogen atom, ONa, OK, or $OR_{Ea}$. In addition, $R_{Ea}$ and $A_E$ each independently represent a group having a substituted or unsubstituted aliphatic hydrocarbon structure, a substituted or unsubstituted aromatic ring structure, or a substituted or unsubstituted heterocyclic structure. When multiple units exist, $R_E$, $R_{E1}$, $R_{Ea}$, $A_E$, and n each independently have the above meaning for each unit.)

Examples of the compound represented by the chemical formula (E) include 2-acrylamide-2-methylpropanesulfonic acid, and alkali metal salts and esterified products thereof.

A reaction between the polyhydroxyalkanoate containing a unit represented by the chemical formula (A) and the compound represented by the chemical formula (E) will be described in detail.

The present invention can be achieved by subjecting an α-methylene group adjacent to a carbonyl group in a polymer main chain to a Michael addition reaction with the compound represented by the chemical formula (E). To be specific, the present invention can be achieved by: allowing the polyhydroxyalkanoate containing a unit represented by the chemical formula (A) to react with a base capable of forming an α-methylene group, which is adjacent to a carbonyl group in the polymer main chain of the polyhydroxyalkanoate containing a unit represented by the chemical formula (A), into an anion under a Michael addition reaction condition; and allowing the resultant to react with the compound represented by the chemical formula (E). In the present invention, the amount of the compound represented by the chemical formula (E) to be used is 0.001 to 100 times mole, or preferably 0.01 to 10 times mole with respect to the unit represented by the chemical formula (A).

A solvent to be used in the reaction of the present invention is not particularly limited as long as it is inactive to the reaction and dissolves the staring material to some extent. Examples of such a solvent include: aliphatic hydrocarbons such as hexane, cyclohexane, heptane, ligroin, and petroleum ether; aromatic hydrocarbons such as benzene, toluene, and xylene; ethers such as diethyl ether, diisopropyl ether, tetrahydrofuran, dioxane, dimethoxyethane, and diethyleneglycoldimethylether; and amides such as formamide, N,N-dimethylformamide, N,N-dimethylacetamide, N-methyl-2-pyrrolidone, N-methylpyrrolidinone, and hexamethylphosphorotriamide. Of those, tetrahydrofuran is preferable.

The reaction is performed in the presence of a base. Examples of a base to be used include: lithium alkyls such as methyl lithium and butyl lithium; alkali metal disilazides such as lithium hexamethyl disilazide, sodium hexamethyl disilazide, and potassium hexamethyl disilazide; and lithium amides such as lithium diisopropylamide and lithium dicyclohexylamide. Of those, lithium diisopropylamide is preferable. In addition, the amount of the base to be used is 0.001 to 100 times mole, or preferably 0.01 to 10 times mole with respect to the unit represented by the chemical formula (A).

A reaction temperature in the method of the present invention is generally in the range of −78° C. to 40° C., or preferably in the range of −78° C. to 30° C.

A reaction time in the method of the present invention is generally in the range of 10 minutes to 24 hours. The reaction time is particularly preferably in the range of 10 minutes to 4 hours.

Of the polyhydroxyalkanoate represented by the chemical formula (5) of the present invention, the polyhydroxyalkanoate represented by the chemical formula (21) can be produced by oxidizing a side chain double bond portion of a polyhydroxyalkanoate represented by the chemical formula (6) as a starting material.

(21)

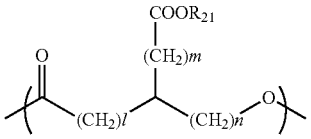

(In the formula, $R_{21}$ represents hydrogen or a group for forming a salt.

In addition, with regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8.

In addition, when multiple units exist, $R_{21}$, l, m, and n each independently have the above meaning for each unit.)

(6)

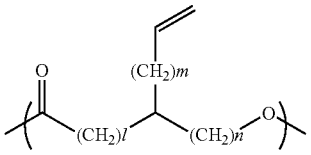

(With regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8; and when multiple units exist, l, m, and n each independently have the above meaning for each unit.)

Known examples of a method of obtaining a carboxylic acid by subjecting such a carbon-carbon double bond as described above to oxidation cleavage by means of an oxidizing agent include a method involving the use of a permanganate (J. Chem. Soc., Perkin. Trans. 1, 806 (1973)), a method involving the use of a dichromate (Org. Synth., 4, 698 (1963)), a method involving the use of a periodate (J. Org. Chem., 46, 19 (1981)), a method involving the use of nitric acid (Japanese Patent Application Laid-Open No. S59-190945), and a method involving the use of ozone (J. Am. Chem. Soc., 81, 4273 (1959)). In addition, Macromolecular chemistry, 4, 289-293 (2001) has reported a method of obtaining a carboxylic acid involving subjecting a carbon-carbon double bond of a side chain terminal of a polyhydroxyalkanoate produced by using a microorganism to a reaction under an acid condition by means of potassium permanganate as an oxidizing agent. A similar method can be used in the present invention.

Potassium permanganate is generally used as a permanganate to be used as an oxidizing agent. The amount of the permanganate to be used is generally 1 mole equivalent or more, or preferably 2 to 10 mole equivalents with respect to 1 mole of the unit represented by the chemical formula (6) because an oxidation cleavage reaction is a stoichiometric reaction.

Various inorganic acids such as sulfuric acid, hydrochloric acid, acetic acid, and nitric acid, and organic acids are used to place a reaction system under an acid condition. However, the use of an acid such as sulfuric acid, nitric acid, or hydrochloric acid may cause a molecular weight to reduce because an ester bond of a main chain is cleaved. Therefore, acetic acid is preferably used. The amount of an acid to be used is generally in the range of 0.2 to 2,000 mole equivalents, or preferably in the range of 0.4 to 1,000 mole equivalents with respect to 1 mole of the unit represented by the chemical formula (6). An amount of less than 0.2 mole equivalent is not preferable because yield is low, while an amount of in excess of 2,000 mole equivalents is not preferable because a decomposed product due to the acid is produced as a by-product. In addition, a crown-ether can be used for the purpose of accelerating the reaction. In this case, the crown-ether and the permanganate form a complex, thereby providing an enhancing effect on reaction activity. Dibenzo-18-crown-6-ether, dicyclo-18-crown-6-ether, or 18-crown-6-ether is generally used as the crown-ether. The amount of the crown-ether to be used is generally in the range of 0.005 to 2.0 mole equivalents, or preferably in the range of 0.01 to 1.5 mole equivalents with respect to 1 mole of the permanganate.

A solvent to be used in an oxidation reaction is not particularly limited as long as it is inactive to the reaction. Examples of such a solvent include: water; acetone; ethers such tetrahydrofuran and dioxane; aromatic hydrocarbons such as benzene; aliphatic hydrocarbons such as hexane and heptane; and halogenated hydrocarbons such as methyl chloride, dichloromethane, and chloroform. Of those solvents, halogenated hydrocarbons such as methyl chloride, dichloromethane, and chloroform, and acetone are preferable in consideration of the solubility of the polyhydroxyalkanoate.

In the oxidation reaction, the polyhydroxyalkanoate containing a unit represented by the chemical formula (6), the permanganate, and the acid may be collectively charged together with a solvent at the first stage to carry out a reaction, or each of them may be continuously or intermittently added to a system to carry out a reaction. Alternatively, only the permanganate may be dissolved or suspended into the solvent in advance, and subsequently the polyhydroxyalkanoate and the acid may be continuously or intermittently added to the system to carry out a reaction. Alternatively, only the polyhydroxyalkanoate may be dissolved or suspended into the solvent in advance, and subsequently the permanganate and the acid may be continuously or intermittently added to the system to carry out a reaction. Furthermore, the polyhydroxyalkanoate and the acid may be charged in advance, and subsequently the permanganate may be continuously or intermittently added to the system to carry out a reaction. Alternatively, the permanganate and the acid may be charged in advance, and subsequently the polyhydroxyalkanoate may be continuously or intermittently added to the system to carry out a reaction. Alternatively, the polyhydroxyalkanoate and the permanganate may be charged in advance, and subsequently the acid may be continuously or intermittently added to the system to carry out a reaction.

A reaction temperature is generally in the range of −40° C. to 40° C., or preferably in the range of −10° C. to 30° C. A reaction time, which depends on the stoichiometric mixture ratio between the unit represented by the chemical formula (6) and the permanganate, is generally in the range of 2 to 48 hours.

In addition, in the polyhydroxyalkanoate represented by the chemical formula (5), the polyhydroxyalkanoate represented by the chemical formula (11) is produced by hydrolyzing a side chain ester portion of a polyhydroxyalkanoate represented by the chemical formula (23) as a starting material in the presence of an acid or an alkali, or by subjecting the polyhydroxyalkanoate to hydrogenolysis including catalytic reduction.

(11)

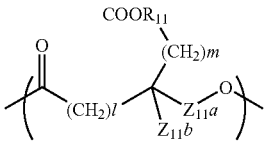

(In the formula, $R_{11}$ represents hydrogen or a group forming a salt.

In addition, with regard to l, m, $Z_{11a}$, and $Z_{11b}$ in the formula:

when l represents an integer selected from 2 to 4, $Z_{11a}$ represents nothing or a linear alkylene chain having 1 to 4 carbon atoms, $Z_{11b}$ represents a hydrogen atom, and m represents an integer selected from 0 to 8;

when l represents 1 and $Z_{11a}$ represents a linear alkylene chain having 1 to 4 carbon atoms, $Z_{11b}$ represents a hydrogen atom and m represents an integer selected from 0 to 8;

when l represents 1 and $Z_{11a}$ represents nothing, $Z_{11b}$ represents a hydrogen atom and m represents 0;

when l represents 0 and $Z_{11a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{11b}$ represents a hydrogen atom, or a linear or branched alkyl group, aryl group, or aralkyl group which may be substituted by an aryl group, and m represents an integer selected from 0 to 8; and when l represents 0 and $Z_{11a}$ represents nothing, $Z_{11b}$ represents a hydrogen atom, or a linear or branched alkyl group, aryl group, or aralkyl group which may be substituted by an aryl group, and m represents an integer selected from 0 to 8.

In addition, when multiple units exist, $R_{11}$, $Z_{11a}$, $Z_{11b}$, l, and m each independently have the above meaning for each unit.)

(23)

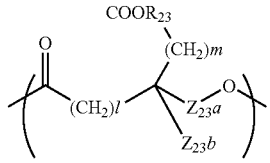

(In the formula, $R_{23}$ represents a linear or branched alkyl having 1 to 12 carbon atoms, or aralkyl group.

In addition, with regard to l, m, $Z_{23a}$, and $Z_{23b}$ in the formula:

when l represents an integer selected from 2 to 4, $Z_{23a}$ represents nothing or a linear alkylene chain having 1 to 4 carbon atoms, $Z_{23b}$ represents a hydrogen atom, and m represents an integer selected from 0 to 8;

when l represents 1 and $Z_{23a}$ represents a linear alkylene chain having 1 to 4 carbon atoms, $Z_{23b}$ represents a hydrogen atom and m represents an integer selected from 0 to 8;

when 1 represents 1 and $Z_{23a}$ represents nothing, $Z_{23b}$ represents a hydrogen atom and m represents 0;

when l represents 0 and $Z_{23a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{23b}$ represents a hydrogen atom, or a linear or branched alkyl group, aryl group, or aralkyl group which may be substituted by an aryl group, and m represents an integer selected from 0 to 8; and when l represents 0 and $Z_{23a}$ represents nothing, $Z_{23b}$ represents a hydrogen atom, or a linear or branched alkyl group, aryl group, or aralkyl group which may be substituted by an aryl group, and m represents an integer selected from 0 to 8.

In addition, when multiple units exist, $R_{23}$, $Z_{23a}$, $Z_{23b}$, l, and m each independently have the above meaning for each unit.)

More specifically, in the compound represented by the chemical formula (23) to be used in the present invention, when l represents 0 and $Z_{23a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof. Specific examples thereof include a substituted or unsubstituted cyclohexyl structure, a substituted or unsubstituted phenyl structure, a substituted or unsubstituted phenoxy structure, a substituted or unsubstituted benzoyl structure, a substituted or unsubstituted phenylsulfanyl structure, a substituted or unsubstituted phenylsulfinyl structure, a substituted or unsubstituted phenylsulfonyl structure, a substituted or unsubstituted (phenylmethyl)sulfanyl structure, a (phenylmethyl)oxy structure, a 2-thienyl structure, a 2-thienylsulfanyl structure, and a 2-thienylcarbonyl structure.

In addition, in the compound represented by the chemical formula (23) to be used in the present invention, when 1 represents 0, $Z_{23b}$ represents a hydrogen atom, or a linear or branched alkyl group, aryl group, or aralkyl group which is substituted by an aryl group. Specific examples of the linear or branched alkyl group include a methyl group, an ethyl group, a propyl group, an isopropyl group (2-methylpropyl group), a butyl group, a 1-methylpropyl group, a pentyl group, an isopropyl group (3-methylbutyl group), a hexyl group, an isohexyl group (4-methylpentyl group), and a heptyl group. Examples of the aryl group include a phenyl group and a methylphenyl group. Examples of the aralkyl group include a phenylmethyl group (benzyl group), a phenylethyl group, a phenylpropyl group, a phenylbutyl group, a phenylpentyl group, and a methylbenzyl group. In the present invention, in synthesizing a polymer, $Z_{23b}$ preferably represents a methyl group, an ethyl group, a propyl group, an isopropyl group, a pentyl group, a hexyl group, a phenyl group, or a phenylmethyl group in consideration of productivity.

In the case where hydrolysis in the presence of an acid or an alkali is employed, the hydrolysis can be performed by using, in an aqueous solution or a hydrophilic organic solvent such as methanol, ethanol, tetrahydrofuran, dioxane, dimethylformamide, or dimethyl sulfoxide as a solvent, an aqueous solution of an inorganic acid such as hydrochloric acid, sulfuric acid, nitric acid, or phosphoric acid, an organic acid such as trifluoroacetic acid, trichloroacetic acid, p-toluenesulfonic acid, or methanesulfonic acid, an aqueous caustic alkali such as sodium hydroxide or potassium hydroxide, an aqueous solution of an alkali carbonate such as sodium carbonate or potassium carbonate, or an alcohol solution of a metal alkoxide such as sodium methoxide or sodium ethoxide. A reaction temperature is generally in the range of 0° C. to 40° C., or preferably in the range of 0° C. to 30° C. A reaction time is generally in the range of 0.5 to 48 hours. When hydrolysis is performed in the presence of an acid or an alkali, in each case, an ester bond of a main chain is cleaved, and a reduction in molecular weight is observed in some cases.

A method of obtaining a carboxylic acid by way of hydrogenolysis including catalytic reduction is performed as follows. That is, in an appropriate solvent, in the temperature range of −20° C. to the boiling point of the solvent used, or preferably 0 to 50° C., in the presence of a reduction catalyst, hydrogen is allowed to act under normal or increased pressure to perform catalytic reduction. Examples of the solvent used include water, methanol, ethanol, propanol, hexafluoroisopropanol, ethyl acetate, diethyl ether, tetrahydrofuran, dioxane, benzene, toluene, dimethylformamide, pyridine, and N-methylpyrrolidone. A mixed solvent of the above solvents may also be used. A catalyst such as palladium, platinum, or rhodium which is used singly or used while being carried by a carrier, Raney nickel, or the like is used as the reduction catalyst. A reaction time is generally in the range of 0.5 to 72 hours. A thus produced reaction solution containing a polyhydroxyalkanoate represented by the chemical formula (11) is collected as a crude polymer by: removing the catalyst through filtration; and removing the solvent through distillation or the like. The resultant polyhydroxyalkanoate represented by the chemical formula (11) can be subjected to isolation purification as required. A method for the isolation purification is not particularly limited, and a method involving reprecipitation using a solvent which does not dissolve the polyhydroxyalkanoate represented by the chemical formula (11), a method according to column chromatography, dialysis, or the like can be used. Provided, however, that even in the case where catalytic reduction is employed, an ester bond of a main chain is cleaved, and a reduction in molecular weight is observed in some cases.

In addition, in the polyhydroxyalkanoate represented by the chemical formula (5) of the present invention, the polyhydroxyalkanoate represented by the chemical formula (23) is produced by esterifying the polyhydroxyalkanoate represented by the chemical formula (11) as a staring material by means of an esterifying agent.

(23)

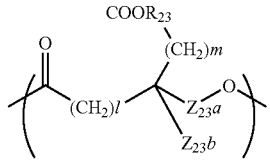

(In the formula, $R_{23}$ represents a linear or branched alkyl group having 1 to 12 carbon atoms, or aralkyl group.

In addition, with regard to l, m, $Z_{23a}$, and $Z_{23b}$ in the formula:

when l represents an integer selected from 2 to 4, $Z_{23a}$ represents nothing or a linear alkylene chain having 1 to 4 carbon atoms, $Z_{23b}$ represents a hydrogen atom, and m represents an integer selected from 0 to 8;

when l represents 1 and $Z_{23a}$ represents a linear alkylene chain having 1 to 4 carbon atoms, $Z_{23b}$ represents a hydrogen atom and m represents an integer selected from 0 to 8;

when l represents 1 and $Z_{23a}$ represents nothing, $Z_{23b}$ represents a hydrogen atom and m represents 0;

when l represents 0 and $Z_{23a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{23b}$ represents a hydrogen atom, or a linear or branched alkyl group, aryl group, or aralkyl group which may be substituted by an aryl group, and m represents an integer selected from 0 to 8; and when l represents 0 and $Z_{23a}$ represents nothing, $Z_{23b}$ represents a hydrogen atom, or a linear or branched alkyl group, aryl group, or aralkyl group which may be substituted by an aryl group, and m represents an integer selected from 0 to 8.

In addition, when multiple units exist, $R_{23}$, $Z_{23a}$, $Z_{23b}$, l, and m each independently have the above meaning for each unit.)

(11)

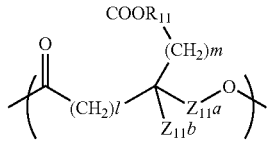

(In the formula, $R_{11}$ represents hydrogen or a group forming a salt.

In addition, with regard to l, m, $Z_{11a}$, and $Z_{11b}$ in the formula:

when l represents an integer selected from 2 to 4, $Z_{11a}$ represents nothing or a linear alkylene chain having 1 to 4 carbon atoms, $Z_{11b}$ represents a hydrogen atom, and m represents an integer selected from 0 to 8;

when l represents 1 and $Z_{11a}$ represents a linear alkylene chain having 1 to 4 carbon atoms, $Z_{11b}$ represents a hydrogen atom and m represents an integer selected from 0 to 8;

when l represents 1 and $Z_{11a}$ represents nothing, $Z_{11b}$ represents a hydrogen atom and m represents 0;

when l represents 0 and $Z_{11a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof, $Z_{11b}$ represents a hydrogen atom, or a linear or branched alkyl group, aryl group, or aralkyl group which may be substituted by an aryl group, and m represents an integer selected from 0 to 8; and when l represents 0 and $Z_{11a}$ represents nothing, $Z_{11b}$ represents a hydrogen atom, or a linear or branched alkyl group, aryl group, or aralkyl group which may be substituted by an aryl group, and m represents an integer selected from 0 to 8.

In addition, when multiple units exist, $R_{11}$, $Z_{11a}$, $Z_{11b}$, l, and m each independently have the above meaning for each unit.)

More specifically, in the compound represented by the chemical formula (11) to be used in the present invention, when l represents 0 and $Z_{11a}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof. Specific examples thereof include a substituted or unsubstituted cyclohexyl structure, a substituted or unsubstituted phenyl structure, a substituted or unsubstituted phenoxy structure, a substituted or unsubstituted benzoyl structure, a substituted or unsubstituted phenylsulfanyl structure, a substituted or unsubstituted phenylsulfinyl structure, a substituted or unsubstituted phenylsulfonyl structure, a substituted or unsubstituted (phenylmethyl)sulfanyl structure, a (phenylmethyl)oxy structure, a 2-thienyl structure, a 2-thienylsulfanyl structure, and a 2-thienylcarbonyl structure.

In addition, in the compound represented by the chemical formula (11) to be used in the present invention, when l represents 0, $Z_{11b}$ represents a hydrogen atom, or a linear or branched alkyl group, aryl group, or aralkyl group which is substituted by an aryl group. Specific examples of the linear or branched alkyl group include a methyl group, an ethyl group, a propyl group, an isopropyl group (2-methylpropyl group), a butyl group, a 1-methylpropyl group, a pentyl group, an isopropyl group (3-methylbutyl group), a hexyl group, an isohexyl group (4-methylpentyl group), and a heptyl group. Examples of the aryl group include a phenyl group and a methylphenyl group. Examples of the aralkyl group include a phenylmethyl group (benzyl group), a phenylethyl group, a phenylpropyl group, a phenylbutyl group, a phenylpentyl group, and a methylbenzyl group. In the present invention, in synthesizing a polymer, $Z_{11b}$ preferably represents a methyl group, an ethyl group, a propyl group, an isopropyl group, a pentyl group, a hexyl group, a phenyl group, or a phenylmethyl group in consideration of productivity.

Examples of the esterifying agent to be used include diazomethane and DMF dimethylacetals. For example, the polyhydroxyalkanoate easily reacts with trimethylsilyldiazomethane, DMF dimethylacetal, DMF diethylacetal, DMF dipropylacetal, DMF diisopropylacetal, DMF-n-butylacetal, DMF-tert-butylacetal, DMF dineopentylacetal, or the like to produce a corresponding ester. Furthermore, the polyhydroxyalkanoate is allowed to react with any one of alcohols such as methanol, ethanol, propanol, isopropyl alcohol, butyl alcohol, sec-butyl alcohol, tert-butyl alcohol, pentyl alcohol, neopentyl alcohol, hexyl alcohol, heptyl alcohol, octyl alcohol, nonyl alcohol, decyl alcohol, and lauryl alcohol, or any one of saccharides such as D-glucose, D-fructose, and otherwise by using an acid catalyst or a condensing agent such as DCC to produce an esterified polyhydroxyalkanoate.

In addition, in the present invention, a polyhydroxyalkanoate containing a unit represented by the chemical formula (J) can be produced through the steps of: allowing a polyhydroxyalkanoate having a unit represented by the chemical formula (G) to react with a base; and allowing the compound obtained in the foregoing step to react with a compound represented by the chemical formula (K).

(G)

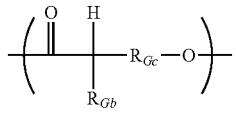

(In the formula, $R_{Gc}$ represents a nothing or a linear alkylene chain having 1 to 4 carbon atoms. When $R_{Gc}$ represents a linear alkylene chain having 1 to 4 carbon atoms, the linear alkylene chain may be arbitrarily substituted by a linear or branched alkyl group, or an alkyl group containing a residue having any one of a phenyl structure, a thienyl structure, and a cyclohexyl structure at a terminal thereof. In addition, $R_{Gb}$ represents a hydrogen atom, or a linear or branched alkyl group, aryl group, or aralkyl group which may be substituted by an aryl group. When $R_{Gc}$ represents a nothing, $R_{Gb}$ represents a hydrogen atom, or a linear or branched alkyl group, aryl group, or aralkyl group which may be substituted by an aryl group.

When multiple units exist, $R_{Gb}$ and $R_{Gc}$ each independently have the above meaning for each unit.)

$$X(CH_2)_mCOOR_K \quad (K)$$

(In the formula, m represents an integer selected from 0 to 8. X represents a halogen atom. $R_K$ represents a linear or branched alkyl group having 1 to 12 carbon atoms, or alkyl group.)

(J)

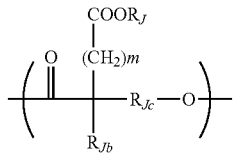

(In the formula, m represents an integer selected from 0 to 8. $R_J$ represents a linear or branched alkyl group having 1 to 12 carbon atoms, or aralkyl group. $R_{Jc}$ represents a nothing or a linear alkylene chain having 1 to 4 carbon atoms. When $R_{Jc}$ represents a linear alkylene chain having 1 to 4 carbon atoms, the linear alkylene chain may be arbitrarily substituted by a linear or branched alkyl group, or an alkyl group containing a residue having any one of a phenyl structure, a thienyl structure, and a cyclohexyl structure at a terminal thereof. In addition, $R_{Jb}$ represents a hydrogen atom, or a linear or branched alkyl group, aryl group, or aralkyl group which may be substituted by an aryl group. When $R_{Jc}$ represents a nothing, $R_{Jc}$ represents a hydrogen atom, or a linear or branched alkyl group, aryl group, or aralkyl group which may be substituted by an aryl group. When multiple units exist, $R_J$, $R_{Jb}$, $R_{Jc}$, and m each independently have the above meaning for each unit.)

More specifically, in the compound represented by the chemical formula (G) to be used in the present invention, when $R_{Gc}$ represents a linear alkylene chain having 1 to 4 carbon atoms, the linear alkylene chain may be substituted by a linear or branched alkyl group, or an alkyl group containing a residue having any one of a phenyl structure, a thienyl structure, and a cyclohexyl structure at a terminal thereof. Specific examples thereof include a substituted or unsubstituted cyclohexyl structure, a substituted or unsubstituted phenyl structure, a substituted or unsubstituted phenoxy structure, a substituted or unsubstituted benzoyl structure, a substituted or unsubstituted phenylsulfanyl structure, a substituted or unsubstituted phenylsulfinyl structure, a substituted or unsubstituted phenylsulfonyl structure, a substituted or unsubstituted (phenylmethyl)sulfanyl structure, a (phenylmethyl)oxy structure, a 2-thienyl structure, a 2-thienylsulfanyl structure, and a 2-thienylcarbonyl structure.

In addition, in the compound represented by the chemical formula (G) to be used in the present invention, $R_{Gb}$ represents a hydrogen atom, or a linear or branched alkyl group, aryl group, or aralkyl group which may be substituted by an aryl group. Specific examples of the linear or branched alkyl group include a methyl group, an ethyl group, a propyl group, an isopropyl group (2-methylpropyl group), a butyl group, a 1-methylpropyl group, a pentyl group, an isopropyl group (3-methylbutyl group), a hexyl group, an isohexyl group (4-methylpentyl group), and a heptyl group. Examples of the aryl group include a phenyl group and a methylphenyl group. Examples of the aralkyl group include a phenylmethyl group (benzyl group), a phenylethyl group, a phenylpropyl group, a phenylbutyl group, a phenylpentyl group, and a methylbenzyl group. In the present invention, in synthesizing a polymer, $R_{Gb}$ preferably represents a methyl group, an ethyl group, a propyl group, an isopropyl group, a pentyl group, a hexyl group, a phenyl group, or a phenylmethyl group in consideration of productivity.

For example, a polyhydroxyalkanoate having a unit represented by the chemical formula (C) corresponding to the chemical formula (J) in which the alkylene chain represented is not substituted and $R_{Jb}$ represents a hydrogen atom can be produced through the steps of: allowing a polyhydroxyalkanoate having a unit represented by the chemical formula (A) as a staring material to react with a base; and allowing the compound obtained in the foregoing step to react with a compound represented by the chemical formula (B).

(C)

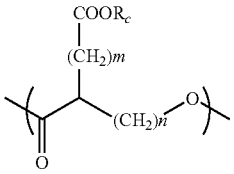

(In the formula, n represents an integer selected from 0 to 4, and m represents an integer selected from 0 to 8. $R_C$ represents a linear or branched alkyl group having 1 to 12 carbon atoms, or aralkyl group. When multiple units exist, $R_C$, m and n each independently have the above meaning for each unit.)

(A)

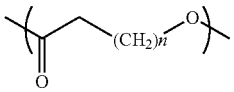

(In the formula, n represents an integer selected from 0 to 4. When multiple units exist, n's each independently have the above meaning for each unit.)

$$X(CH_2)_mCOOR_B \quad (B)$$

(In the formula, m represents an integer selected from 0 to 8. X represents a halogen atom. $R_B$ represents a linear or branched alkyl group having 1 to 12 carbon atoms, or aralkyl group.)

Examples of the compound represented by the chemical formula (B) include methyl chloroformate, ethyl chloroformate, propyl chloroformate, isopropyl chloroformate, butyl chloroformate, cyclohexyl chloroformate, benzyl chloroformate, methyl bromoformate, ethyl bromoformate, propyl bromoformate, isopropyl bromoformate, butyl bromoformate, cyclohexyl bromoformate, benzyl bromoformate, methyl chloroacetate, ethyl chloroacetate, propyl chloroacetate, isopropyl chloroacetate, butyl chloroacetate, cyclohexyl chloroacetate, benzyl chloroacetate, methyl bromoacetate, ethyl bromoacetate, propyl bromoacetate, isopropyl bromoacetate, butyl bromoacetate, cyclohexyl bromoacetate, benzyl bromoacetate, methyl 3-chloropropionate, ethyl 3-chloropropionate, propyl 3-chloropropionate, isopropyl 3-chloropropionate, butyl 3-chloropropionate, cyclohexyl 3-chloropropionate, benzyl 3-chloropropionate, methyl 3-bromopropionate, ethyl 3-bromopropionate, propyl 3-bromopropionate, isopropyl 3-bromopropionate, butyl 3-bromopropionate, cyclohexyl 3-bromopropionate, benzyl 3-bromopropionate, methyl 4-chlorobutyrate, ethyl 4-chlorobutyrate, propyl 4-chlorobutyrate, isopropyl 4-chlorobutyrate, butyl 4-chlorobutyrate, cyclohexyl 4-chlorobutyrate, benzyl 4-chlorobutyrate, methyl 4-bromobutyrate, ethyl 4-bromobutyrate, propyl 4-bromobutyrate, isopropyl 4-bromobutyrate, butyl 4-bromobutyrate, cyclohexyl 4-bromobutyrate, benzyl 4-bromobutyrate, methyl 5-chlorovalerate, ethyl 5-chlorovalerate, propyl 5-chlorovalerate, isopropyl 5-chlorovalerate, butyl 5-chlorovalerate, cyclohexyl 5-chlorovalerate, benzyl 5-chlorovalerate, methyl 5-bromovalerate, ethyl 5-bromovalerate, propyl 5-bromovalerate, isopropyl 5-bromovalerate, butyl 5-bromovalerate, cyclohexyl 5-bromovalerate, benzyl 5-bromovalerate, methyl 6-chlorohexanoate, ethyl 6-chlorohexanoate, propyl 6-chlorohexanoate, isopropyl 6-chlorohexanoate, butyl 6-chlorohexanoate, cyclohexyl 6-chlorohexanoate, benzyl 6-chlorohexanoate, methyl 6-bromohexanoate, ethyl 6-bromohexanoate, propyl 6-bromohexanoate, isopropyl 6-bromohexanoate, butyl 6-bromohexanoate, cyclohexyl 6-bromohexanoate, benzyl 6-bromohexanoate, methyl 7-chloroheptanoate, ethyl 7-chloroheptanoate, propyl 7-chloroheptanoate, isopropyl 7-chloroheptanoate, butyl 7-chloroheptanoate, cyclohexyl 7-chloroheptanoate, benzyl 7-chloroheptanoate, methyl 7-bromoheptanoate, ethyl 7-bromoheptanoate, propyl 7-bromoheptanoate, isopropyl 7-bromoheptanoate, butyl 7-bromoheptanoate, cyclohexyl 7-bromoheptanoate, benzyl 7-bromooctanoate, methyl 8-chlorooctanoate, ethyl 8-chlorooctanoate, propyl 8-chlorooctanoate, isopropyl 8-chlorooctanoate, butyl 8-chlorooctanoate, cyclohexyl 8-chlorooctanoate, benzyl 8-chlorooctanoate, methyl 8-bromooctanoate, ethyl 8-bromooctanoate, propyl 8-bromooctanoate, isopropyl 8-bromooctanoate, butyl 8-bromooctanoate, cyclohexyl 8-bromooctanoate, benzyl 8-bromooctanoate, methyl 9-chlorononanoate, ethyl 9-chlorononanoate, propyl 9-chlorononanoate, isopropyl 9-chlorononanoate, butyl 9-chlorononanoate, cyclohexyl 9-chlorononanoate, benzyl 9-chlorononanoate, methyl 9-bromononanoate, ethyl 9-bromononanoate, propyl 9-bromononanoate, isopropyl 9-bromononanoate, butyl 9-bromononanoate, cyclohexyl 9-bromononanoate, and benzyl 9-bromononanoate.

A reaction between the polyhydroxyalkanoate containing a unit represented by the chemical formula (A) and the compound represented by the chemical formula (B) will be described in detail.

The present invention can be achieved by subjecting an α-methylene group adjacent to a carbonyl group in a polymer main chain to an addition reaction with the compound represented by the chemical formula (B). To be specific, the present invention can be achieved by: allowing the polyhydroxyalkanoate containing a unit represented by the chemical formula (A) to react with a base capable of forming an α-methylene group, which is adjacent to a carbonyl group in the polymer main chain of the polyhydroxyalkanoate containing a unit represented by the chemical formula (A), into an anion under an addition reaction condition; and allowing the resultant to react with the compound represented by the chemical formula (B). In the present invention, the amount of the compound represented by the chemical formula (B) to be used is 0.001 to 100 times mole, or preferably 0.01 to 10 times mole with respect to the unit represented by the chemical formula (A).

A solvent to be used in the reaction is not particularly limited as long as it is inactive to the reaction and dissolves the staring material to some extent. Examples of such a solvent include: aliphatic hydrocarbons such as hexane, cyclohexane, heptane, ligroin, and petroleum ether; aromatic hydrocarbons such as benzene, toluene, and xylene; ethers such as diethyl ether, diisopropyl ether, tetrahydrofuran, dioxane, dimethoxyethane, and diethyleneglycoldimethylether; and amides such as formamide, N,N-dimethylformamide, N,N-dimethylacetamide, N-methyl-2-pyrrolidone, N-methylpyrrolidinone, and hexamethylphosphorotriamide. Of those, tetrahydrofuran is preferable.

The reaction is performed in the presence of a base. Examples of a base to be used include: lithium alkyls such as methyl lithium and butyl lithium; alkali metal disilazides such as lithium hexamethyl disilazide, sodium hexamethyl disilazide, and potassium hexamethyl disilazide; and lithium amides such as lithium diisopropylamide and lithium dicyclohexylamide. Of those, lithium diisopropylamide is preferable. In addition, the amount of the base to be used in the present invention is 0.001 to 100 times mole, or preferably 0.01 to 10 times mole with respect to the unit represented by the chemical formula (A).

A reaction temperature in the method of the present invention is generally in the range of −78° C. to 40° C., or preferably in the range of −78° C. to 30° C.

A reaction time in the method of the present invention is generally in the range of 10 minutes to 24 hours. The reaction time is particularly preferably in the range of 10 minutes to 4 hours.

The polyhydroxyalkanoate having a unit represented by the chemical formula (C) can be produced according to the above production method.

In addition, a polymer produced by means of a conventionally known method can be arbitrarily used as the polyhydroxyalkanoate containing a unit represented by the chemical formula (G) to be used in the present invention. Examples thereof include organism-produced polyhydroxyalkanoates typified by poly-3-hydroxybutyric acid, poly-3-hydroxyvaleric acid, and the like. For example, Japanese Patent Publication Nos. H07-14352 and H08-19227 each disclose a method of producing a copolymer of 3-hydroxybutyric acid and 3-hydroxyvaleric acid. In addition, Japanese Patent Application Laid-Open Nos. H05-93049 and H07-265065 each disclose a method of producing a copolymer of 3-hydroxybutyric acid and 3-hydroxyhexanoic acid. In addition, Japanese Patent No. 2642937 discloses a method of producing a copolymer containing a 3-hydroxyalkanoate having 6 to 12 carbon atoms (that is, from 3-hydroxyhexanoic acid to 3-hydroxyundecylic acid). Japanese Patent Application Laid-Open No. 2002-306190 discloses a method of producing a homopolymer of poly-3-hydroxybutyric acid. A polyhydroxyalkanoate can be produced in the present invention by means of a similar method. In addition, other organism-produced polyhydroxyalkanoates can be produced by means of methods disclosed in International Journal of Biological Macromolecules 12 (1990) 92, Japanese Patent Application Laid-Open Nos. 2001-288256 and 2003-319792, and the like.

A polyhydroxyalkanoate composed of a unit of a substituted α-hydroxylic acid represented by the chemical formula (G) in which $R_{Gc}$ represents a linear alkylene chain having 0 carbon atoms ($R_{Gc}$ represents nothing) can also be synthesized by means of a conventionally known method. For example, a polyester can be directly synthesized from a substituted α-hydroxylic acid. Alternatively, prior to a polymerization step, a substituted α-hydroxylic acid may be transformed into a derivative having high polymerization activity, and the derivative may be subjected to ring-opening polymerization to produce a polyhydroxyalkanoate.

(Method of Producing Polyhydroxyalkanoate Composed of Unit of Substituted α-Hydroxylic Acid from Substituted α-Hydroxylic Acid)

A polyhydroxyalkanoate composed of a unit of a substituted α-hydroxylic acid can be obtained by means of condensation polymerization that is advanced by: refluxing a substituted α-hydroxylic acid and a polymerization catalyst in an organic solvent; and removing water produced in a polymerization step to the outside of a reaction system.

(I) Polymerization Catalyst

Examples of a polymerization catalyst that can be used in the condensation polymerization of a substituted α-hydroxylic acid include: metals such as tin powder and zinc powder; metal oxides such as tin oxide, zinc oxide, magnesium oxide, titanium oxide, and aluminum oxide; metal halides such as stannous chloride, stannic chloride, stannous bromide, stannic bromide, zinc chloride, magnesium chloride, and aluminum chloride; tetraphenyltin; tin octylate; and p-toluenesulfonic acid. The amount of the polymerization catalyst to be used is 0.001 to 10% by weight, or preferably 0.01 to 5% by weight with respect to the substituted α-hydroxylic acid.

(II) Polymerization Solvent

A polymerization solvent to be used in the polycondensation of a substituted α-hydroxylic acid is preferably one that can be easily separated from water. Examples of an available solvent include: toluene; xylene; mesitylene; 1,2,3,5-tetramethylbenzene; chlorobenzene; 1,2-dichlorobenzene; 1,3-dichlorobenzene; bromobenzene; 1,2-dibromobenzene; 1,3-dibromobenzene; iodobenzene; 1,2-diiodobenzene; diphenyl ether; and dibenzyl ether. Those solvents may be mixed before use. The amount of the polymerization solvent to be used is preferably such that the concentration of the substituted α-hydroxylic acid becomes 5 to 50% by weight.

(III) Polymerization Condition

A polymerization temperature in the condensation polymerization of a substituted α-hydroxylic acid is in the range of 50 to 200° C., or preferably 110 to 180° C. in consideration of the generation rate of a polymer and the thermal decomposition rate of the produced polymer. A condensation polymerization reaction is generally performed at the distillation temperature of an organic solvent to be used under normal pressure. When an organic solvent having a high boiling point is used, the reaction may be performed under reduced pressure. The condensation polymerization of the substituted α-hydroxylic acid is preferably performed under an inert gas atmosphere. The condensation polymerization may be performed while a reaction apparatus is replaced or bubbled by an inert gas. In addition, water produced in the course of a polymerization reaction is appropriately removed from the reaction apparatus. The number average molecular weight of a polyester to be produced by polymerization can vary widely by changing conditions including the kind of the polymerization solvent, the kind and amount of the polymerization catalyst, the polymerization temperature, and the polymerization time. However, the number average molecular weight is preferably in the range of 1,000 to 1,000,000 in terms of polystyrene in consideration of a reaction in a subsequent step.

(Method of Producing Polyhydroxyalkanoate Composed of Unit of Substituted α-Hydroxylic Acid from Cyclic Dimer of Substituted α-Hydroxylic Acid)

A polyester can be produced by: performing cyclic diesterification by subjecting a substituted α-hydroxylic acid to bimolecular dehydration to prepare a cyclic dimer lactide as a derivative of the substituted α-hydroxylic acid; and subjecting the cyclic dimer lactide to ring-opening polymerization. Ring-opening polymerization allows a polyester having a high degree of polymerization to be produced because the polymerization velocity of the ring-opening polymerization is generally high. An example of a method of performing cyclic diesterification by subjecting a substituted α-hydroxylic acid to bimolecular dehydration is as follows. A substituted α-hydroxylic acid and a condensation catalyst such as p-toluenesulfonic acid are subjected to azeotropic dehydration in toluene under a nitrogen atmosphere for 30 hours by means of a reaction apparatus equipped with a Dean Stark trap. Water accumulated in the Dean Stark trap is appropriately removed, so a cyclic dimer lactide can be obtained in a high yield. The polyester of interest can also be obtained by: adding a polymerization catalyst to a cyclic dimer lactide; and subjecting the mixture to ring-opening polymerization under an inert gas atmosphere.

(I) Polymerization Catalyst

Examples of a polymerization catalyst that can be used in the ring-opening polymerization of a cyclic dimer lactide include: metals such as tin powder and zinc powder; metal oxides such as tin oxide, zinc oxide, magnesium oxide, titanium oxide, and aluminum oxide; metal halides such as stannous chloride, stannic chloride, stannous bromide, stannic bromide, zinc chloride, magnesium chloride, and aluminum chloride; tetraphenyltin; and tin octylate. Of those, tin or a tin compound is particularly preferable because of its excellent catalytic activity. The amount of the polymerization catalyst to be used is 0.001 to 10% by weight, or preferably 0.01 to 5% by weight with respect to the cyclic dimer lactide.

(II) Polymerization Condition

A polymerization temperature in the ring-opening polymerization of a cyclic dimer lactide is in the range of 100 to 200° C., or preferably 120 to 180° C. in consideration of the generation rate of a polymer and the thermal decomposition rate of the produced polymer. The ring-opening polymerization of the cyclic dimer lactide is preferably performed under an inert gas atmosphere. Examples of an available inert gas include a nitrogen gas and an argon gas. The number average molecular weight of a polyester to be produced by polymerization can vary widely by changing conditions including the kind and amount of the polymerization catalyst, the polymerization temperature, and the polymerization time. However, the number average molecular weight is preferably in the range of 1,000 to 1,000,000 in terms of polystyrene in consideration of a reaction of a polyhydroxyalkanoate composed of a unit of a substituted α-hydroxylic acid to be used in the present invention in a subsequent step.

A polyhydroxyalkanoate represented by the chemical formula (6) can be produced by ring-opening polymerization of an intramolecular ring-closure compound of ω-hydroxycarboxylic acid represented by the chemical formula (8) in the presence of a catalyst.

(6)

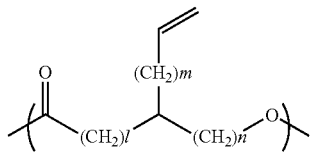

(With regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8.

In addition, when multiple units exist, l, m, and n each independently have the above meaning for each unit.)

(8)

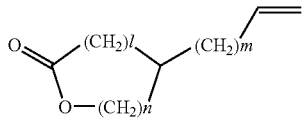

(With regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8.)

In the production of a polyester containing a unit represented by the chemical formula (6) using an intramolecular ring-closure compound of ω-hydroxycarboxylic acid represented by the chemical formula (8), a polymerization method is not particularly limited, and solution polymerization, slurry polymerization, bulk polymerization, or the like can be adopted. In the case where the solution polymerization is adopted, the solvent to be used is not particularly limited, and an inert solvent such as an aliphatic hydrocarbon or cyclic hydrocarbon having 5 to 18 carbon atoms or an aromatic hydrocarbon having 6 to 20 carbon atoms, tetrahydrofuran, chloroform, o-dichlorobenzene, dioxane, or the like can be used.

Any one of conventionally known ring-opening polymerization catalysts can be used as a catalyst to be used for polymerization. Examples thereof include stannous chloride, stannic chloride, stannous fluoride, stannous acetate, stannous stearate, stannous octanoate, stannous oxide, stannic oxide, and other tin salts. The examples further include triethoxyaluminum, tri-n-propoxy-aluminum, tri-iso-propoxy-aluminum, tri-n-butoxyaluminum, tri-iso-butoxyaluminum, aluminum chloride, di-iso-propylzinc, dimethylzinc, diethylzinc, zinc chloride, tetra-n-propoxytitanium, tetra-n-butoxytitanium, tetra-t-butoxytitanium, antimony trifluoride, lead oxide, lead stearate, titanium tetrachloride, boron trifluoride, a boron trifluoride ether complex, triethylamine, and tributylamine.

The amount of any one of those catalysts to be used is in the range of 0.0001 to 10% by weight, or preferably 0.001 to 5% by weight with respect to the total amount of a monomer compound.

At the time of ring-opening polymerization, any one of conventionally known polymerization initiators can be used as a polymerization initiator. To be specific, an aliphatic alcohol is used, which may be a monohydric alcohol, a dihydric alcohol, or a polyhydric alcohol, and may be saturated or unsaturated. Specific examples thereof include: monohydric alcohols such as methanol, ethanol, propanol, butanol, pentanol, hexanol, heptanol, nonanol, decanol, lauryl alcohol, 1-tetradecanol, cetyl alcohol, stearyl alcohol, and p-tert-butylbenzyl alcohol; dihydric alcohols such as ethylene glycol, butanediol, hexanediol, nonanendiol, and tetramethylene glycol; polyhydric alcohols such as glycerol, sorbitol, xylitol, ribitol, and erythritol; methyl lactate; and ethyl lactate. Any one of those aliphatic alcohols is generally used in an amount of 0.01 to 10% by weight with respect to the total amount of a monomer, although the amount slightly varies depending on conditions such as the kind of an alcohol to be used.

A ring-opening polymerization reaction temperature is in the range of 25 to 200° C., preferably 50 to 200° C., or more preferably 100 to 180° C. A ring-opening polymerization reaction may be performed under an inert gas (such as nitrogen or argon) atmosphere, or may be performed under reduced or increased pressure. At that time, a catalyst and an alcohol may be added sequentially.

A second component or the like may be copolymerized in order to change physical properties such as mechanical properties and decomposition properties in a wide range. To be specific, a cyclic diester of α-hydroxycarboxylic acid, or a lactone as an intramolecular ring-closure compound of ω-hydroxycarboxylic acid can be copolymerized. Furthermore, specific examples of the cyclic diester of α-hydroxycarboxylic acid include intermolecular cyclic diesters such as glycolic acid, lactic acid, α-hydroxybutyric acid, α-hydroxyisobutyric acid, α-hydroxyvaleric acid, α-hydroxyisovaleric acid, α-hydroxy-α-methylbutyric acid, α-hydroxycaproic acid, α-hydroxyisocaproic acid, α-hydroxy-β-methylvaleric acid, α-hydroxyheptanoic acid, mandelic acid, and β-phenyllactic acid. One having asymmetric carbon may be of any one of an L body, a D body, a racemic body, and a meso body. In addition, no problem arises even when the cyclic diester is formed of different α-hydroxy acids. Specific examples thereof include cyclic diesters of glycolic acid and lactic acid such as 3-methyl-2,5-diketo-1,4-dioxane. Examples of the lactone as an intramolecular ring-closure compound of ω-hydroxycarboxylic acid include, but not limited to, intramolecular ring-closure compounds such as β-propiolactone, β-butyrolactone, β-isovalerolactone, β-caprolactone, β-isocaprolactone, β-methyl-β-valerolactone, γ-butyrolactone, γ-valerolactone, δ-valerolactone, ε-caprolactone, lactone 11-oxydecanoate, p-dioxanone, and 1,5-dioxepane-2-one.

The number average molecular weight of a polyester to be produced by polymerization can vary widely by changing conditions including the kind and amount of the polymerization catalyst, the polymerization temperature, and the polymerization time. However, the number average molecular weight is preferably in the range of 1,000 to 1,000,000.

In addition, a polyhydroxyalkanoate represented by the chemical formula (10) is produced by ring-opening polymerization of an intramolecular ring-closure compound of ω-hydroxycarboxylic acid represented by the chemical formula (9) in the presence of a catalyst.

(9)

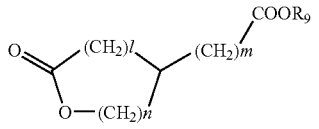

(In the formula, $R_9$ represents a linear or branched alkyl having 1 to 12 carbon atoms, or aralkyl group.

In addition, with regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8; and when l represents 1 and n represents 0, m represents 0.)

(10)

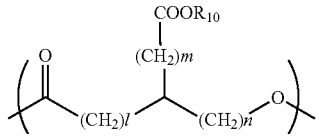

(In the formula, $R_{10}$ represents a linear or branched alkyl group having 1 to 12 carbon atoms, or aralkyl group.

In addition, with regard to l, m, and n in the formula:

when l represents an integer selected from 0 and 2 to 4 and n represents an integer selected from 0 to 4, m represents an integer selected from 0 to 8;

when l represents 1 and n represents an integer selected from 1 to 4, m represents an integer selected from 0 to 8; and when l represents 1 and n represents 0, m represents 0.

In addition, when multiple units exist, l and n each independently have the above meaning for each unit.)

In the production of a polyhydroxyalkanoate containing a unit represented by the chemical formula (10) using an intramolecular ring-closure compound of ω-hydroxycarboxylic acid represented by the chemical formula (9), a polymerization method is not particularly limited, and solution polymerization, slurry polymerization, bulk polymerization, or the like can be adopted. In the case where the solution polymerization is adopted, the solvent to be used is not particularly limited, and an inert solvent such as an aliphatic hydrocarbon or cyclic hydrocarbon having 5 to 18 carbon atoms or an aromatic hydrocarbon having 6 to 20 carbon atoms, tetrahydrofuran, chloroform, o-dichlorobenzene, dioxane, or the like can be used.

Any one of conventionally known ring-opening polymerization catalysts can be used as a catalyst to be used for polymerization. Examples thereof include stannous chloride, stannic chloride, stannous fluoride, stannous acetate, stannous stearate, stannous octanoate, stannous oxide, stannic oxide, and other tin salts. The examples further include triethoxyaluminum, tri-n-propoxy-aluminum, tri-iso-propoxy-aluminum, tri-n-butoxyaluminum, tri-iso-butoxyaluminum, aluminum chloride, di-iso-propylzinc, dimethylzinc, diethylzinc, zinc chloride, tetra-n-propoxytitanium, tetra-n-butoxytitanium, tetra-t-butoxytitanium, antimony trifluoride, lead oxide, lead stearate, titanium tetrachloride, boron trifluoride, a boron trifluoride ether complex, triethylamine, and tributylamine.

The amount of any one of those catalysts to be used is in the range of 0.0001 to 10% by weight, or preferably 0.001 to 5% by weight with respect to the total amount of a monomer compound.

At the time of ring-opening polymerization, any one of conventionally known polymerization initiators can be used as a polymerization initiator. To be specific, an aliphatic alcohol is used, which may be a monohydric alcohol, a dihydric alcohol, or a polyhydric alcohol, and may be saturated or unsaturated. Specific examples thereof include: monohydric alcohols such as methanol, ethanol, propanol, butanol, pentanol, hexanol, heptanol, nonanol, decanol, lauryl alcohol, 1-tetradecanol, cetyl alcohol, stearyl alcohol, and p-tert-butylbenzyl alcohol; dihydric alcohols such as ethylene glycol, butanediol, hexanediol, nonanendiol, and tetramethylene glycol; polyhydric alcohols such as glycerol, sorbitol, xylitol, ribitol, and erythritol; methyl lactate; and ethyl lactate. Any one of those aliphatic alcohols is generally used in an amount of 0.01 to 10% by weight with respect to the total amount of a monomer, although the amount slightly varies depending on conditions such as the kind of an alcohol to be used.

A ring-opening polymerization reaction temperature is in the range of 25 to 200° C., preferably 50 to 200° C., or more preferably 100 to 180° C. In the present invention, a ring-opening polymerization reaction may be performed under an inert gas (such as nitrogen or argon) atmosphere, or may be performed under reduced or increased pressure. At that time, a catalyst and an alcohol may be added sequentially.

A second component or the like may be copolymerized in order to change physical properties such as mechanical properties and decomposition properties in a wide range. To be specific, a cyclic diester of α-hydroxycarboxylic acid, or a lactone as an intramolecular ring-closure compound of ω-hydroxycarboxylic acid can be copolymerized. Furthermore, specific examples of the cyclic diester of α-hydroxycarboxylic acid include intermolecular cyclic diesters such as glycolic acid, lactic acid, α-hydroxybutyric acid, α-hydroxyisobutyric acid, α-hydroxyvaleric acid, α-hydroxyisovaleric acid, α-hydroxy-α-methylbutyric acid, α-hydroxycaproic acid, α-hydroxyisocaproic acid, α-hydroxy-β-methylvaleric acid, α-hydroxyheptanoic acid, mandelic acid, and β-phenyllactic acid. One having asymmetric carbon may be of any one of an L body, a D body, a racemic body, and a meso body. In addition, no problem arises even when the cyclic diester is formed of different α-hydroxy acids. Specific examples thereof include cyclic diesters of glycolic acid and lactic acid such as 3-methyl-2,5-diketo-1,4-dioxane. Examples of the lactone as an intramolecular ring-closure compound of ω-hydroxycarboxylic acid include, but not limited to, intramolecular ring-closure compounds such as β-propiolactone, β-butyrolactone, β-isovalerolactone, β-caprolactone, β-isocaprolactone, β-methyl-β-valerolactone, γ-butyrolactone, γ-valerolactone, δ-valerolactone, ϵ-caprolactone, lactone 11-oxydecanoate, p-dioxanone, and 1,5-dioxepane-2-one.

The number average molecular weight of a polyhydroxyalkanoate to be produced by polymerization can vary widely by changing conditions including the kind and amount of the polymerization catalyst, the polymerization temperature, and the polymerization time. However, the number average molecular weight is preferably in the range of 1,000 to 1,000,000.

The molecular weight of the polyhydroxyalkanoate of the present invention can be measured as a relative molecular weight or an absolute molecular weight. The molecular weight can be simply measured by means of, for example, gel permeation chromatography (GPC). A specific measurement method by means of GPC is as follows. The polyhydroxyalkanote is dissolved in advance into a solvent into which the polyhydroxyalkanoate is soluble, and the molecular weight is measured in an identical mobile phase. A differential refractometer (RI) detector or an ultraviolet (UV) detector can be used as a detector depending on the polyhydroxyalkanoate to be measured. The molecular weight is determined as a result of relative comparison with a standard sample (such as polystyrene or polymethyl methacrylate). The solvent can be selected from solvents into each of which a polymer is soluble such as dimethylformamide (which may be referred to as DMF), dimethyl sulfoxide (which may be referred to as DMSO), chloroform, tetrahydrofuran (which may be referred to as THF), toluene, and hexafluoroisopropanol (which may be referred to as HFIP). In the case of a polar solvent, the molecular weight can be measured through addition of a salt.

In addition, out of the above polyhydroxyalkanoates, a polyhydroxyalkanoate having a ratio (Mw/Mn) between a weight average molecular weight (Mw) and a number average molecular weight (Mn) measured as described above in the range of 1 to 10 is preferably used in the present invention.

A polyhydroxyalkanote polymer using any one of those polyhydroxyalkanoates as an intermediate raw material contains, in a polymer molecule, a unit having: a sulfonic group or a derivative thereof; or a carboxyl group or a derivative thereof. Such a structure strongly promotes the localization of an electron in a molecule at the terminal of such a unit, and the electrical characteristics of the structure may be remarkably different from those of a conventional polyhydroxyalkanoate. In addition, such localization of an electron makes behavior with respect to a solvent different from that of the conventional polyhydroxyalkanoate. For example, the polyhydroxyalkanoate polymer is soluble in a polar solvent such as dimethylformamide (DMF) owing to such localization. In addition, control of thermal properties, in particular, an increase in glass transition temperature derived from a hydrogen bond is remarkable, so the polyhydroxyalkanoate polymer can find use in a wide variety of applications.

The polyhydroxyalkanoate to be used in the present invention preferably contains a monomer unit represented by the chemical formula (1) or (5) at a ratio of 0.2% or more to 40% or less with respect to all the monomer units constituting the polyhydroxyalkanoate, and preferably has a number average molecular weight in the range of 1,000 to 200,000. A ratio of the unit represented by the chemical formula (1) or (5) of 0.2% or more tends to improve the ability to induce toner to have positive charge. Meanwhile, a ratio of the unit represented by the chemical formula (1) or (5) of 40% or less is preferable because environmental stability such as moisture resistance and film property increase. In addition, when the number average molecular weight of the polyhydroxyalkanoate to be used is set to 1,000 or more, there is a tendency that the amount of a low-molecular-weight component reduces, toner hardly adheres or fixes to a resin coating layer, and the charge imparting property of the resin coating layer increases. Meanwhile, when the number average molecular weight is set to 200,000 or less, compatibility with any one of the other resins constituting the resin coating layer increases, and chargeability stable against an environmental fluctuation and time is easily obtained. In addition, when the polyhydroxyalkanote is dissolved into a solvent, a resin solution has an appropriate viscosity and hence can be easily applied. In addition, the composition of the resin coating layer becomes uniform, so toner charging becomes stable. Furthermore, the surface roughness of the resin coating layer becomes stable, so abrasion resistance increases.

In general, a binder resin for toner often has a glass transition point in the range of 50° C. to 70° C. Therefore, a polyhydroxyalkanoate to be used is preferably selected in such an appropriate manner that a resin coating layer with which a core material is coated, the resin coating layer having a glass transition point higher than that of toner, is formed for the purpose of preventing the toner from adhering to the surface of the resin coating layer.

The resin-coated carrier for an electrophotographic developer of the present invention includes: a core material; and a resin coating layer containing such a polyhydroxyalkanoate as described above, the resin coating layer being placed on the core material. A material for the core material may be any one of conventionally known magnetic substances, and examples of such magnetic substances include: ferromagnetic metals such as iron, cobalt, and nickel; alloys and compounds such as magnetite, hematite, and ferrite; and particles obtained by dispersing these magnetic substances into binder resins. Resin nuclide particles obtained by dispersing magnetic substances into binder resins may also be used.

The core material to be used in the present invention has an average particle size in the range of preferably 20 to 100 μm, or particularly preferably 30 to 65 μm. That is, an average particle size of the core material of 20 μm or more is preferable because the amount of a fine powder system in the particle distribution of a resin-coated carrier reduces, magnetization per particle increases, and the resin-coated carrier hardly scatters. In addition, an average particle size of the core material of 100 μm or less is preferable because a specific surface area increases, so toner hardly scatters, and because the reproducibility of a solid portion in a full-color image a substantial part of which is occupied by the solid portion tends to be good.

An example of a method of coating the above core material with a resin coating layer includes a method involving coating the surface of such a core material as described above with a resin layer containing at least the polyhydroxyalkanoate to form a resin coating layer.

Examples of a solvent that can be used in the method include toluene, xylene, methyl ethyl ketone, methyl isobutyl ketone, and cellosolve butyl acetate.

The resin coating amount of the resin coating layer constituting the resin-coated carrier for an electrophotographic developer of the present invention is in the range of 0.1 to 5.0% by weight with respect to the total amount of the resin-coated carrier when the polyhydroxyalkanoate is used alone as the resin coating layer. When the polyhydroxyalkanoate is used in combination with another resin, the resin coating amount is preferably in the range of 0.1 to 25% by weight with respect to the total amount of the resin-coated carrier, although the preferable amount depends on a mixing ratio between the polyhydroxyalkanoate and the other resin.

A baking device for forming the resin coating layer may be of any one of an external heating type and an internal heating type. For example, baking may be performed by means of a fixed type or fluid type electric furnace, a rotary electric furnace, a burner furnace, or microwave. A baking temperature is preferably about 130 to 300° C.

The resin coating layer may be obtained by subjecting a polyhydroxyalkanoate to melamine aldehyde resin cross-linking or isocyanate cross-linking, or may be used in combination with any one of other conventionally known resins. Examples of such resins include: polyolefin-based resins such as polyethylene and polypropylene; polyvinyl-based resins and polyvinylidene-based resins such as polystyrene, an acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic acid copolymers; straight silicone resins composed of organosiloxane bonds, or denatured products thereof; fluorine-based resins such as polytetrafluoroethylene, polyvinyl fluoride, polyvinylidene fluoride, and polychlorotrifluoroethylene; silicone resins; polyester; polyurethane; polycarbonate; phenol resins; amide resins such as a urea-formaldehyde resin, a melamine resin, a benzoguanamine resin, a urea resin, and a polyamide resin; and epoxy resins. Of those resins, a fluorine-based resin and/or a silicone resin is preferably used. The use of a fluorine-based resin and/or a silicone resin as the resin is advantageous in that a large effect of preventing carrier contamination (impaction) caused by toner or an external additive can be achieved.

In particular, in order that the toner to be used may provide positive friction, in addition to the polyhydroxyalkanoate, a fluoride-containing polymer such as polyvinyl fluoride, polyvinylidene fluoride, polytrifluoroethylene, polytetrafluoroethylene, polyperfluoropropylene, a copolymer of vinylidene fluoride and vinyl fluoride, a copolymer of tetrafluoroethylene and hexafluoropropylene, a copolymer of vinylidene fluoride and trifluorochloroethylene, or a copolymer of vinylidene fluoride and hexafluoropropylene may be incorporated as a resin constituting the resin coating layer of the resin-coated carrier in an amount of 30 to 70% by weight.

As described above, a silicone-based resin may be used as a resin constituting the resin coating layer. Any one of straight silicone resins composed of organosiloxane bonds may be used. Specific examples thereof include commercially available products such as: KR-271 and KR-255 (trade name) manufacture by Shin-Etsu Chemical Co., Ltd.; SR-2410, SR-2406, and SR-2411 (trade name) manufactured by Dow Corning Toray Co., Ltd.; and TSR-127B and TSR-144 (trade name) manufactured by GE Toshiba Silicones. A catalyst and the like may be added as required to those straight silicone resins. Examples of a denatured silicone-based resin include denatured silicone resins by an alkyd resin, a polyester resin, an epoxy resin, a polyurethane resin, an acrylic resin, and the like. Examples of a commercially available denatured silicone-based resin include: KR-206 (alkyd resin-denatured product; trade name), KR-9706 (acrylic resin-denatured product; trade name), and ES-1001N (epoxy resin-denatured product; trade name) manufacture by Shin-Etsu Chemical Co., Ltd.; and SR-2101 (alkyd resin-denatured product; trade name) manufactured by Dow Corning Toray Co., Ltd.

The resin-coated carrier for an electrophotographic developer of the present invention is mixed with toner to be used as a two-component developer when an image is formed. The toner to be used at this time contains at least a binder resin and a colorant, and may contain any one of various additives such as a charge control agent as required.

The binder resin to be used for toner is not particularly limited, and examples thereof include: polyester; polystyrene; polymer compounds derived from styrene derivatives such as poly-p-chlorostyrene and polyvinyl toluene; styrene copolymers such as a styrene-p-chlorostyrene copolymer, a styrene-vinyltoluene copolymer, a styrene-vinyl naphthalene copolymer, a styrene-acrylate copolymer, a styrene-methacrylate copolymer, a styrene-α-chloromethyl methacrylate copolymer, a styrene-acrylonitrile copolymer, a styrene-vinyl methyl ketone copolymer, a styrene-butadiene copolymer, a styrene-isoprene copolymer, and a styrene-acrylonitrile-indene copolymer; polyvinyl chloride; phenol resins; denatured phenol resins; maleic resins; acrylic resins; methacrylic resins; polyvinyl acetate resins; silicone resins; polyester resins each having, as a structural unit, a monomer selected from aliphatic polyhydric alcohols, aliphatic dicarboxylic acids, aromatic dicarboxylic acids, aromatic dialcohols, and diphenols; polyurethane resins; polyamide resins; polyvinyl butyral; terpene resins; coumarone-indene resins; and petroleum resins. Each of those resins is used alone, or two or more of them are used as a mixture.

Toner having a core/shell structure with its core formed of a low-softening-point substance is also preferably used. The toner is advantageous of low-temperature fixation because of the low-softening-point substance used.

A method of including a low-softening-point substance in toner particles involves: setting the polarity of the low-softening-point substance in an aqueous medium to be smaller than that of a main monomer; and adding a small amount of a resin or monomer having large polarity. With the method, toner particles each having a core/shell structure in which the low-softening-point substance is coated with an outer shell resin can be obtained.

The particle size distribution and particle diameter of toner can be controlled by changing the kind and addition amount of a dispersant using a hardly water-soluble inorganic salt or protective colloid as an action or by controlling: mechanical device conditions such as the peripheral speed of a roller and the number of pass; stirring conditions such as the shape of a stirring blade; the shape of a container; and a solid content concentration in an aqueous medium.

Examples of an outer shell resin for toner include a styrene-(meth)acrylate copolymer, a polyester resin, an epoxy resin, and a styrene-butadiene copolymer.

In a method of directly producing toner particles by means of polymerization, monomers thereof are preferably used. Specific examples of a monomer to be preferably used include: styrene; styrene monomers such as o(m-, p-)-methylstyrene and m(p-)-ethylstyrene; (meth)acrylate monomers such as methyl (meth)acrylate, ethyl (meth)acrylate, propyl (meth)acrylate, butyl (meth)acrylate, octyl (meth)acrylate, dodecyl (meth)acrylate, stearyl (meth)acrylate, behenyl (meth)acrylate, 2-ethylhexyl (meth)acrylate, dimethylaminoethyl (meth)acrylate, and diethylaminoethyl (meth)acrylate; and ene monomers such as butadiene, isoprene, cyclohexene, (meth)acrylonitrile, and acrylic amide.

Each of those toners preferably uses at least one of silica fine powder and titanium oxide fine powder as an external additive because good fluidity can be imparted to a developer and the lifetime of the developer extends. In addition, the use of the above fine powder can provide a developer less susceptible to an environmental fluctuation.

Examples of other preferable external additives include: metal oxide fine powder (made of, for example, aluminum oxide, strontium titanate, cerium oxide, magnesium oxide, chromium oxide, tin oxide, or zinc oxide); nitride fine powder (made of, for example, silicon nitride); carbide fine powder (made of, for example, silicon carbide); metal salt fine powder (made of, for example, calcium sulfate, barium sulfate, or calcium carbonate); aliphatic acid metal salt fine powder (made of, for example, zinc stearate or calcium stearate); carbon black; and resin fine powder (made of, for example, polytetrafluoroethylene, polyvinylidene fluoride, polymethyl methacrylate, polystyrene, or a silicone resin). Each of those external additives may be used alone, or 2 or more of them may be used in combination. The above external additives including silica fine powder are more preferably subjected to a hydrophobic treatment.

The above external additives each preferably have a number average particle size of 0.2 μm or less. A number average particle size of 0.2 μm or less improves fluidity and improves image quality at the time of development and transfer.

An external additive is used in an amount of preferably 0.01 to 10 parts by weight, or more preferably 0.05 to 5 parts by weight with respect to 100 parts by weight of toner particles.

An external additive to be suitably used has a specific surface area according to nitrogen adsorption by means of a BET method of preferably 30 $m^2/g$ or more, or more preferably in the range of 50 to 400 $m^2/g$.

Toner particles and an external additive can be mixed by means of a mixer such as a Henschel mixer.

Examples of colorants to be used for toner in the present invention are given below.

Examples of a yellow colorant that can be suitably used include compounds typified by a condensed azo compound, an isoindolinone compound, an anthraquinone compound, an azo metal complex, a methine compound, and an allylamide compound. Specific examples thereof include C.I. Pigment Yellow 12, 13, 14, 15, 17, 62, 74, 83, 93, 94, 95, 109, 110, 111, 128, 129, 147, and 168.

Examples of a magenta colorant that can be suitably used include a condensed azo compound, a diketopyrrolopyrrole compound, anthraquinone, a quinacridone compound, a basic dye lake compound, a naphthol compound, a benzimidazolone compound, a thioindigo compound, and a perylene compound. Specific examples thereof include C.I. Pigment Red 2, 3, 5, 6, 7, 23, 48:2, 48:3, 48:4, 57:1, 81:1, 144, 146, 166, 169, 177, 184, 185, 202, 206, 220, 221, and 254.

Examples of a cyan colorant that can be suitably used include: a copper phthalocyanine compound and a derivative thereof; an anthraquinone compound; and a basic dye lake compound. Specific examples thereof include C.I. Pigment Blue 1, 7, 15, 15:1, 15:2, 15:3, 15:4, 60, 62, and 66.

Each of those colorants may be used alone, or 2 or more of them may be used as a mixture. Furthermore, each of them may be used as a solid solution.

Examples of a black colorant include carbon black and a colorant having a black tone obtained by using the yellow/magenta/cyan colorants described above. Magnetic one-component development in which magnetic toner is used only for black toner is also applicable to full-color applications.

A colorant for color toner is selected in consideration of hue angle, chroma, brightness, weather resistance, OHP transparency, and dispersibility in toner. The colorant content is preferably 1 to 20 parts by weight with respect to 100 parts by weight of a binder resin for toner.

Any one of conventionally known charge control agents can be used for toner. A charge control agent for color toner is particularly preferably one which is colorless or has a pale color, has a high charging speed with respect to toner, and is capable of stably maintaining a constant charge amount. Furthermore, in the present invention, in producing toner by means of polymerization, a charge control agent which has no inhibiting effect on polymerization and contains no matter soluble in an aqueous medium is particularly preferable.

Examples of a negative charge control agent that can be preferably used include: metal compounds of salicylic acid, dialkylsalicylic acid, naphthoic acid, and dicarboxylic acid, and of derivatives of these acids; polymer compounds each having a sulfonic acid or a carboxylic acid at a side chain thereof; boron compounds; urea compounds; silicon compounds; and calixarene. Examples of a positive charge control agent that can be preferably used include: quaternary ammonium salts; polymer compounds each having any one of the quaternary ammonium salts at a side chain thereof; guanidine compounds; and imidazole compounds. The charge control agent content is preferably 0.5 to 10 parts by weight with respect to 100 parts by weight of a binder resin. However, the addition of a charge control agent to toner particles is not essential.

Examples of a method of producing toner include a method involving: sufficiently mixing the binder resin, the colorant, and, as desired, additives such as the charge control agent by means of a mixer such as a Henschel mixer; kneading the mixture by means of a biaxial extruder; cooling the kneaded product; coarsely pulverizing the cooled product by means of a pulverizer such as a feather mill; making the coarsely pulverized product into particles each having a desired particle size by means of a jet pulverizer, a classifier, or the like; adding an external additive such as silica fine powder as required; and mixing the whole by means of a mixer. The examples further include: a method of directly producing toner particles by using suspension polymerization; dispersion polymerization involving the use of an aqueous organic solvent into which a monomer is soluble and a polymer to be obtained is insoluble to directly product toner particles; and a method of producing toner particles by using emulsion polymerization typified by soap free polymerization for producing toner particles through direct polymerization in the presence of a water-soluble polar polymerization initiator.

When toner to be used in the present invention is produced, examples of a polymerization initiator used when producing toner particles by means of polymerization include: azo-based polymerization initiators such as 2,2'-azobis(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobisisobutyronitrile; and peroxide-based polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide.

The amount of a polymerization initiator to be added, which varies depending on a target degree of polymerization, is generally 0.5 to 20% by weight with respect to a monomer. The number of kinds of polymerization initiators, which slightly varies depending on a polymerization method, is one, or two or more in combination with reference to a 10-hour half life temperature. Any one of conventionally known crosslinking agents, chain transfer agents, polymerization inhibitors, and the like for controlling a degree of polymerization can be further added. As a dispersant when suspension polymerization is used as a toner production method examples of an inorganic oxide to be used, include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of an organic compound include polyvinyl alcohol, gelatin, methylcellulose, methylhydroxy-propylcellulose, ethylcellulose, sodium carboxymethyl-cellulose, and starch. Each of them is dispersed into an aqueous phase before use. Each of those dispersants is preferably used in an amount of 0.2 to 10.0 parts by weight with respect to 100 parts by weight of a polymerizable monomer.

Those dispersants may be those commercially available without any treatment. However, in order to obtain dispersed particles each having a fine and uniform particle size, any one of the inorganic compounds may be produced in a dispersion medium under high-speed stirring. For example, in the case of tricalcium phosphate, a dispersion medium preferable for suspension polymerization can be prepared by mixing an aqueous solution of sodium phosphate and an aqueous solution of calcium chloride under high-speed stirring. 0.001 to 0.1 part by weight of a surfactant may also be used in combination in order to make those dispersants fine. To be specific, commercially available nonionic, anionic, or cationic surfactants may be used. Examples thereof that can be preferably used include sodium dodecyl sulfate, sodium tetradecyl sulfate, sodium pentadecyl sulfate, sodium octyl sulfate, sodium oleate, sodium laurate, potassium stearate, and calcium oleate.

In the case where direct polymerization is used for a toner production method, to be specific, toner can be produced according to the production method described below. A releasing agent, a colorant, a charge control agent, a polymerization initiator, and other additives each of which is composed of a low-softening-point substance are added to a monomer, and the whole is evenly dissolved or dispersed by means of a homogenizer, an ultrasonic dispersing unit, or the like to prepare a monomer composition. Then, the monomer composition is dispersed into an aqueous phase containing a dispersion stabilizer by means of an ordinary stirring device, or a homomixer, a homogenizer, or the like. Preferably, liquid droplets composed of the monomer composition are granulated while a stirring speed and a stirring time are adjusted so that the resultant has a desired toner particle size. After that, stirring has only to be performed to the extent that a particle state is maintained by virtue of the action of the dispersion stabilizer and the sedimentation of particles is prevented. Polymerization is performed at a polymerization temperature set to 40° C. or higher, or generally 50 to 90° C. The temperature may be increased in the latter half of the polymerization reaction. For the purpose of improving durability, part of an aqueous medium may be distilled off in the latter half of the reaction or after the completion of the reaction to remove an unreacted polymerizable monomer and a by-product. After the completion of the reaction, the resultant toner particles are washed, collected through filtration, and dried. In suspension polymerization, water is typically used as a dispersant in an amount of preferably 300 to 3,000 parts by weight with respect to 100 parts by weight of the polymerizable monomer.

The toner may be classified to control the particle size distribution. A multi-division classifier utilizing inertial force is preferably used for such classification. The use of the classifier enables toner having a preferable particle size distribution in the present invention to be efficiently produced.

When toner and a resin-coated carrier are mixed to prepare a two-component developer in the present invention, a mixing ratio between them that provides good results is such that the toner concentration in the developer is typically 2 to 15% by weight, or preferably 4 to 13% by weight. A toner concentration of 2% by weight or more is preferable because an image density increases, while a toner concentration of 15% by weight or less is preferable because neither fogging nor scattering in an apparatus occurs and the lifetime of a developer lengthens.

When a replenishing developer is prepared by mixing toner and a resin-coated carrier in a development method in which development is performed while the replenishing developer is supplied, a mixing ratio between the toner and the resin-coated carrier that provides good results is such that the amount of the toner in the developer is 2 to 50 parts by weight with respect to 1 part by weight of the resin-coated carrier. An amount of the toner of 2 parts by weight or more is preferable because a ratio of the amount of the toner to the amount of the resin-coated carrier is appropriate, the charge amount of the developer becomes suitable, and an image density is stabilized. An amount of the toner of 50 parts by weight or less is preferable because the deterioration of the resin-coated carrier is prevented and the charge amount of the developer becomes suitable.

Next, the average particle diameter and particle size distribution of the toner to be used in the present invention can be measured as follows.

100 ml to 150 ml of an electrolytic solution are added with 0.1 to 5 ml of a surfactant (an alkyl benzene sulfonate). Then, 2 to 20 mg of toner as measurement samples are added to the electrolytic solution. The electrolytic solution in which the samples are suspended is subjected to a dispersion treatment in an ultrasonic dispersing unit for about 1 to 3 minutes. After that, a particle size of 0.3 to 40 μm or the like is measured on a volume basis by means of a Coulter Counter Multisizer (manufactured by Beckman Coulter, Inc; trade name) and an aperture adjusted for an appropriate toner size such as 17 μm or 100 μm. The number average particle diameter and weight average particle diameter measured under this condition are processed on a computer.

Next, a method of measuring the triboelectric charge amount used in the present invention will be described. Toner and the resin-coated carrier of the present invention are mixed in such a manner that the toner comprises 5% by weight based on the weight of the mixture, and then the mixture is mixed for 60 seconds by means of a tumbler mixer to prepare a developer. The developer is charged into a metal container equipped with 500-mesh conductive screen, aspirated with an aspirator, and the triboelectric charge amount is determined from a difference between the weight before the aspiration and that after the aspiration and the potential accumulated in a capacitor connected to the container. The suction pressure at this time is set to 250 mmHg. With the method, the triboelectric charge amount is calculated by using the following equation.

$$Q(\mu C/g)=(C\times V)/(W1-W2)$$

(In the equation, W1 represents the weight before the suction, W2 represents the weight after the suction, C represents the capacity of the capacitor, and V represents the potential accumulated in the capacitor.)

EXAMPLES

Hereinafter, the present invention will be described in more detail by way of examples. The term "part" in Examples means "part by weight". First, a toner and a polyhydroxyalkanoate used in Examples were produced according to the following method.

Toner Production Example 1

| | |
|---|---|
| Styrene-acrylic acid-dimethylaminoethyl 2-ethyl hexyl methacrylate copolymer (copolymerization ratio = 80:15:5) | 100 parts by weight |
| Copper phthalocyanine pigment | 5 parts by weight |
| Low-molecular-weight polypropylene | 4 parts by weight |

The above respective materials were sufficiently premixed, and the mixture was melted and kneaded. After having been cooled, the kneaded product was coarsely pulverized by means of a hammer mill in an average particle diameter of about 1 to 2 mm. Then, the coarsely pulverized product was finely pulverized by means of an air jet classifier. Furthermore, the finely pulverized product was classified by means of an elbow jet classifier to prepare positive charge type cyan fine powder. 100 parts by weight of the cyan fine powder and 0.8 part by weight of positive charge type hydrophobic colloidal silica treated with amino-denatured silicone oil were mixed by means of a Henschel mixer to prepare a cyan toner No. 1 having a weight average particle size of 8.2 μm.

Toner Production Example 2

450 parts of a 0.1-M aqueous solution of $Na_3PO_4$ were charged into 710 parts of ion-exchanged water, and the whole was heated to 60° C. and stirred by means of a TK Homomixer (manufactured by Tokushu Kika Kogyo Co., Ltd.; trade name) at 12,000 rpm. 68 parts of a 1.0-M aqueous solution of $CaCl_2$ were gradually added to the mixture to prepare an aqueous medium containing $Ca_3(PO_4)_2$.

Next, the following respective materials were prepared.

| | |
|---|---|
| Styrene | 165 parts |
| n-butyl acrylate | 35 parts |
| C.I. Pigment Blue 15:3 (colorant) | 12 parts |
| Charge control agent | 3 parts |
| Saturated polyester (polar resin) | 10 parts |
| Ester wax (having a melting point of 70° C.) | 20 parts |

The above respective materials were heated to 60° C., and were uniformly dissolved and dispersed by means of a TK Homomixer (manufactured by Tokushu Kika Kogyo Co., Ltd.; trade name) at 11,000 rpm. 10 parts of 2,2'-azobis(2,4-dimethylvaleronitrile) as a polymerization initiator were dissolved into the resultant to prepare a polymerizable monomer composition.

The polymerizable monomer composition was placed in the aqueous medium, and the whole was stirred at 60° C. in an $N_2$ atmosphere by means of a TK Homomixer (manufactured by Tokushu Kika Kogyo Co., Ltd.; trade name) at 11,000 rpm for 10 minutes to granulate the polymerizable monomer composition. After that, the resultant was heated to 80° C. while being stirred by means of a paddle stirring blade to react for 10 hours. After the completion of the polymerization reaction, the residual monomer was distilled off under reduced pressure, and the remainder was cooled. Then, hydrochloric acid was added to dissolve $Ca_3(PO_4)_2$ and the like. After that, the resultant was filtered, washed with water, and dried to prepare positive chargeable type cyan toner particles.

0.5 part of positive chargeable type hydrophobic colloidal silica treated with amino-denatured silicone oil (having a number average particle diameter of primary particles of 0.03 μm) and 0.5 part of positive chargeable type hydrophobic titania powder treated with amino-denatured silicone oil (having a number average particle diameter of primary particles of 0.03 μm) were externally added to 100 parts of the resultant cyan toner particles to prepare a cyan toner No. 2 having a weight average particle diameter of 6.8 μm.

Next, preparation examples of polyhydroxyalkanoates to be used in the present invention will be described (Preparation Examples A to 2P).

Preparation Example A-1

[Synthesis of Polyester Using 3,6-di(3-butenyl)-1,4-dioxane-2,5-dione and L-lactide]

0.11 g (0.5 mmol) of 3,6-di(3-butenyl)-1,4-dioxane-2,5-dione, 0.65 g (4.5 mmol) of L-lactide, 2 ml of a solution of 0.01 M of tin octylate(tin 2-ethylhexanoate) in toluene, and 2 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 1 hour after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 0.63 g of a polymer.

NMR analysis was performed under the following conditions to determine the structure of the resultant polymer.

<Measuring equipment> FT-NMR: Bruker DPX 400 (trade name)

Resonance frequency: $^1H$=400 MHz

<Measurement conditions> Measured nuclear species: $^1H$

Solvent used: TMS/$CDCl_3$

Measurement temperature: room temperature

The analysis confirmed that the polymer was a polyhydroxyalkanoate copolymer containing a unit represented by the following chemical formula (24) as a monomer unit. The analysis also confirmed that an A unit accounted for 9 mol % of the monomer unit and a B unit accounted for 91 mol % thereof.

(24)

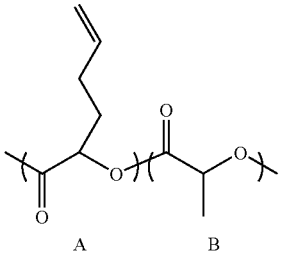

The resultant polyhydroxyalkanoate was evaluated for average molecular weight by means of gel permeation chromatography (GPC; HLC-8220 (trade name) manufactured by Tosoh Corporation, column; TSK-GEL Super HM-H (trade name) manufactured by Tosoh Corporation, solvent; chloroform, in terms of polystyrene). As a result, the resultant polyhydroxyalkanoate was found to have a number average molecular weight Mn of 18,200 and a weight average molecular weight Mw of 24,000.

Preparation Example A-2

Oxidation reaction of polyhydroxyalkanoate composed of unit represented by chemical formula (24) synthesized in Preparation Example A-1

(24)

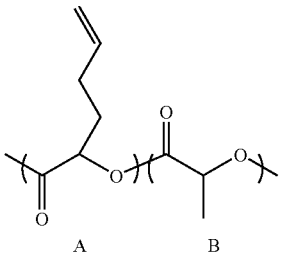

0.50 g of the polyhydroxyalkanoate copolymer composed of the unit represented by the chemical formula (24) synthesized in Preparation Example A-1 (A: 9 mol %, B: 91 mol %) was placed in a round-bottomed flask, and 30 ml of acetone were added to dissolve this. The flask was placed in an ice bath, 5 ml of acetic acid and 0.47 g of 18-crown-6-ether were added, and the whole was stirred. Next, 0.38 g of potassium permanganate was gradually added to the flask in the ice bath, and the whole was stirred in the ice bath for 2 hours and stirred at room temperature for an additional 18 hours. After the completion of the reaction, 60 ml of ethyl acetate were added, and 45 ml of water were further added. Next, sodium hydrogen sulfite was added until peracid was removed. After that, liquid property was adjusted with 1.0N hydrochloric acid to have a pH of 1. The organic layer was extracted and washed with 1.0N hydrochloric acid 3 times. After the organic layer had been collected, the solvent was distilled off to collect a crude polymer. Next, the polymer was washed with 50 ml of water and 50 ml of methanol, and was further washed with 50 ml of water 3 times, followed by collection of a polymer. Next, the polymer was dissolved into 3 ml of THF, and reprecipitated in methanol in an amount 50 times that of THF necessary for the dissolution. The precipitate was collected and dried under reduced pressure to prepare 0.44 g of a polymer.

NMR analysis was performed under the same conditions as those of Preparation Example A-1 to determine the structure of the resultant polymer. The analysis confirmed that the polymer was a polyhydroxyalkanoate containing a unit represented by the following chemical formula (25) as a monomer unit.

(25)

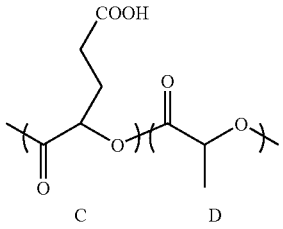

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 13,200 and a weight average molecular weight Mw of 18,200.

A carboxyl group at the terminal of a side chain of the resultant polyhydroxyalkanoate was methyl esterified with trimethylsilyldiazomethane to calculate the unit of the polyhydroxyalkanoate.

30 mg of the polyhydroxyalkanoate as a target product were placed in a 100-ml round-bottomed flask, and 2.1 ml of chloroform and 0.7 ml of methanol were added to dissolve them. 0.5 ml of a 2 mol/L hexane solution of trimethylsilyldiazomethane was added to the solution, and the whole was stirred at room temperature for 1 hour. After the completion of the reaction, the solvent was distilled off to collect a polymer. The polymer was washed with 50 ml of methanol, then recovered. The polymer was dried under reduced pressure to prepare 31 mg of a polyhydroxyalkanoate.

NMR analysis was performed in the same manner as in Preparation Example A-1. The analysis confirmed that the polyhydroxyalkanoate was a copolymer in which a C unit accounted for 8 mol % of the unit of the polyhydroxyalkanoate represented by the chemical formula (25) and a D unit accounted for 92 mol % thereof.

Preparation Example A-3

Condensation reaction between polyhydroxyalkanoate composed of unit represented by chemical formula (25) synthesized in Preparation Example A-2 and 2-aminobenzenesulfonic acid (25)

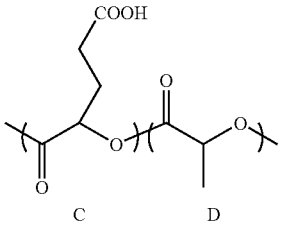

Under a nitrogen atmosphere, 0.40 g of the polyhydroxyalkanoate copolymer composed of the unit represented by the chemical formula (25) synthesized in Preparation Example A-2 (C: 8 mol %, D: 92 mol %) and 0.36 g of 2-aminobenzenesulfonic acid were placed in a 100-ml three-necked flask. 15.0 ml of pyridine were added to the flask, and the mixture was stirred. After that, 1.09 ml of triphenyl phosphite were added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.32 g of a polymer.

The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature) and Fourier transformation-infrared absorption (FT-IR) spectrum (Nicolet AVATAR 360FT-IR). In the FT-IR spectrum, a peak at 1,695 cm$^{-1}$ derived from a carboxylic acid reduced, and a peak derived from an amide group was newly observed at 1,658 cm$^{-1}$.

$^1$H-NMR confirmed that the resultant polymer was a polyhydroxyalkanoate containing a unit represented by the following chemical formula (26) as a monomer unit because a peak derived from an aromatic ring of the 2-aminobenzenesulfonic acid structure shifted.

(26)

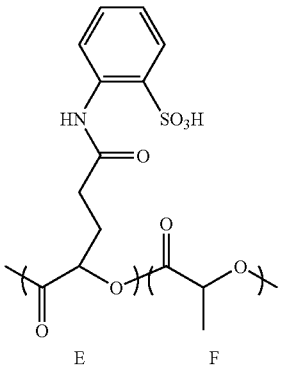

It was also confirmed that the polyhydroxyalkanoate was a copolymer in which an E unit accounted for 8 mol % of the unit of the polyhydroxyalkanoate represented by the chemical formula (26) and an F unit accounted for 92 mol % thereof.

The resultant polymer was evaluated for average molecular weight by means of gel permeation chromatography (GPC; Tosoh Corporation HLC-8120, column; Polymer Laboratories PLgel 5μ MIXED-C, solvent; DMF/LiBr 0.1% (w/v), in terms of polystyrene). As a result, the resultant polymer was found to have a number average molecular weight Mn of 11,300 and a weight average molecular weight Mw of 16,000.

Preparation Example A-4

Esterification reaction of polyhydroxyalkanoate composed of unit represented by chemical formula (26) synthesized in Preparation Example A-3

(26)

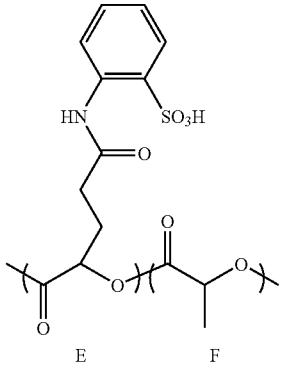

0.30 g of the polyhydroxyalkanoate copolymer composed of the unit represented by the chemical formula (26) synthesized in Preparation Example A-3 (E: 8 mol %, F: 92 mol %) was added to a round-bottomed flask. Then, 21.0 ml of chloroform and 7.0 ml of methanol were added to dissolve the polymer, and the solution was cooled to 0° C. 1.35 ml of a 2 mol/L hexane solution of trimethylsilyldiazomethane (manufactured by Aldrich) were added to the solution, and the whole was stirred for 4 hours. After the completion of the reaction, the solvent was distilled off by using an evaporator, and then the polymer was collected.

Furthermore, 21.0 ml of chloroform and 7.0 ml of methanol were added to dissolve the polymer again. Then, the solvent was distilled off by using an evaporator. This operation was repeated 3 times. The collected polymer was dried under reduced pressure to prepare 0.30 g of a polymer.

The structure of the resultant polymer was determined through analysis according to $^1$H-NMR in the same manner as in Preparation Example A-3. $^1$H-NMR confirmed that the resultant polymer was a polyhydroxyalkanoate containing a unit represented by the following chemical formula (27) as a monomer unit because a peak derived from methyl sulfonate was observed at 3 to 4 ppm.

(27)

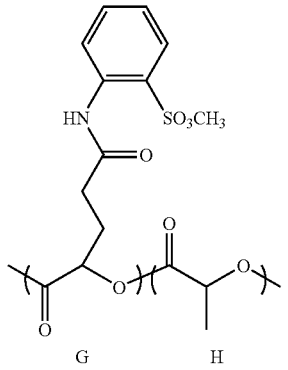

It was also confirmed that the polyhydroxyalkanoate was a copolymer in which a G unit accounted for 8 mol % of the unit of the polyhydroxyalkanoate represented by the chemical formula (27) and a H unit accounted for 92 mol % thereof.

Also an acid value titration utilizing a potentiometric titration apparatus AT510 (manufactured by KYOTO ELECTRONICS MANUFACTURING CO., LTD; trade name) did not show a peak attributable to a sulfonic acid, thus clarifying that the sulfonic acid was converted to methyl sulfonate.

The resultant polymer was evaluated for average molecular weight by means of gel permeation chromatography in the same manner as in Preparation Example A-3. As a result, the resultant polymer was found to have a number average molecular weight Mn of 10,900 and a weight average molecular weight Mw of 15,600.

The scales of these procedures were increased to produce a large amount of polyhydroxyalkanoate containing units represented by the formula (27).

The compound was provided as Exemplified Compound PHA (A).

Preparation Example B-1

(51)

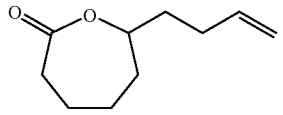

[Synthesis of Polyester Using 7-(3-butenyl)-2-oxepanone Represented by Chemical Formula (51) and L-lactide]

0.34 g (2.0 mmol) of 7-(3butenyl)-2-oxepanone, 1.15 g (8.0 mmol) of L-lactide, 20 μl of a solution of 2 M of di-isopropylzinc in toluene, and 8 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 10 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 1.05 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (52) as a monomer unit. The analysis also confirmed that an A unit accounted for 8 mol % of the monomer unit and a B unit accounted for 92 mol % thereof.

(52)

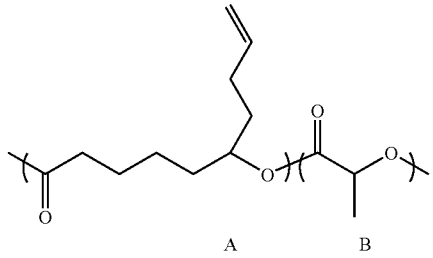

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 43,500 and a weight average molecular weight Mw of 67,400.

Preparation Example B-2

Oxidation reaction of polyhydroxyalkanoate composed of unit represented by chemical formula (52) synthesized in Preparation Example B-1

(52)

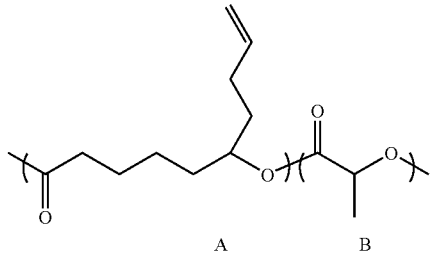

0.50 g of the polyhydroxyalkanoate copolymer composed of the unit represented by the chemical formula (52) synthesized in Preparation Example B-1 (A: 8 mol %, B: 92 mol %) was placed in a round-bottomed flask, and 30 ml of acetone were added to dissolve this. The flask was placed in an ice bath, 5 ml of acetic acid and 0.40 g of 18-crown-6-ether were added, and the whole was stirred. Next, 0.32 g of potassium permanganate was gradually added to the flask in the ice bath, and the whole was stirred in the ice bath for 2 hours and stirred at room temperature for an additional 18 hours. After the completion of the reaction, 60 ml of ethyl acetate were added, and 45 ml of water were further added. Next, sodium hydrogen sulfite was added until peracid was removed. After that, liquid property was adjusted with 1.0N hydrochloric acid to have a pH of 1. The organic layer was extracted and washed with 1.0N hydrochloric acid 3 times. After the organic layer had been collected, the solvent was distilled off to collect a crude polymer. Next, the polymer was washed with 50 ml of water and 50 ml of methanol, and was further washed with 50 ml of water 3 times, followed by collection of a polymer. Next, the polymer was dissolved into THF, and reprecipitated in methanol in an amount 50 times that of THF necessary for the dissolution. The precipitate was collected and dried under reduced pressure to prepare 0.44 g of a polymer.

NMR analysis was performed under the same conditions as those of Preparation Example A-1 to determine the structure of the resultant polymer. The analysis confirmed that the polymer was a polyhydroxyalkanoate containing a unit represented by the following chemical formula (53) as a monomer unit.

(53)

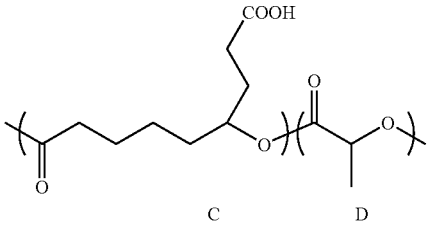

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 37,500 and a weight average molecular weight Mw of 59,600.

A carboxyl group at the terminal of a side chain of the resultant polyhydroxyalkanoate was methyl esterified with trimethylsilyldiazomethane to calculate the unit of the polyhydroxyalkanoate.

30 mg of the polyhydroxyalkanoate as a target product were placed in a 100-ml round-bottomed flask, and 2.1 ml of chloroform and 0.7 ml of methanol were added to dissolve them. 0.5 ml of a 2 mol/L hexane solution of trimethylsilyldiazomethane was added to the solution, and the whole was stirred at room temperature for 1 hour. After the completion of the reaction, the solvent was distilled off to collect a polymer. The polymer was washed with 50 ml of methanol, then recovered. The polymer was dried under reduced pressure to prepare 28 mg of a polyhydroxyalkanoate.

NMR analysis was performed in the same manner as in Preparation Example A-1. The analysis confirmed that the polyhydroxyalkanoate was a copolymer in which a C unit accounted for 8 mol % of the unit of the polyhydroxyalkanoate represented by the chemical formula (53) and a D unit accounted for 92 mol % thereof.

Preparation Example B-3

Condensation reaction between polyhydroxyalkanoate composed of unit represented by chemical formula (53) synthesized in Preparation Example B-2 and 2-amino-2-methylpropanesulfonic acid (53)

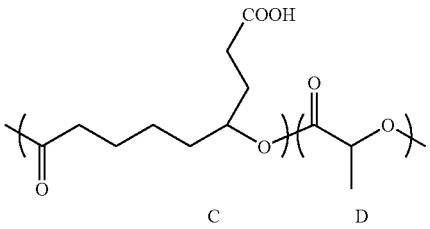

Under a nitrogen atmosphere, 0.40 g of the polyhydroxyalkanoate copolymer composed of the unit represented by the chemical formula (53) synthesized in Preparation Example B-2 (C: 8 mol %, D: 92 mol %) and 0.30 g of 2-amino-2-methylpropanesulfonic acid were placed in a 100-ml three-necked flask. 15.0 ml of pyridine were added to the flask, and the mixture was stirred. After that, 1.03 ml of triphenyl phosphite were added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.32 g of a polymer.

The structure of the resultant polymer was determined through analysis according to $^1$H-NMR and Fourier transformation-infrared absorption (FT-IR) spectrum in the same manner as in Preparation Example A-3. In the FT-IR spectrum, a peak at 1,695 cm$^{-1}$ derived from a carboxylic acid reduced, and a peak derived from an amide group was newly observed at 1,668 cm$^{-1}$.

$^1$H-NMR confirmed that the resultant polymer was a polyhydroxyalkanoate containing a unit represented by the following chemical formula (54) as a monomer unit because a peak derived from methylene of the 2-amino-2-methylpropanesulfonic acid structure shifted.

(54)

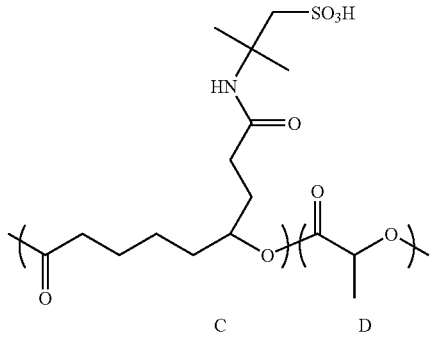

It was also confirmed that the polyhydroxyalkanoate was a copolymer in which an E unit accounted for 8 mol % of the unit of the polyhydroxyalkanoate represented by the chemical formula (54) and an F unit accounted for 92 mol % thereof.

The resultant polymer was evaluated for average molecular weight by means of gel permeation chromatography in the same manner as in Preparation Example A-3. As a result, the resultant polymer was found to have a number average molecular weight Mn of 37,500 and a weight average molecular weight Mw of 59,600.

The scales of these procedures were increased to produce a large amount of polyhydroxyalkanoate containing units represented by the formula (54). The compound was provided as Exemplified Compound PHA (B).

Preparation Example C-1

[Synthesis of Polyester Using phenylmethyl 7-oxo-4-oxepane carboxylate Represented by Chemical Formula (89) and L-lactide]

(89)

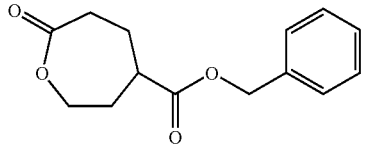

2.48 g (10.0 mmol) of phenylmethyl 7-oxo-4-oxepane carboxylate represented by the chemical formula (89), 7.21 g (50.0 mmol) of L-lactide, 2.4 ml of a solution of 0.1 M of tin octylate(tin 2-ethylhexanoate) in toluene, and 2.4 ml of a solution of 0.1 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 12 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 7.08 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (90) as a monomer unit. The analysis also confirmed that an A unit accounted for 8 mol % of the monomer unit and a B unit accounted for 92 mol % thereof.

(90)

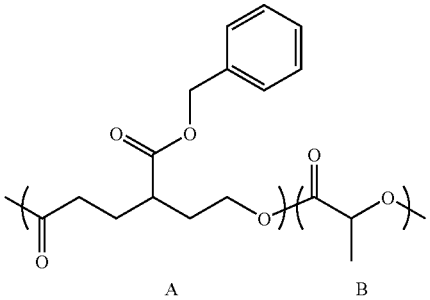

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 10,300 and a weight average molecular weight Mw of 14,800.

Preparation Example C-2

5.00 g of the polyhydroxyalkanoate copolymer represented by the chemical formula (90) synthesized in Preparation Example C-1 were dissolved into 500 ml of a mixed solvent of dioxane-ethanol (75:25), and 1.10 g of a 5% palladium/carbon catalyst were added to the solution. The inside of the reaction system was filled with hydrogen, and the whole was stirred at room temperature for 1 day. After the completion of the reaction, in order to remove the catalyst, the resultant was filtered through a 0.25-μm membrane filter to collect a reaction solution. After the solution had been concentrated, the concentrate was dissolved into chloroform, and reprecipitated in methanol in an amount 10 times that of chloroform. The resultant polymer was collected and dried under reduced pressure to prepare 3.70 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (91) as a monomer unit. The analysis also confirmed that a C unit accounted for 8 mol % of the monomer unit and a D unit accounted for 92 mol % thereof.

(91)

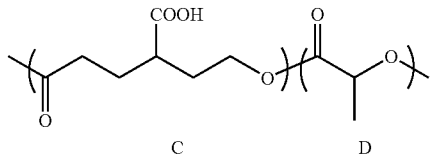

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 9,500 and a weight average molecular weight Mw of 12,900.

Preparation Example C-3

Condensation reaction between polyhydroxyalkanoate composed of unit represented by chemical formula (91) synthesized in Preparation Example C-2 and 1-naphthylamine-8-sulfonic acid (91)

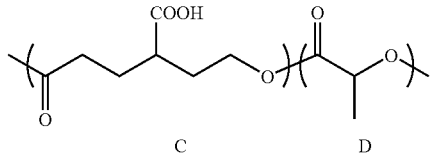

Under a nitrogen atmosphere, 0.40 g of the polyhydroxyalkanoate copolymer composed of the unit represented by the chemical formula (91) synthesized in Preparation Example C-2 (C: 8 mol %, D: 92 mol %) and 0.45 g of 1-naphthylamine-8-sulfonic acid were placed in a 100-ml three-necked flask. 15.0 ml of pyridine were added to the flask, and the mixture was stirred. After that, 1.06 ml of triphenyl phosphite were added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.33 g of a polymer.

The structure of the resultant polymer was determined through analysis according to $^1$H-NMR and Fourier transformation-infrared absorption (FT-IR) spectrum in the same manner as in Preparation Example A-3. In the FT-IR spectrum, a peak at 1,695 cm$^{-1}$ derived from a carboxylic acid reduced, and a peak derived from an amide group was newly observed at 1,658 cm$^{-1}$.

$^1$H-NMR confirmed that the resultant polymer was a polyhydroxyalkanoate containing a unit represented by the following chemical formula (92) as a monomer unit because a peak derived from an aromatic ring of the 1-naphthylamine-8-sulfonic acid structure shifted.

(92)

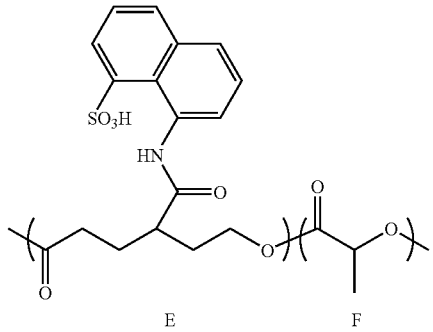

It was also confirmed that the polyhydroxyalkanoate was a copolymer in which an E unit accounted for 8 mol % of the unit of the polyhydroxyalkanoate represented by the chemical formula (92) and an F unit accounted for 92 mol % thereof.

The resultant polymer was evaluated for average molecular weight by means of gel permeation chromatography in the same manner as in Preparation Example A-3. As a result, the resultant polymer was found to have a number average molecular weight Mn of 8,200 and a weight average molecular weight Mw of 12,400.

Preparation Example C-4

Esterification reaction of polyhydroxyalkanoate composed of unit represented by chemical formula (92) synthesized in Preparation Example C-3

(92)

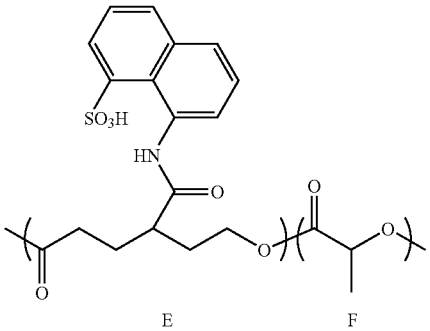

0.30 g of the polyhydroxyalkanoate copolymer composed of the unit represented by the chemical formula (92) synthesized in Preparation Example C-3 (E: 8 mol %, F: 92 mol %) was added to a round-bottomed flask. Then, 21.0 ml of chloroform and 7.0 ml of methanol were added to dissolve the copolymer, and the solution was cooled to 0° C. 1.34 ml of a 2 mol/L hexane solution of trimethylsilyldiazomethane (manufactured by Aldrich) were added to the solution, and the whole was stirred for 4 hours. After the completion of the reaction, the solvent was distilled off by using an evaporator, and then the polymer was collected.

Furthermore, 21.0 ml of chloroform and 7.0 ml of methanol were added to dissolve the polymer again. Then, the solvent was distilled off by using an evaporator. This operation was repeated 3 times.

The collected polymer was dried under reduced pressure to prepare 0.30 g of a polymer.

The structure of the resultant polymer was determined through analysis according to $^1$H-NMR in the same manner as in Preparation Example A-3. $^1$H-NMR confirmed that the resultant polymer was a polyhydroxyalkanoate containing a unit represented by the following chemical formula (93) as a monomer unit because a peak derived from methyl sulfonate was observed at 3 to 4 ppm.

(93)

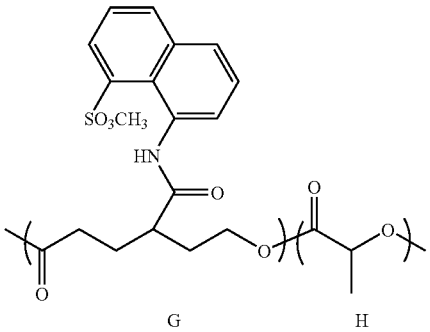

It was also confirmed that the polyhydroxyalkanoate was a copolymer in which a G unit accounted for 8 mol % of the unit of the polyhydroxyalkanoate represented by the chemical formula (93) and an H unit accounted for 92 mol % thereof.

Also an acid value titration utilizing a potentiometric titration apparatus AT510 (manufactured by KYOTO ELECTRONICS MANUFACTURING CO., LTD; trade name) did not show a peak attributable to a sulfonic acid, thus clarifying that the sulfonic acid was converted to methyl sulfonate.

The resultant polymer was evaluated for average molecular weight by means of gel permeation chromatography in the same manner as in Preparation Example A-3. As a result, the resultant polymer was found to have a number average molecular weight Mn of 7,500 and a weight average molecular weight Mw of 11,400.

The scales of these procedures were increased to produce a large amount of polyhydroxyalkanoate containing units represented by the formula (93).

The compound was provided as Exemplified Compound PHA (C).

Preparation Example D-1

[Synthesis of Polyester Using 3-(9-decenyl)-2-oxetanone Represented by Chemical Formula (65) and L-lactide]

(65)

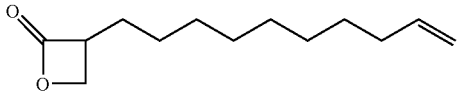

0.36 g (2.0 mmol) of 3-(9-decenyl)-2-oxetanone represented by the chemical formula (65), 1.44 g (10.0 mmol) of L-lactide, 4.8 ml of a solution of 0.01 M of tin octylate(tin 2-ethylhexanoate) in toluene, and 4.8 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 12 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 0.75 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (66) as a monomer unit. The analysis also confirmed that an A unit accounted for 4 mol % of the monomer unit and a B unit accounted for 96 mol % thereof.

(66)

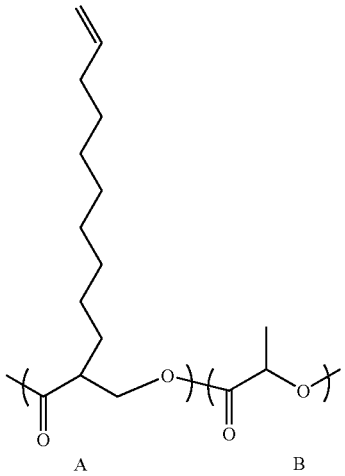

Preparation Example D-2

Oxidation reaction of polyhydroxyalkanoate composed of unit represented by chemical formula (66) synthesized in Preparation Example D-1

(66)

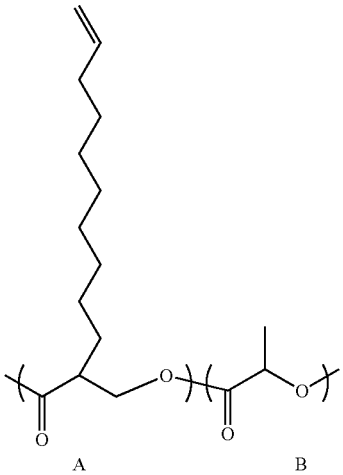

0.50 g of the polyhydroxyalkanoate copolymer composed of the unit represented by the chemical formula (66) synthesized in Preparation Example D-1 (A: 4 mol %, B: 96 mol %) was placed in a round-bottomed flask, and 30 ml of acetone were added to dissolve this. The flask was placed in an ice bath, 5 ml of acetic acid and 0.21 g of 18-crown-6-ether were added, and the whole was stirred. Next, 0.17 g of potassium permanganate was gradually added to the flask in the ice bath, and the whole was stirred in the ice bath for 2 hours and stirred at room temperature for an additional 18 hours. After the completion of the reaction, 60 ml of ethyl acetate were added, and 45 ml of water were further added. Next, sodium hydrogen sulfite was added until peracid was removed. After that, liquid property was adjusted with 1.0N hydrochloric acid to have a pH of 1. The organic layer was extracted and washed with 1.0N hydrochloric acid 3 times. After the organic layer had been collected, the solvent was distilled off to collect a crude polymer. Next, the polymer was washed with 50 ml of water and 50 ml of methanol, and was further washed with 50 ml of water 3 times, followed by collection of a polymer. Next, the polymer was dissolved into 3 ml of THF, and reprecipitated in methanol in an amount 50 times that of THF necessary for the dissolution. The precipitate was collected and dried under reduced pressure to prepare 0.44 g of a polymer.

NMR analysis was performed under the same conditions as those of Preparation Example A-1 to determine the structure of the resultant polymer. The analysis confirmed that the polymer was a polyhydroxyalkanoate containing a unit represented by the following chemical formula (67) as a monomer unit.

(67)

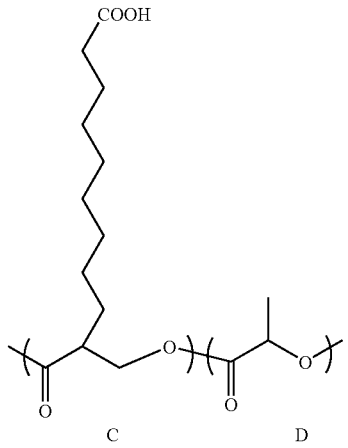

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 13,100 and a weight average molecular weight Mw of 19,100.

A carboxyl group at the terminal of a side chain of the resultant polyhydroxyalkanoate was methyl esterified with trimethylsilyldiazomethane to calculate the unit of the polyhydroxyalkanoate.

30 mg of the polyhydroxyalkanoate as a target product were placed in a 100-ml round-bottomed flask, and 2.1 ml of chloroform and 0.7 ml of methanol were added to dissolve them. 0.5 ml of a 2 mol/L hexane solution of trimethylsilyldiazomethane was added to the solution, and the whole was stirred at room temperature for 1 hour. After the completion of the reaction, the solvent was distilled off to collect a polymer. The polymer was washed with 50 ml of methanol, then recovered. The polymer was dried under reduced pressure to prepare 29 mg of a polyhydroxyalkanoate.

NMR analysis was performed in the same manner as in Preparation Example A-1. The analysis confirmed that the polyhydroxyalkanoate was a copolymer in which a C unit accounted for 4 mol % of the unit of the polyhydroxyalkanoate represented by the chemical formula (67) and a D unit accounted for 96 mol % thereof.

The scales of these procedures were increased to produce a large amount of polyhydroxyalkanoate containing units represented by the formula (67).

The compound was provided as Exemplified Compound PHA (D).

Preparation Example E-1

[Synthesis of Polyester Using tetrahydro-3-(2-propenyl)-2H-pyrane-2-one and mandelide]

0.28 g (2.0 mmol) of tetrahydro-3-(2-propenyl)-2H-pyrane-2-one, 2.68 g (10.0 mmol) of mandelide, 4.8 ml of a solution of 0.01 M of tin octylate(tin 2-ethylhexanoate) in toluene, and 4.8 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 10 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 2.06 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (73) as a monomer unit. The analysis also confirmed that an A unit accounted for 12 mol % of the monomer unit and a B unit accounted for 88 mol % thereof.

(73)

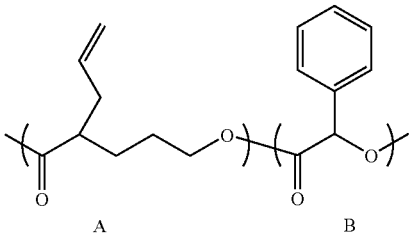

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 48,000 and a weight average molecular weight Mw of 97,200.

Preparation Example E-2

Oxidation reaction of polyhydroxyalkanoate composed of unit represented by chemical formula (73) synthesized in Preparation Example E-1

(73)

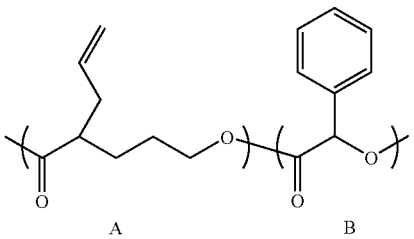

0.50 g of the polyhydroxyalkanoate copolymer composed of the unit represented by the chemical formula (73) synthesized in Preparation Example E-1 (A: 12 mol %, B: 88 mol %) was placed in a round-bottomed flask, and 30 ml of acetone were added to dissolve this. The flask was placed in an ice bath, 5 ml of acetic acid and 0.35 g of 18-crown-6-ether were added, and the whole was stirred. Next, 0.28 g of potassium permanganate was gradually added to the flask in the ice bath, and the whole was stirred in the ice bath for 2 hours and stirred at room temperature for an additional 18 hours. After the completion of the reaction, 60 ml of ethyl acetate were added, and 45 ml of water were further added. Next, sodium hydrogen sulfite was added until peracid was removed. After that, liquid property was adjusted with 1.0N hydrochloric acid to have a pH of 1. The organic layer was extracted and washed with 1.0N hydrochloric acid 3 times. After the organic layer had been collected, the solvent was distilled off to collect a crude polymer. Next, the polymer was washed with 50 ml of water and 50 ml of methanol, and was further washed with 50 ml of water 3 times, followed by collection of a polymer. Next, the polymer was dissolved into 3 ml of THF, and reprecipitated in methanol in an amount 50 times that of THF necessary for the dissolution. The precipitate was collected and dried under reduced pressure to prepare 0.44 g of a polymer.

NMR analysis was performed under the same conditions as those of Preparation Example A-1 to determine the structure of the resultant polymer. The analysis confirmed that the polymer was a polyhydroxyalkanoate containing a unit represented by the following chemical formula (74) as a monomer unit.

(74)

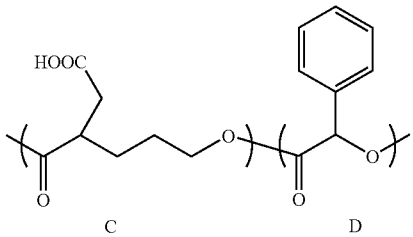

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 38,600 and a weight average molecular weight Mw of 69,100.

A carboxyl group at the terminal of a side chain of the resultant polyhydroxyalkanoate was methyl esterified with trimethylsilyldiazomethane to calculate the unit of the polyhydroxyalkanoate.

30 mg of the polyhydroxyalkanoate as a target product were placed in a 100-ml round-bottomed flask, and 2.1 ml of chloroform and 0.7 ml of methanol were added to dissolve them. 0.5 ml of a 2 mol/L hexane solution of trimethylsilyldiazomethane was added to the solution, and the whole was stirred at room temperature for 1 hour. After the completion of the reaction, the solvent was distilled off to collect a polymer. The polymer was washed with 50 ml of methanol, then recovered. The polymer was dried under reduced pressure to prepare 28 mg of a polyhydroxyalkanoate.

NMR analysis was performed in the same manner as in Preparation Example A-1. The analysis confirmed that the polyhydroxyalkanoate was a copolymer in which a C unit accounted for 11 mol % of the unit of the polyhydroxyalkanoate represented by the chemical formula (74) and a D unit accounted for 89 mol % thereof.

The scales of these procedures were increased to produce a large amount of polyhydroxyalkanoate containing units represented by the formula (74).

The compound was provided as Exemplified Compound PHA (E).

Preparation Example F-1

[Synthesis of Polyester Using 3-(2-propenyl)-2-oxepanone Represented by Chemical Formula (76) and L-lactide]

(76)

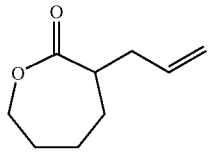

0.31 g (2.0 mmol) of 3-(2-propenyl)-2-oxepanone represented by the chemical formula (76), 1.44 g (10.0 mmol) of L-lactide, 4.8 ml of a solution of 0.01 M of tin octylate(tin 2-ethylhexanoate) in toluene, and 4.8 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 150° C. to perform ring-opening polymerization. 10 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 1.32 g of a polymer.

NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (77) as a monomer unit. The analysis also confirmed that an A unit accounted for 10 mol % of the monomer unit and a B unit accounted for 90 mol % thereof.

(77)

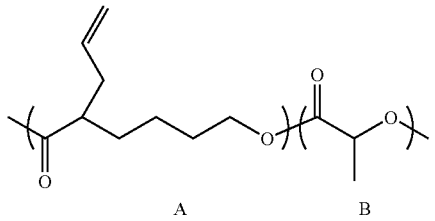

A B

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 132,000 and a weight average molecular weight Mw of 220,400.

Preparation Example F-2

Oxidation reaction of polyhydroxyalkanoate composed of unit represented by chemical formula (77) synthesized in Preparation Example F-1

(77)

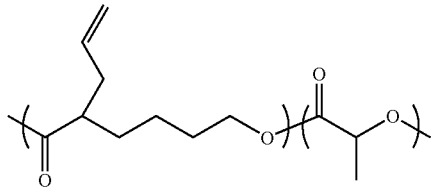

A B 0.50 g of the polyhydroxyalkanoate copolymer composed of the unit represented by the chemical formula (77) synthesized in Preparation Example F-1 (A: 10 mol %, B: 90 mol %) was placed in a round-bottomed flask, and 30 ml of acetone were added to dissolve this. The flask was placed in an ice bath, 5 ml of acetic acid and 0.45 g of 18-crown-6-ether were added, and the whole was stirred. Next, 0.36 g of potassium permanganate was gradually added to the flask in the ice bath, and the whole was stirred in the ice bath for 2 hours and stirred at room temperature for an additional 18 hours. After the completion of the reaction, 60 ml of ethyl acetate were added, and 45 ml of water were further added. Next, sodium hydrogen sulfite was added until peracid was removed. After that, liquid property was adjusted with 1.0N hydrochloric acid to have a pH of 1. The organic layer was extracted and washed with 1.0N hydrochloric acid 3 times. After the organic layer had been collected, the solvent was distilled off to collect a crude polymer. Next, the polymer was washed with 50 ml of water and 50 ml of methanol, and was further washed with 50 ml of water 3 times, followed by collection of a polymer. Next, the polymer was dissolved into 3 ml of THF, and reprecipitated in methanol in an amount 50 times that of THF necessary for the dissolution. The precipitate was collected and dried under reduced pressure to prepare 0.44 g of a polymer.

NMR analysis was performed under the same conditions as those of Preparation Example A-1 to determine the structure of the resultant polymer. The analysis confirmed that the polymer was a polyhydroxyalkanoate containing a unit represented by the following chemical formula (78) as a monomer unit.

(78)

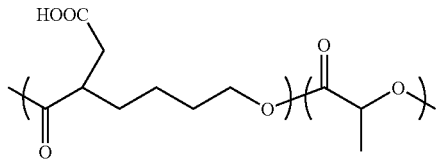

C D

The resultant polyhydroxyalkanoate was evaluated for average molecular weight by means of gel permeation chromatography in the same manner as in Preparation Example A-1. As a result, the resultant polyhydroxyalkanoate was found to have a number average molecular weight Mn of 115,400 and a weight average molecular weight Mw of 202,000.

A carboxyl group at the terminal of a side chain of the resultant polyhydroxyalkanoate was methyl esterified with trimethylsilyldiazomethane to calculate the unit of the polyhydroxyalkanoate.

30 mg of the polyhydroxyalkanoate as a target product were placed in a 100-ml round-bottomed flask, and 2.1 ml of chloroform and 0.7 ml of methanol were added to dissolve them. 0.5 ml of a 2 mol/L hexane solution of trimethylsilyldiazomethane was added to the solution, and the whole was stirred at room temperature for 1 hour. After the completion of the reaction, the solvent was distilled off to collect a polymer. The polymer was washed with 50 ml of methanol, then recovered. The polymer was dried under reduced pressure to prepare 28 mg of a polyhydroxyalkanoate.

NMR analysis was performed in the same manner as in Preparation Example A-1. The analysis confirmed that the polyhydroxyalkanoate was a copolymer in which a C unit accounted for 9 mol % of the unit of the polyhydroxyalkanoate represented by the chemical formula (78) and a D unit accounted for 91 mol % thereof.

The scales of these procedures were increased to produce a large amount of polyhydroxyalkanoate containing units represented by the formula (78).

The compound was provided as Exemplified Compound PHA (F).

Preparation Example 2A-1

[Synthesis of L-3-(2-benzyloxycarbonyl)ethyl-1,4-dioxane-2,5-dione Represented by Chemical Formula (98)]

(98)

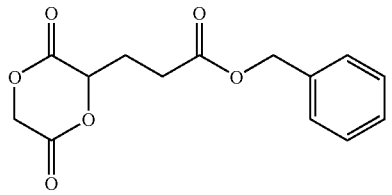

20 g of L-glutamic acid were dissolved into 200 ml of 80% sulfuric acid, and 500 g of benzyl alcohol were added and allowed to react with the solution while the temperature of the solution was kept at 70° C., thereby preparing a crude product containing a compound represented by the chemical formula (99) in which a carboxyl group at reposition was protected. 100 g of the crude product were added to 1,400 ml of 1N sulfuric acid. While the mixture was stirred at 0 to 5° C., 100 ml of an aqueous solution containing 45.2 g of sodium sulfite were dropped over about 3 hours. Then, the resultant was continuously stirred for 30 minutes. Furthermore, 30 ml of an aqueous solution containing 9.4 g of sodium sulfite were dropped over about 30 minutes, and the resultant was left standing at room temperature overnight. The resultant was extracted with ether. The extract was dried with sodium sulfate and concentrated, and the remaining crude crystal was purified by means of silica gel column chromatography and recrystallization to prepare a compound represented by the chemical formula (100). 20 g of the compound represented by the chemical formula (100) and 17.4 g of bromoacetylchloride were dissolved into 300 ml of ether, the solution was cooled to 5° C. or lower, and 50 ml of an ether solution containing 9.5 g of 1.1 times mole of triethylamine were dropped over 30 minutes. The reaction mixture was stirred at room temperature for an additional 6 hours and filtered, and 50 ml of water were added to the filtrate, followed by stirring for 30 minutes. Liquid separation was performed by adding water several times, and sodium sulfate was added to the ether layer for drying, followed by concentration. As a result, 28.3 g of a compound represented by the chemical formula (101) were prepared in 94% yield.

A solution of 10 g of the compound represented by the chemical formula (101) in 50 ml of DMF was dropped into a solution of 3.6 g of sodium hydrogen carbonate in 950 ml of DMF (heterogeneous solution) over about 8 hours at room temperature. Furthermore, the resultant was allowed to react at the same temperature for 12 hours, the resultant was filtered, DMF was concentrated, and the residue was washed with 50 ml of isopropanol. After the filtration, the resultant white powder was dissolved into 200 ml of acetone, insoluble matter was filtered out, and the filtrate was concentrated. The residue was washed with a small amount of isopropanol, filtered, and sufficiently dried. The white powder was sublimated and recrystallized with 400 ml of isopropanol to prepare 1.9 g of L-3-(2-benzyloxycarbonyl)ethyl-1,4-dioxane-2,5-dione represented by the chemical formula (98) (24% yield).

(99)

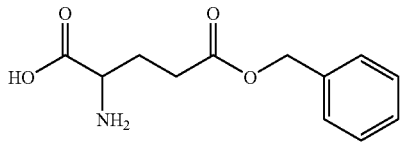

(100)

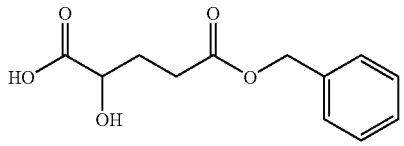

(101)

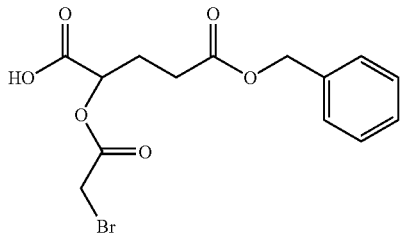

Preparation Example 2A-2

[Synthesis of Polyester Using L-3-(2-benzyloxycarbonyl) ethyl-1,4-dioxane-2,5-dione Represented by Chemical Formula (98) and Phenyl lactide(3,6-bis(phenylmethyl)-1,4-dioxane-2,5-dione)]

0.56 g (2.0 mmol) of L-3-(2-benzyloxycarbonyl)ethyl-1,4-dioxane-2,5-dione represented by the chemical formula (98) synthesized in Preparation Example 2A-1, 2.96 g (10.0 mmol) of phenyl lactide, 4.8 ml of a solution of 0.01 M of tin octylate(tin 2-ethylhexanoate) in toluene, and 4.8 ml of a solution of 0.01 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 180° C. to perform ring-opening polymerization. 2 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 2.98 g of a polymer. NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (102) as a monomer unit. The analysis also confirmed that an A unit accounted for 12 mol % of the monomer unit and a B unit accounted for 88 mol % thereof.

(102)

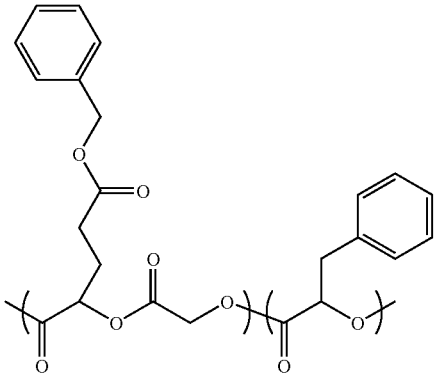

A B

The resultant polyhydroxyalkanoate was evaluated for average molecular weight in the same manner as in Preparation Example A-1. As a result, the resultant polyhydroxyalkanoate was found to have a number average molecular weight Mn of 37,500 and a weight average molecular weight Mw of 53,300.

1.00 g of the polyhydroxyalkanoate copolymer represented by the chemical formula (102) synthesized here was dissolved into 100 ml of a mixed solvent of dioxane-ethanol (75:25), and 0.22 g of a 5% palladium/carbon catalyst was added to the solution. The inside of the reaction system was filled with hydrogen, and the whole was stirred at room temperature for 1 day. After the completion of the reaction, in order to remove the catalyst, the resultant was filtered through a 0.25-μm membrane filter to collect a reaction solution. After the solution had been concentrated, the concentrate was dissolved into chloroform, and reprecipitated in methanol in an amount 10 times that of chloroform. The resultant polymer was collected and dried under reduced pressure to prepare 0.75 g of a polymer. NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (103) as a monomer unit. The analysis also confirmed that a C unit accounted for 12 mol % of the monomer unit and a D unit accounted for 88 mol % thereof.

(103)

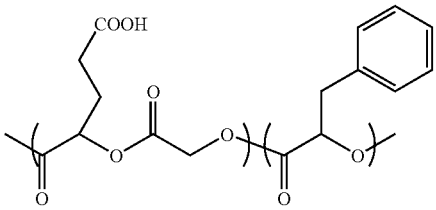

C D

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 31,200 and a weight average molecular weight Mw of 46,800.

Preparation Example 2A-3

[Condensation Reaction between Polyhydroxyalkanoate Composed of Unit Represented by Chemical Formula (103) Synthesized in Preparation Example 2A-2 and 2-aminobenzenesulfonic Acid]

(103)

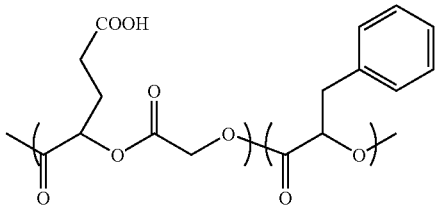

C D

Under a nitrogen atmosphere, 0.40 g of the polyhydroxyalkanoate copolymer composed of the unit represented by the chemical formula (103) synthesized in Preparation Example 2A-2 (C: 12 mol %, D: 88 mol %) and 0.27 g of 2-aminobenzenesulfonic acid were placed in a 100-ml three-necked flask. 15.0 ml of pyridine were added to the flask, and the mixture was stirred. After that, 0.82 ml of triphenyl phosphite was added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.36 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature) or Fourier transformation-infrared absorption (FT-IR) spectrum (Nicolet AVATAR 360FT-IR). As a result of IR measurement, a peak at 1,695 cm$^{-1}$ derived from a carboxylic acid reduced, and a peak derived from an amide group was newly observed at 1,658 cm$^{-1}$.

$^1$H-NMR confirmed that the resultant polymer was a polyhydroxyalkanoate containing a unit represented by the following chemical formula (104) as a monomer unit because a peak derived from an aromatic ring of the 2-aminobenzenesulfonic acid structure shifted.

(104)

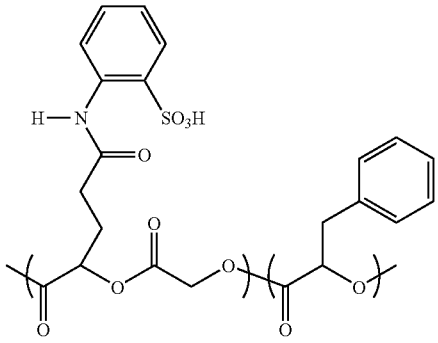

E F

It was also confirmed that the polyhydroxyalkanoate was a copolymer in which an E unit accounted for 11 mol % of the unit of the polyhydroxyalkanoate represented by the chemical formula (104) and an F unit accounted for 89 mol % thereof. The resultant polymer was evaluated for average molecular weight by means of gel permeation chromatography (GPC; Tosoh Corporation HLC-8120, column; Polymer Laboratories PLgel 5μ MIXED-C, solvent; DMF/LiBr 0.1% (w/v), in terms of polystyrene). As a result, the resultant polymer was found to have a number average molecular weight Mn of 26,800 and a weight average molecular weight Mw of 42,900.

The scales of these procedures were increased to produce a large amount of polyhydroxyalkanoate containing units represented by the formula (104).

The compound was provided as Exemplified Compound PHA (2A).

Preparation Example 2B-1

[Synthesis of Polyester Using tetrahydro-3-(2-propenyl)-2H-pyrane-2-one and Phenyl lactide(3,6-bis(phenylmethyl)-1,4-dioxane-2,5-dione)]

0.28 g (2.0 mmol) of tetrahydro-3-(2-propenyl)-2H-pyrane-2-one, 2.96 g (10.0 mmol) of phenyl lactide, 4.8 ml of a solution of 0.01 M of tin octylate(tin 2-ethylhexanoate) in toluene, and 4.8 ml of a solution of 0.01 M of p-tert-butylbenzyl alcohol in toluene were placed in a polymerization ampule. After that, 2.06 g of a polymer were prepared in the same manner as in Preparation Example A-1. NMR analysis was performed under the same conditions as those of Preparation Example A-1 to determine the structure of the resultant polymer. The analysis confirmed that the polymer was a polyhydroxyalkanoate copolymer containing a unit represented by the following chemical formula (105) as a monomer unit. The analysis also confirmed that an A unit accounted for 13 mol % of the monomer unit and a B unit accounted for 87 mol % thereof.

(105)

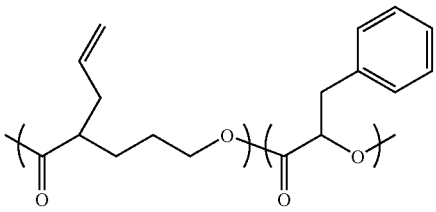

The resultant polyhydroxyalkanoate was evaluated for average molecular weight in the same manner as in Preparation Example A-1. As a result, the resultant polyhydroxyalkanoate was found to have a number average molecular weight Mn of 32,000 and a weight average molecular weight Mw of 56,000.

Preparation Example 2B-2

[Oxidation Reaction of Polyhydroxyalkanoate Composed of Unit Represented by Chemical Formula (105) Synthesized in Preparation Example 2B-1]

(105)

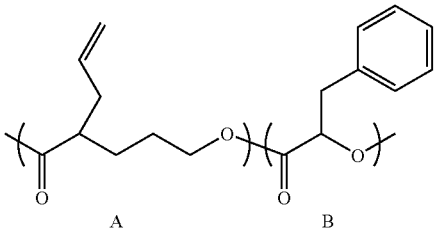

0.50 g of the polyhydroxyalkanoate copolymer composed of the unit represented by the chemical formula (105) synthesized in Preparation Example 2B-1 (A: 13 mol %, B: 87 mol %) was placed in a round-bottomed flask, and 30 ml of acetone were added to dissolve this. The flask was placed in an ice bath, 5 ml of acetic acid and 0.35 g of 18-crown-6-ether were added, and the whole was stirred. Next, 0.28 g of potassium permanganate was gradually added to the flask in the ice bath, and the whole was stirred in the ice bath for 2 hours and stirred at room temperature for an additional 18 hours. After the completion of the reaction, 0.45 g of a polymer was prepared in the same manner as in Preparation Example A-2. NMR analysis was performed under the same conditions as those of Preparation Example A-1 to determine the structure of the resultant polymer. The analysis confirmed that the polymer was a polyhydroxyalkanoate containing a unit represented by the following chemical formula (106) as a monomer unit.

(106)

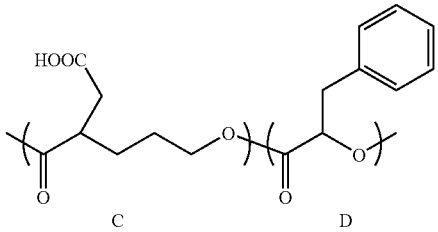

The resultant polyhydroxyalkanoate was evaluated for average molecular weight in the same manner as in Preparation Example A-1. As a result, the resultant polyhydroxyalkanoate was found to have a number average molecular weight Mn of 30,100 and a weight average molecular weight Mw of 54,200.

Furthermore, in order to calculate the unit of the resultant polyhydroxyalkanoate, 29 mg of the polyhydroxyalkanoate prepared in the same manner as in Preparation Example A-2 were subjected to NMR analysis in the same manner as in Preparation Example A-1. The analysis confirmed that the polyhydroxyalkanoate was a copolymer in which a C unit accounted for 12 mol % of the unit of the polyhydroxyalkanoate represented by the chemical formula (106) and a D unit accounted for 88 mol % thereof.

Preparation Example 2B-3

[Condensation Reaction Between Polyhydroxyalkanoate Composed of Unit Represented by Chemical Formula (106) Synthesized in Preparation Example 2B-2 and 4-methoxyaniline-2-sulfonic Acid]

(106)

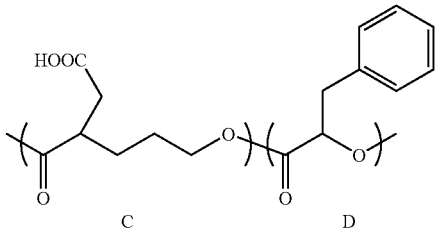

Under a nitrogen atmosphere, 0.40 g of the polyhydroxyalkanoate copolymer composed of the unit represented by the chemical formula (106) synthesized in Preparation Example 2B-2 (C: 12 mol %, D: 88 mol %) and 0.33 g of 4-methoxyaniline-2-sulfonic acid were placed in a 100-ml three-necked flask. 15.0 ml of pyridine were added to the flask, and the mixture was stirred. After that, 0.84 ml of triphenyl phosphite was added, and the whole was heated at 120° C. for 6 hours. After the completion of the reaction, 0.33 g of a polymer was prepared in the same manner as in Preparation Example A-3. The structure of the resultant polymer was determined through analysis in the same manner as in Preparation Example A-3. As a result of IR measurement, a peak at 1,695 $cm^{-1}$ derived from a carboxylic acid reduced, and a peak derived from an amide group was newly observed at 1,658 $cm^{-1}$. $^1$H-NMR confirmed that the resultant polymer was a polyhydroxyalkanoate containing a unit represented by the following chemical formula (107) as a monomer unit because a peak derived from an aromatic ring of the 4-methoxyaniline-2-sulfonic acid structure shifted.

(107)

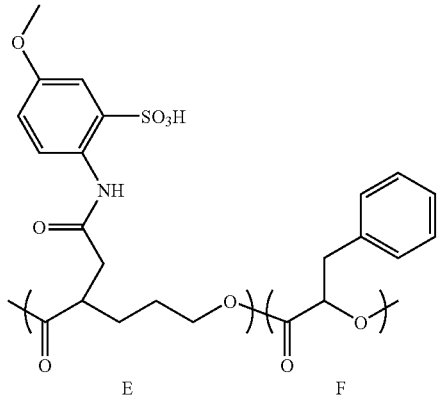

It was also confirmed that the polyhydroxyalkanoate was a copolymer in which an E unit accounted for 11 mol % of the unit of the polyhydroxyalkanoate represented by the chemical formula (107) and an F unit accounted for 89 mol % thereof. The resultant polymer was evaluated for average molecular weight in the same manner as in Preparation Example A-3. As a result, the resultant polymer was found to have a number average molecular weight Mn of 29,500 and a weight average molecular weight Mw of 53,700. The scales of these procedures were increased to produce a large amount of polyhydroxyalkanoate containing units represented by the formula (107). The compound was provided as Exemplified Compound PHA (2B).

Preparation Example 2C-1

[Synthesis of Polyester Using Phenyl Lactide]

29.63 g (100.0 mmol) of phenyl lactide, 4.0 ml of a solution of 0.1 M of tin octylate(tin 2-ethylhexanoate) in toluene, and 4.0 ml of a solution of 0.1 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 180° C. to perform ring-opening polymerization. 10 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 24.00 g of a polymer. NMR analysis was performed under the following conditions to determine the structure of the resultant polymer.

<Measuring equipment> FT-NMR: Bruker DPX 400

Resonance frequency: $^1$H=400 MHz

<Measurement conditions> Measured nuclear species: $^1$H

Solvent used: TMS/$CDCl_3$

Measurement temperature: room temperature

The analysis confirmed that the resultant compound was a polyhydroxyalkanoate containing a unit represented by the following chemical formula (108) as a monomer unit.

(108)

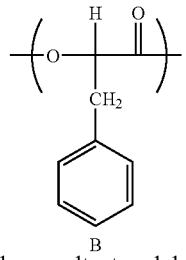

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 35,000 and a weight average molecular weight Mw of 49,000.

Preparation Example 2C-2

10.00 g of the polyhydroxyalkanoate composed of the unit represented by the chemical formula (108) synthesized in Preparation Example 2C-1 were placed in a round-bottomed flask, and 500 ml of THF were added to dissolve this. The flask was placed under a nitrogen atmosphere, and the solution was stirred at −78° C. Next, 33.75 ml (67.5 mmol) of a solution of 2 M of lithium diisopropylamide in THF were gradually added to the flask, and the whole was stirred at −78° C. for 30 minutes. Next, 11.58 g (130.5 mmol) of benzyl chloroformate were added to the flask, and the whole was stirred at room temperature for 30 minutes. After the completion of the reaction, the reaction solution was poured into 1,000 ml of an aqueous solution of ammonium chloride, and 500 ml of dichloromethane were added to extract the organic layer. The extracted organic layer was washed with 250 ml of water 3 times. After the organic layer had been collected, the solvent was distilled off to collect a crude polymer. Next, the polymer was dissolved into 60 ml of THF, and reprecipitated in methanol in an amount 50 times that of THF necessary for the dissolution. The precipitate was collected and dried under reduced pressure to prepare 8.03 g of a polymer. NMR analysis was performed under the same conditions as those of Preparation Example 2C-1 to determine the structure of the resultant polymer. The analysis confirmed that the polymer was a polyhydroxyalkanoate containing a unit represented by the following chemical formula (109) as a monomer unit. The analysis also confirmed that an A unit accounted for 11 mol % of the monomer unit and a B unit accounted for 89 mol % thereof.

(109)

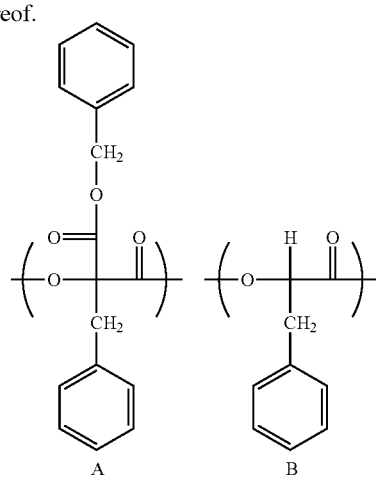

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 28,500 and a weight average molecular weight Mw of 41,000.

5.00 g of the polyhydroxyalkanoate copolymer represented by the chemical formula (109) synthesized here were dissolved into 500 ml of a mixed solvent of dioxane-ethanol (75:25), and 1.10 g of a 5% palladium/carbon catalyst were added to the solution. The inside of the reaction system was filled with hydrogen, and the whole was stirred at room temperature for 1 day. After the completion of the reaction, in order to remove the catalyst, the resultant was filtered through a 0.25-μm membrane filter to collect a reaction solution. After the solution had been concentrated, the concentrate was dissolved into chloroform, and reprecipitated in methanol in an amount 10 times that of chloroform. The resultant polymer was collected and dried under reduced pressure to prepare 3.66 g of a polymer. NMR analysis was performed under the same conditions as those of Preparation Example 2C-1 to determine the structure of the resultant polymer. The analysis confirmed that the polymer was a polyhydroxyalkanoate copolymer containing a unit represented by the following chemical formula (110) as a monomer unit. The analysis also confirmed that a C unit accounted for 11 mol % of the monomer unit and a D unit accounted for 89 mol % thereof.

(110)

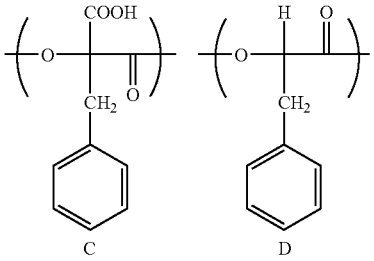

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 22,500 and a weight average molecular weight Mw of 33,800.

30 mg of the polyhydroxyalkanoate synthesized here were placed in a 100-ml round-bottomed flask. Then, 2.1 ml of chloroform and 0.7 ml of methanol were added to dissolve the polyhydroxyalkanoate. 0.5 ml of a 2 mol/L hexane solution of trimethylsilyldiazomethane was added to the solution, and the whole was stirred at room temperature for 1 hour. After the completion of the reaction, the solvent was distilled off, and then a polymer was collected. That was washed with 50 ml of methanol and then a polymer was collected. The polymer was dried under reduced pressure to prepare 29 mg of a polyhydroxyalkanoate.

The resultant polyhydroxyalkanoate was subjected to NMR analysis in the same manner as in Preparation Example 2C-1. The analysis confirmed that a carboxyl group of the C unit was transformed into methyl carboxylate, and that the resultant polymer can be esterified again.

Preparation Example 2C-3

Under a nitrogen atmosphere, 0.40 g of the polyhydroxyalkanoate copolymer composed of the unit represented by the chemical formula (110) synthesized in Preparation Example 2C-2 (C: 11 mol %, D: 89 mol %) and 0.25 g (1.4 mmol) of 2-aminobenzenesulfonic acid were placed in a 100-ml three-necked flask. 15.0 ml of pyridine were added to the flask, and the mixture was stirred. After that, 0.75 ml (2.8 mmol) of triphenyl phosphite was added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.35 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature) or Fourier transformation-infrared absorption (FT-IR) spectrum (Nicolet AVATAR 360FT-IR). As a result of IR measurement, a peak at 1,695 cm$^{-1}$ derived from a carboxylic acid reduced, and a peak derived from an amide group was newly observed at 1,658 cm$^{-1}$.

$^1$H-NMR confirmed that the resultant polymer was a polyhydroxyalkanoate containing a unit represented by the following chemical formula (111) as a monomer unit because a peak derived from an aromatic ring of the 2-aminobenzenesulfonic acid structure shifted.

(111)

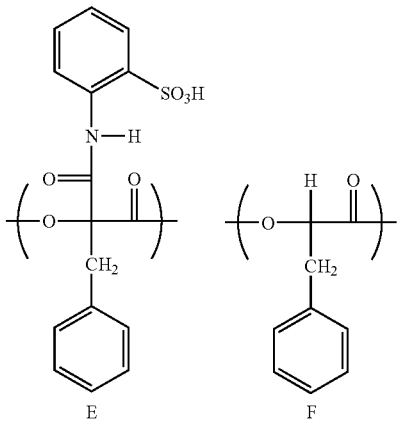

It was also confirmed that the polyhydroxyalkanoate was a copolymer in which an E unit accounted for 11 mol % of the unit of the polyhydroxyalkanoate represented by the chemical formula (111). The resultant polymer was evaluated for average molecular weight by means of gel permeation chromatography (GPC; Tosoh Corporation HLC-8120, column; Polymer Laboratories PLgel 5 μ MIXED-C, solvent; DMF/LiBr 0.1% (w/v), in terms of polystyrene). As a result, the resultant polymer was found to have a number average molecular weight Mn of 20,500 and a weight average molecular weight Mw of 30,800.

Preparation Example 2C-4

0.30 g of the polyhydroxyalkanoate copolymer composed of the unit represented by the chemical formula (111) synthesized in Preparation Example 2C-3 was added to a round-bottomed flask. Then, 21.0 ml of chloroform and 7.0 ml of methanol were added to dissolve the polymer, and the solution was cooled to 0° C. 0.78 ml of a 2 mol/L hexane solution of trimethylsilyldiazomethane (manufactured by Aldrich) was added to the solution, and the whole was stirred for 4 hours. After the completion of the reaction, the solvent was distilled off by using an evaporator, and then the polymer was collected. Furthermore, 21.0 ml of chloroform and 7.0 ml of methanol were added to dissolve the polymer again. Then, the solvent was distilled off by using an evaporator. This operation was repeated 3 times. The collected polymer was dried under reduced pressure to prepare 0.30 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature). $^1$H-NMR confirmed that the resultant polymer was a polyhydroxyalkanoate containing a unit represented by the following chemical formula (112) as a monomer unit because a peak derived from methyl sulfonate was observed at 3 to 4 ppm.

(112)

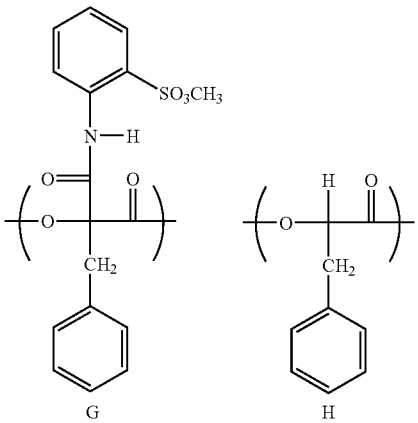

It was also confirmed that a G unit accounted for 11 mol % of the unit of the polyhydroxyalkanoate represented by the chemical formula (112).

Also an acid value titration utilizing a potentiometric titration apparatus AT510 (manufactured by KYOTO ELECTRONICS MANUFACTURING CO., LTD; trade name) did not show a peak attributable to a sulfonic acid, thus clarifying that the sulfonic acid was converted to methyl sulfonate. The resultant polymer was evaluated for average molecular weight by means of gel permeation chromatography (GPC; Tosoh Corporation HLC-8120, column; Polymer Laboratories PLgel 5μ MIXED-C, solvent; DMF/LiBr 0.1% (w/v), in terms of polystyrene). As a result, the resultant polymer was found to have a number average molecular weight Mn of 20,000 and a weight average molecular weight Mw of 30,400.

The scales of these procedures were increased to produce a large amount of polyhydroxyalkanoate containing units represented by the formula (112).

The compound was provided as Exemplified Compound PHA (2C).

Preparation Example 2D-1

8.02 g of a polymer were prepared by using the polyhydroxyalkanoate composed of the unit represented by the chemical formula (108) synthesized in Preparation Example 2C-1 in the same manner as in Preparation Example 2C-2 except that 14.41 g (130.5 mmol) of ethyl 5-bromovalerate were used instead of benzyl chloroformate. The resultant polymer was subjected to NMR analysis under the same conditions as those of Preparation Example 2C-1. The analysis confirmed that the polymer was a polyhydroxyalkanoate containing a unit represented by the following chemical formula (113). The analysis also confirmed that an A unit accounted for 8 mol % of the monomer unit and a B unit accounted for 92 mol % thereof.

(113)

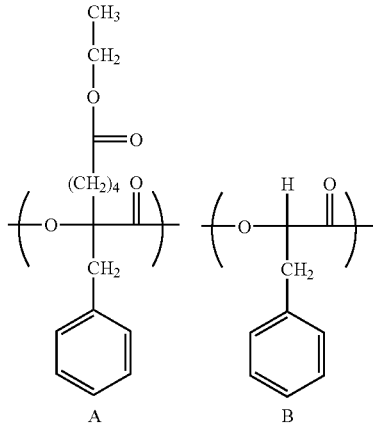

The average molecular weight of the resultant polyhydroxyalkanoate was measured under the same conditions as those of Preparation Example 2C-1. As a result, the resultant polyhydroxyalkanoate was found to have a number average molecular weight Mn of 28,500 and a weight average molecular weight Mw of 39,600.

The above polymer was subjected to hydrogenolysis in the same manner as in Preparation Example 2C-2 to prepare 3.94 g of a polymer. The resultant polymer was subjected to NMR analysis under the same conditions as those of Preparation Example 2C-1. The analysis confirmed that the polymer was a polyhydroxyalkanoate copolymer containing a unit represented by the following chemical formula (114) as a monomer unit. The analysis also confirmed that a C unit accounted for 8 mol % of the monomer unit and a D unit accounted for 92 mol % thereof.

(114)

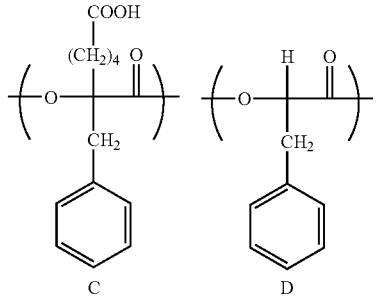

The average molecular weight of the resultant polyhydroxyalkanoate was measured under the same conditions as those of Preparation Example 2C-1. As a result, the resultant polyhydroxyalkanoate was found to have a number average molecular weight Mn of 24,900 and a weight average molecular weight Mw of 35,400.

Preparation Example 2D-2

Under a nitrogen atmosphere, 0.40 g of the polyhydroxyalkanoate copolymer composed of the unit represented by the chemical formula (114) synthesized in Preparation Example 2D-1 (C: 8 mol %, D: 92 mol %) and 0.13 g (1.0 mmol) of taurine were placed in a 100-ml three-necked flask. 15.0 ml of pyridine were added to the flask, and the mixture was stirred. After that, 0.53 ml (2.0 mmol) of triphenyl phosphite was added. After that, 0.31 g of a polymer was prepared in the same manner as in Preparation Example A-3. The resultant polymer was subjected to NMR analysis and Fourier transformation-infrared absorption spectral analysis under the same conditions as those of Preparation Example A-3. As a result, it was confirmed that the resultant polymer was a polyhydroxyalkanoate containing a unit represented by the following chemical formula (115), and that the polyhydroxyalkanoate was a copolymer in which an E unit accounted for 6 mol % of the unit.

(115)

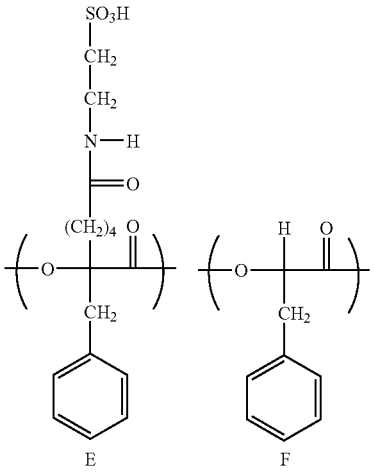

The average molecular weight of the resultant polymer was measured under the same conditions as those of Preparation Example A-3. As a result, the resultant polymer was found to have a number average molecular weight Mn of 19,800 and a weight average molecular weight Mw of 31,700.

The scales of these procedures were increased to produce a large amount of polyhydroxyalkanoate containing units represented by the formula (115). The compound was provided as Exemplified Compound PHA (2D).

Preparation Example 2E-1

[Synthesis of Polyester Using L-lactide]

14.41 g (100.0 mmol) of L-lactide, 4.0 ml of a solution of 0.1 M of tin octylate(tin 2-ethylhexanoate) in toluene, and 4.0 ml of a solution of 0.1 M of p-tert-butylbenzyl alcohol in toluene were placed in a polymerization ampule, and the whole was dried under reduced pressure for 1 hour and replaced with nitrogen. After that, the ampule was heat-sealed under reduced pressure and heated to 160° C. to perform ring-opening polymerization. 10 hours after that, the reaction was terminated, and the ampule was cooled. The resultant polymer was dissolved into chloroform, and reprecipitated in methanol in an amount 10 times that of chloroform necessary for the dissolution. The precipitate was collected and dried under reduced pressure to prepare 12.68 g of a polymer. NMR analysis was performed under the same conditions as those of Preparation Example 2C-1 to determine the structure of the resultant compound. The analysis confirmed that the compound was a polyhydroxyalkanoate containing a unit represented by the following chemical formula (116).

(116)

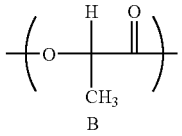

The average molecular weight of the resultant polyhydroxyalkanoate was measured under the same conditions as those of Preparation Example 2C-1. As a result, the resultant polyhydroxyalkanoate was found to have a number average molecular weight Mn of 42,800 and a weight average molecular weight Mw of 59,100.

Preparation Example 2E-2

10.00 g of the polyhydroxyalkanoate composed of the unit represented by the chemical formula (116) synthesized in Preparation Example 2E-1 were placed in a round-bottomed flask, and 500 ml of THF were added to dissolve this. The flask was placed under a nitrogen atmosphere, and the solution was stirred at −78° C. Next, 69.38 ml (138.8 mmol) of a solution of 2 M of lithium diisopropylamide in THF were gradually added to the flask, and the whole was stirred at −78° C. for 30 minutes. Next, 23.81 g (277.5 mmol) of benzyl chloroformate were added to the flask. After that, 9.55 g of a polymer were prepared in the same 20; manner as in Preparation Example 2C-2. The resultant polymer was subjected to NMR analysis under the same conditions as those of Preparation Example 2C-1. The analysis confirmed that the polymer was a polyhydroxyalkanoate containing a unit represented by the following chemical formula (117). The analysis also confirmed that an A unit accounted for 12 mol % of the monomer unit and a B unit accounted for 88 mol % thereof.

(117)

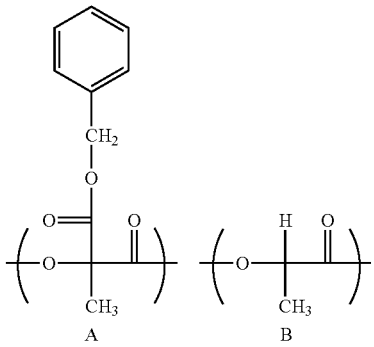

The average molecular weight of the resultant polyhydroxyalkanoate was measured under the same conditions as those of Preparation Example 2C-1. As a result, the resultant polyhydroxyalkanoate was found to have a number average molecular weight Mn of 32,100 and a weight average molecular weight Mw of 46,500.

The above polymer was subjected to hydrogenolysis in the same manner as in Preparation Example 2C-2 to prepare 3.47 g of a polymer. The resultant polymer was subjected to NMR analysis under the same conditions as those of Preparation Example 2C-1. The analysis confirmed that the polymer was a polyhydroxyalkanoate copolymer containing a unit represented by the following chemical formula (118) as a monomer unit. The analysis also confirmed that a C unit accounted for 12 mol % of the monomer unit and a D unit accounted for 88 mol % thereof.

(118)

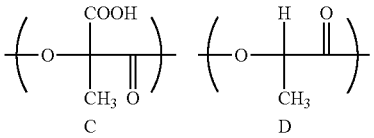

The average molecular weight of the resultant polyhydroxyalkanoate was measured under the same conditions as those of Preparation Example 2C-1. As a result, the resultant polyhydroxyalkanoate was found to have a number average molecular weight Mn of 30,100 and a weight average molecular weight Mw of 45,200.

Preparation Example 2E-3

Under a nitrogen atmosphere, 0.40 g of the polyhydroxyalkanoate copolymer composed of the unit represented by the chemical formula (118) synthesized in Preparation Example 2E-2 (C: 12 mol %, D: 88 mol %) and 0.69 g (3.1 mmol) of 2-amino-1-naphthalenesulfonic acid were placed in a 100-ml three-necked flask. 15.0 ml of pyridine were added to the flask, and the mixture was stirred. After that, 1.62 ml (6.2 mmol) of triphenyl phosphite were added. After that, 0.37 g of a polymer was prepared in the same manner as in Preparation Example 2C-3. The resultant polymer was subjected to NMR analysis and Fourier transformation-infrared absorption spectral analysis under the same conditions as those of Preparation Example 2C-3. As a result, it was confirmed that the resultant polymer was a polyhydroxyalkanoate containing a unit represented by the following chemical formula (119), and that the polyhydroxyalkanoate was a copolymer in which an E unit accounted for 8 mol % of the unit.

(119)

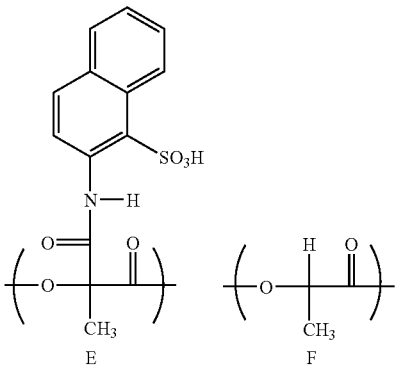

The average molecular weight of the resultant polymer was measured under the same conditions as those of Preparation Example 2C-3. As a result, the resultant polymer was found to have a number average molecular weight Mn of 27,200 and a weight average molecular weight Mw of 43,000.

Preparation Example 2E-4

0.30 g of the polyhydroxyalkanoate copolymer composed of the unit represented by the chemical formula (119) synthesized in Preparation Example 2E-3 was added to a round-bottomed flask. Then, 21.0 ml of chloroform and 7.0 ml of methanol were added to dissolve the polymer, and the solution was cooled to 0° C. 0.90 ml of a 2 mol/L hexane solution of trimethylsilyldiazomethane (manufactured by Aldrich) was added to the solution, and the whole was stirred for 4 hours. After the completion of the reaction, the solvent was distilled off by using an evaporator, and then the polymer was collected. Furthermore, 21.0 ml of chloroform and 7.0 ml of methanol were added to dissolve the polymer again. Then, the solvent was distilled off by using an evaporator. This operation was repeated 3 times. The collected polymer was dried under reduced pressure to prepare 0.30 g of a polymer. The structure of the resultant polymer was determined through analysis according to $^{1}$H-NMR (FT-NMR: Bruker DPX 400; resonance frequency: 400 MHz; measured nuclear species: $^{1}$H; solvent used: deuterized DMSO; measurement temperature: room temperature). $^{1}$H-NMR confirmed that the resultant polymer was a polyhydroxyalkanoate containing a unit represented by the following chemical formula (120) as a monomer unit because a peak derived from methyl sulfonate was observed at 3 to 4 ppm.

(120)

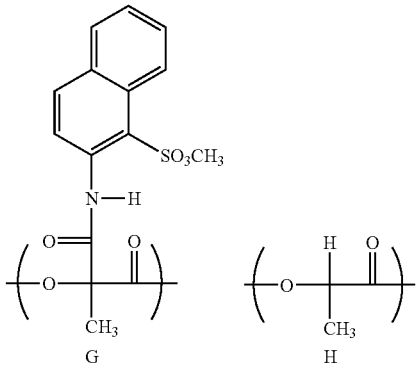

It was also confirmed that a G unit accounted for 8 mol % of the unit of the polyhydroxyalkanoate represented by the chemical formula (120).

Also an acid value titration utilizing a potentiometric titration apparatus AT510 (manufactured by KYOTO ELECTRONICS MANUFACTURING CO., LTD; trade name) did not show a peak attributable to a sulfonic acid, thus clarifying that the sulfonic acid was converted to methyl sulfonate.

The average molecular weight of the resultant polymer was measured under the same conditions as those of Preparation Example 2C-4. As a result, the resultant polymer was found to have a number average molecular weight Mn of 27,000 and a weight average molecular weight Mw of 43,700.

The scales of these procedures were increased to produce a large amount of polyhydroxyalkanoate containing units represented by the formula (120).

The compound was provided as Exemplified Compound PHA (2E).

Preparation Example 2F-1

8.63 g of a polymer were prepared in the same manner as in Preparation Example 2E-2 except that 34.85 g (277.5 mmol) of ethyl 8-bromooctanoate were used instead of benzyl chloroformate. The resultant polymer was subjected to NMR analysis under the same conditions as those of Preparation Example 2C-1. The analysis confirmed that the polymer was a polyhydroxyalkanoate containing a unit represented by the following chemical formula (121). The analysis also confirmed that an A unit accounted for 7 mol % of the monomer unit and a B unit accounted for 93 mol % thereof.

(121)

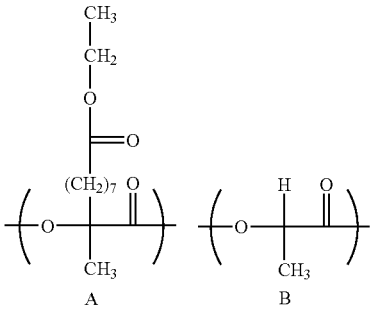

The average molecular weight of the resultant polyhydroxyalkanoate was measured under the same conditions as those of Preparation Example 2C-1. As a result, the resultant polyhydroxyalkanoate was found to have a number average molecular weight Mn of 35,500 and a weight average molecular weight Mw of 52,500.

The above polymer was subjected to hydrogenolysis in the same manner as in Preparation Example 2C-2 to prepare 4.10 g of a polymer. The resultant polymer was subjected to NMR analysis under the same conditions as those of Preparation Example 2C-1. The analysis confirmed that the polymer was a polyhydroxyalkanoate copolymer containing a unit represented by the following chemical formula (122) as a monomer unit. The analysis also confirmed that a C unit accounted for 7 mol % of the monomer unit and a D unit accounted for 93 mol % thereof.

(122)

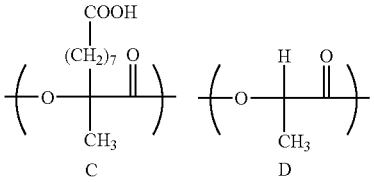

The average molecular weight of the resultant polyhydroxyalkanoate was measured under the same conditions as those of Preparation Example 2C-1. As a result, the resultant polyhydroxyalkanoate was found to have a number average molecular weight Mn of 31,000 and a weight average molecular weight Mw of 48,100.

Preparation Example 2F-2

Under a nitrogen atmosphere, 0.40 g of the polyhydroxyalkanoate copolymer composed of the unit represented by the chemical formula (122) synthesized in Preparation Example 2F-1 (C: 7 mol %, D: 93 mol %) and 0.43 g (1.7 mmol) of phenyl 2-aminobenzene sulfonate were placed in a 100-ml three-necked flask. 15.0 ml of pyridine were added to the flask, and the mixture was stirred. After that, 0.89 ml (3.4 mmol) of triphenyl phosphite was added. After that, 0.39 g of a polymer was prepared in the same manner as in Preparation Example 2C-3. The resultant polymer was subjected to NMR analysis and Fourier transformation-infrared absorption spectral analysis under the same conditions as those of Preparation Example 2C-3. As a result, it was confirmed that the resultant polymer was a polyhydroxyalkanoate containing a unit represented by the following chemical formula (123), and that the polyhydroxyalkanoate was a copolymer in which an E unit accounted for 7 mol % of the unit.

(123)

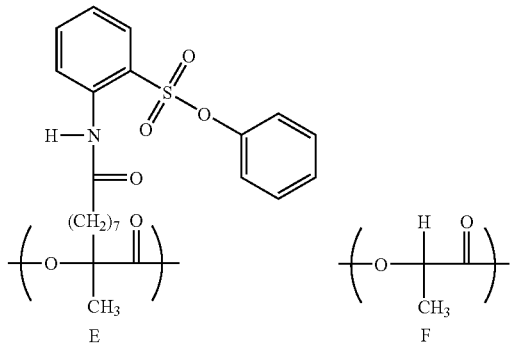

The average molecular weight of the resultant polymer was measured under the same conditions as those of Preparation Example 2C-3. As a result, the resultant polymer was found to have a number average molecular weight Mn of 27,500 and a weight average molecular weight Mw of 44,600.

The scales of these procedures were increased to produce a large amount of polyhydroxyalkanoate containing units represented by the formula (123).

The compound was provided as Exemplified Compound PHA (2F).

Preparation Example 2G-1

[Synthesis of Polyester Using Diisopropyl glycolide(3,6-diisopropyl-1,4-dioxane-2,5-dione)]

14.15 g of a polymer were prepared in the same manner as in Preparation Example 2E-1 except that 22.83 g (100.0 mmol) of diisopropyl glycolide were used instead of L-lactide. The resultant polymer was subjected to NMR analysis under the same conditions as those of Preparation Example 2C-1. The analysis confirmed that the polymer was a polyhydroxyalkanoate containing a unit represented by the following chemical formula (124).

(124)

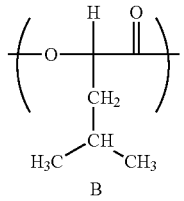

The average molecular weight of the resultant polyhydroxyalkanoate was measured under the same conditions as those of Preparation Example 2C-1. As a result, the resultant polyhydroxyalkanoate was found to have a number average molecular weight Mn of 32,800 and a weight average molecular weight Mw of 48,500.

Preparation Example 2G-2

10.00 g of the polyhydroxyalkanoate composed of the unit represented by the chemical formula (124) synthesized in Preparation Example 2G-1 were placed in a round-bottomed flask, and 500 ml of THF were added to dissolve this. The flask was placed under a nitrogen atmosphere, and the solution was stirred at −78° C. Next, 43.81 ml (87.6 mmol) of a solution of 2 M of lithium diisopropylamide in THF were gradually added to the flask, and the whole was stirred at −78° C. for 30 minutes. Next, 18.32 g (175.2 mmol) of ethyl 5-bromovalerate were added to the flask. After that, 7.64 g of a polymer were prepared in the same manner as in Preparation Example 2C-2. The resultant polymer was subjected to NMR analysis under the same conditions as those of Preparation Example 2C-1. The analysis confirmed that the polymer was a polyhydroxyalkanoate containing a unit represented by the following chemical formula (125). The analysis also confirmed that an A unit accounted for 11 mol % of the monomer unit and a B unit accounted for 89 mol % thereof.

(125)

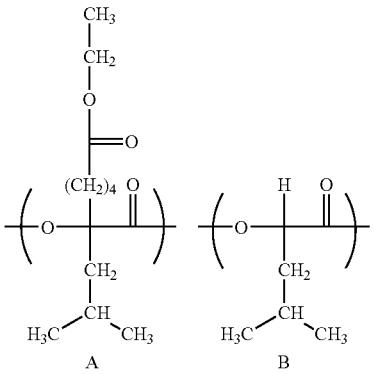

The average molecular weight of the resultant polyhydroxyalkanoate was measured under the same conditions as those of Preparation Example 2C-1. As a result, the resultant polyhydroxyalkanoate was found to have a number average molecular weight Mn of 26,500 and a weight average molecular weight Mw of 41,100.

The above polymer was subjected to hydrogenolysis in the same manner as in Preparation Example 2C-2 to prepare 4.05 g of a polymer. The resultant polymer was subjected to NMR analysis under the same conditions as those of Preparation Example 2C-1. The analysis confirmed that the polymer was a polyhydroxyalkanoate copolymer containing a unit represented by the following chemical formula (126) as a monomer unit. The analysis also confirmed that a C unit accounted for 11 mol % of the monomer unit and a D unit accounted for 89 mol % thereof.

(126)

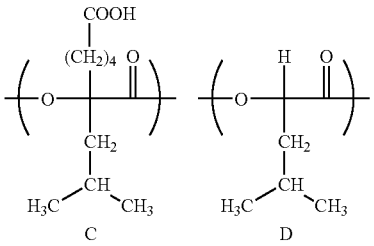

The average molecular weight of the resultant polyhydroxyalkanoate was measured under the same conditions as those of Preparation Example 2C-1. As a result, the resultant polyhydroxyalkanoate was found to have a number average molecular weight Mn of 22,200 and a weight average molecular weight Mw of 33,700.

Preparation Example 2G-3

Under a nitrogen atmosphere, 0.40 g of the polyhydroxyalkanoate copolymer composed of the unit represented by the chemical formula (126) synthesized in Preparation Example 2G-2 (C: 11 mol %, D: 89 mol %) and 0.27 g (1.8 mmol) of 2-amino-2-methylpropanesulfonic acid were placed in a 100-ml three-necked flask. 15.0 ml of pyridine were added to the flask, and the mixture was stirred. After that, 0.92 ml (3.5 mmol) of triphenyl phosphite was added. After that, 0.33 g of a polymer was prepared in the same manner as in Preparation Example 2C-3. The resultant polymer was subjected to NMR analysis and Fourier transformation-infrared absorption spectral analysis under the same conditions as those of Preparation Example 2C-3. As a result, it was confirmed that the resultant polymer was a polyhydroxyalkanoate containing a unit represented by the following chemical formula (127), and that the polyhydroxyalkanoate was a copolymer in which an E unit accounted for 9 mol % of the unit.

(127)

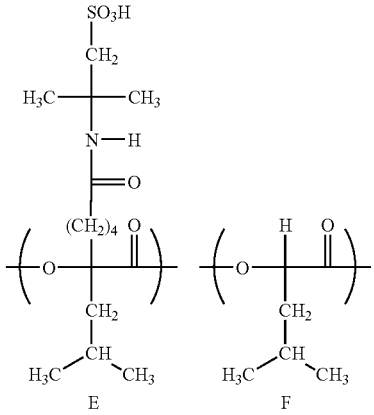

The average molecular weight of the resultant polymer was measured under the same conditions as those of Preparation Example 2C-3. As a result, the resultant polymer was found to have a number average molecular weight Mn of 20,900 and a weight average molecular weight Mw of 35,500.

Preparation Example 2G-4

0.29 g of a polymer was prepared in the same manner as in Preparation Example 2C-4 except that: the polyhydroxyalkanoate represented by the chemical formula (127) synthesized in Preparation Example 2G-3 was used instead of the polyhydroxyalkanoate represented by the chemical formula (111) in Preparation Example 2C-4; and 0.70 ml of a 2 mol/L hexane solution of trimethylsilyldiazomethane (manufactured by Aldrich) was used. The resultant polymer was subjected to NMR analysis under the same conditions as those of Preparation Example 2C-4. The analysis confirmed that the resultant polymer was a polyhydroxyalkanoate containing a unit represented by the following chemical formula (128), and that the polyhydroxyalkanoate was a copolymer in which a G unit accounted for 9 mol % of the unit.

In addition, an acid value titration in the same manner as in Preparation Example 2C-4 revealed that the sulfonic acid was transformed into methyl sulfonate because no peak derived from the sulfonic acid was observed.

(128)

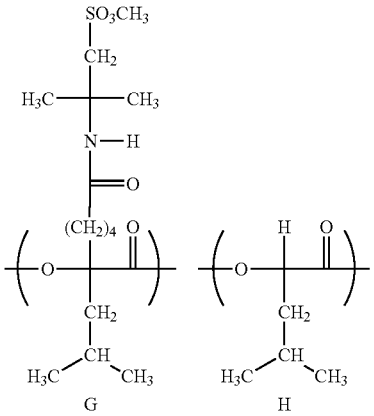

The average molecular weight of the resultant polymer was measured under the same conditions as those of Preparation Example 2C-4. As a result, the resultant polymer was found to have a number average molecular weight Mn of 19,500 and a weight average molecular weight Mw of 33,200.

The scales of these procedures were increased to produce a large amount of polyhydroxyalkanoate containing units represented by the formula (128).

The compound was provided as Exemplified Compound PHA (2G).

Preparation Example 2H-1

[Synthesis of Polyester Using hexylglycolide(3,6-dihexyl-1,4-dioxane-2,5-dione)]

16.66 g of a polymer were prepared in the same manner as in Preparation Example 2E-1 except that 25.63 g (100.0 mmol) of hexylglycolide were used instead of L-lactide. The resultant polymer was subjected to NMR analysis under the same conditions as those of Preparation Example 2C-1. The analysis confirmed that the polymer was a polyhydroxyalkanoate containing a unit represented by the following chemical formula (129).

(129)

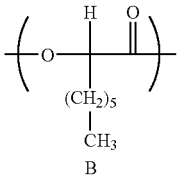

The average molecular weight of the resultant polyhydroxyalkanoate was measured under the same conditions as those of Preparation Example 2C-1. As a result, the resultant polyhydroxyalkanoate was found to have a number average molecular weight Mn of 28,900 and a weight average molecular weight Mw of 42,200.

Preparation Example 2H-2

10.00 g of the polyhydroxyalkanoate composed of the unit represented by the chemical formula (129) synthesized in Preparation Example 2H-1 were placed in a round-bottomed flask, and 500 ml of THF were added to dissolve this. The flask was placed under a nitrogen atmosphere, and the solution was stirred at −78° C. Next, 39.01 ml (78.0 mmol) of a solution of 2 M of lithium diisopropylamide in THF were gradually added to the flask, and the whole was stirred at −78° C. for 30 minutes. Next, 17.95 g (156.0 mmol) of benzyl bromoacetate were added to the flask. After that, 8.40 g of a polymer were prepared in the same manner as in Preparation Example 2C-2. The resultant polymer was subjected to NMR analysis under the same conditions as those of Preparation Example 2C-1. The analysis confirmed that the polymer was a polyhydroxyalkanoate containing a unit represented by the following chemical formula (130). The analysis also confirmed that an A unit accounted for 9 mol % of the monomer unit and a B unit accounted for 91 mol % thereof.

(130)

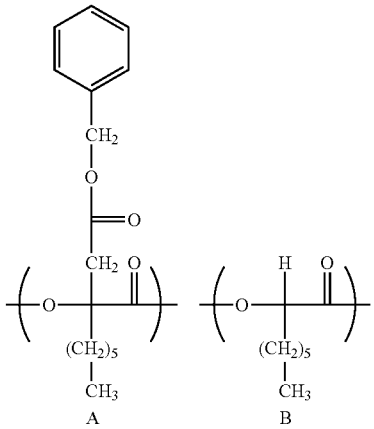

The average molecular weight of the resultant polyhydroxyalkanoate was measured under the same conditions as those of Preparation Example 2C-1. As a result, the resultant polyhydroxyalkanoate was found to have a number average molecular weight Mn of 23,000 and a weight average molecular weight Mw of 34,500.

The above polymer was subjected to hydrogenolysis in the same manner as in Preparation Example 2C-2 to prepare 3.68 g of a polymer. The resultant polymer was subjected to NMR analysis under the same conditions as those of Preparation Example 2C-1. The analysis confirmed that the polymer was a polyhydroxyalkanoate copolymer containing a unit represented by the following chemical formula (131) as a monomer unit. The analysis also confirmed that a C unit accounted for 9 mol % of the monomer unit and a D unit accounted for 91 mol % thereof.

(131)

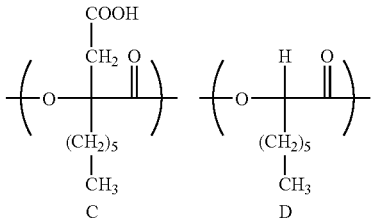

The average molecular weight of the resultant polyhydroxyalkanoate was measured under the same conditions as those of Preparation Example 2C-1. As a result, the resultant polyhydroxyalkanoate was found to have a number average molecular weight Mn of 19,800 and a weight average molecular weight Mw of 30,900.

Preparation Example 2H-3

Under a nitrogen atmosphere, 0.40 g of the polyhydroxyalkanoate copolymer composed of the unit represented by the chemical formula (131) synthesized in Preparation Example 2H-2 (C: 9 mol %, D: 91 mol %) and 0.23 g (1.3 mmol) of 2-aminobenzenesulfonic acid were placed in a 100-ml three-necked flask. 15.0 ml of pyridine were added to the flask, and the mixture was stirred. After that, 0.70 ml (2.6 mmol) of triphenyl phosphite was added. After that, 0.35 g of a polymer was prepared in the same manner as in Preparation Example 2C-3. The resultant polymer was subjected to NMR analysis and Fourier transformation-infrared absorption spectral analysis under the same conditions as those of Preparation Example 2C-3. As a result, it was confirmed that the resultant polymer was a polyhydroxyalkanoate containing a unit represented by the following chemical formula (132), and that the polyhydroxyalkanoate was a copolymer in which an E unit accounted for 8 mol % of the unit.

(132)

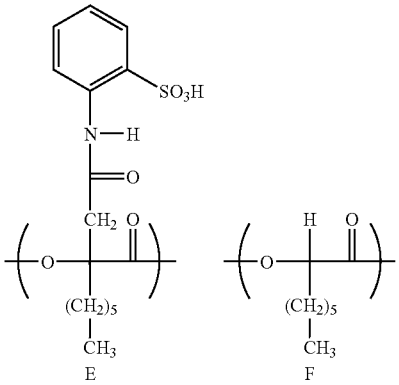

The average molecular weight of the resultant polymer was measured under the same conditions as those of Preparation Example 2C-3. As a result, the resultant polymer was found to have a number average molecular weight Mn of 18,900 and a weight average molecular weight Mw of 30,400.

The scales of these procedures were increased to produce a large amount of polyhydroxyalkanoate containing units represented by the formula (132).

The compound was provided as Exemplified Compound PHA (2H).

Preparation Example 2I-1

2.00 g of the polyhydroxyalkanoate composed of the unit represented by the chemical formula (108) synthesized in Preparation Example 2C-1 were placed in a round-bottomed flask, and 100 ml of THF were added to dissolve this. The flask was placed under a nitrogen atmosphere, and the solution was stirred at −78° C. Next, 18.9 ml of a solution of 2 M of lithium diisopropylamide in THF were gradually added to the flask, and the whole was stirred at −78° C. for 30 minutes. Next, 5.91 g of 2-acrylamide-2-methylpropane methyl sulfonate were added to the flask, and the whole was stirred at room temperature for 30 minutes. After the completion of the reaction, the reaction solution was poured into 400 ml of an aqueous solution of ammonium chloride, and 200 ml of dichloromethane were added to extract the organic layer. The extracted organic layer was washed with 100 ml of water 3 times. After the organic layer had been collected, the solvent was distilled off to collect a crude polymer. Next, the polymer was dissolved into 12 ml of THF, and reprecipitated in methanol in an amount 50 times that of THF necessary for the dissolution. The precipitate was collected and dried under reduced pressure to prepare 1.22 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature). The analysis confirmed that the polymer was a polyhydroxyalkanoate containing a unit represented by the following chemical formula (133) as a monomer unit. The analysis also confirmed that an E unit accounted for 7 mol % of the monomer unit and an F unit accounted for 93 mol % thereof.

(133)

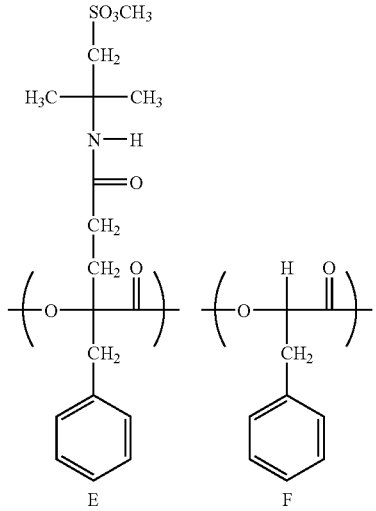

The average molecular weight of the resultant polymer was measured under the same conditions as those of Preparation Example 2C-3. As a result, the resultant polyhydroxyalkanoate was found to have a number average molecular weight Mn of 25,500 and a weight average molecular weight Mw of 38,200.

The scales of these procedures were increased to produce a large amount of polyhydroxyalkanoate containing units represented by the formula (133). The compound was provided as Exemplified Compound PHA (2I).

Preparation Example 2J-1

In this preparation example, a microorganism is used to prepare a polyhydroxyalkanoate. The microorganism used in this preparation example is a *Ralstonia eutropha* TB64 strain (disclosed in Japanese Patent Application Laid-Open No. 2000-166587). The microorganism is deposited in the National Institute of Advanced Industrial Science and Technology, International Patent Organism.

The inorganic salt medium (M9 medium) used in this preparation example has the following composition. M9 medium composition (in 1. L)

| | |
|---|---|
| $Na_2HPO_4$ | 6.2 g |
| $KH_2PO_4$ | 3.0 g |
| NaCl | 0.5 g |
| $NH_4Cl$ | 1.0 g |
| Water (pH 7.0) | Balance |

For better proliferation of a microorganism and better production of a polyhydroxyalkanoate at the time of culture, the above inorganic salt medium is added with about 0.3% (v/v) of a trace component solution shown below.

(Trace Component Solution Composition: Unit g/L) Nitrilotriacetic acid: 1.5; $MgSO_4$: 3.0; $MnSO_4$: 0.5; NaCl: 1.0; $FeSO_4$: 0.1; $CaCl_2$: 0.1; $CoCl_2$: 0.1; $ZnSO_4$: 0.1; $CuSO_4$: 0.1; AlK $(SO_4)_2$: 0.1; $H_3BO_3$: 0.1; $Na_2MoO_4$: 0.1; $NiCl_2$: 0.1

(Synthesis of poly-3-hydroxybutyric acid Represented by Chemical Formula (134))

(134)

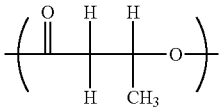

B

Poly-3-hydroxybutyric acid represented by the chemical formula (134) was synthesized by means of the method disclosed in Example 1 of Japanese Patent Application Laid-Open No. 2002-306190.

A colony of a TB 64 strain on an M9 agar medium containing 0.1% of sodium malate was inoculated in 50 ml of an M9 medium containing 0.5% of sodium malate in a 500-mL shaking flask, and the whole was shake cultured at 30° C. 24 hours after that, 5 ml of the culture solution were added to 1 L of a production medium prepared by incorporating 0.5% of sodium malate into an M9 medium with the concentration of $NH_4Cl$ as a nitrogen source reduced to 1/10, and the whole was shaken in the same manner to accumulate PHB in cells. 48 hours after that, the PHB-accumulated cells were recovered by centrifugal separation, washed with methanol, and then freeze-dried. After the dried cells had been weighed, chloroform was added, and the whole was stirred at 60° C. for 24 hours to extract a polymer. After filtrating the extracted chloroform solution through a filter, it was concentrated by means of an evaporator. After that, a portion precipitated and solidified with cold methanol was collected and dried under reduced pressure to prepare 1.83 g of a polymer per 1 L of the production medium. NMR analysis was performed under the following conditions to determine the structure of the resultant polymer.

<Measuring equipment> FT-NMR: Bruker DPX 400
Resonance frequency: $^1H$=400 MHz
<Measurement conditions> Measured nuclear species: $^1H$
Solvent used: TMS/$CDCl_3$
Measurement temperature: room temperature The analysis confirmed that the resultant polymer was a polyhydroxyalkanoate composed of a unit of 3-hydroxybutyric acid represented by the chemical formula (134). The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 549,500 and a weight average molecular weight Mw of 1,263,900.

45.6 g of the polyhydroxyalkanoate to be used for any subsequent preparation example were prepared from 50 L of the production medium by means of the above method.

Preparation Example 2J-2

10.00 g of the polyhydroxyalkanoate composed of the unit represented by the chemical formula (134) synthesized in Preparation Example 2J-1 were placed in a round-bottomed flask, and 500 ml of THF were added to dissolve this. The flask was placed under a nitrogen atmosphere, and the solution was stirred at −78° C. Next, 58.08 ml (116.2 mmol) of a solution of 2 M of lithium diisopropylamide in THF were gradually added to the flask, and the whole was stirred at −78° C. for 30 minutes. Next, 19.82 g (232.3 mmol) of benzyl chloroformate were added to the flask, and the whole was stirred at room temperature for 30 minutes. After the completion of the reaction, the reaction solution was poured into 1,000 ml of an aqueous solution of ammonium chloride, and 500 ml of dichloromethane were added to extract the organic layer. The extracted organic layer was washed with 250 ml of water 3 times. After the organic layer had been collected, the solvent was distilled off to collect a crude polymer. Next, the polymer was dissolved into 60 ml of THF, and reprecipitated in methanol in an amount 50 times that of THF necessary for the dissolution. The precipitate was collected and dried under reduced pressure to prepare 8.44 g of a polymer. NMR analysis was performed under the same conditions as those of Preparation Example 2J-1 to determine the structure of the resultant polymer. The analysis confirmed that the polymer was a polyhydroxyalkanoate containing a unit represented by the following chemical formula (135) as a monomer unit. The analysis also confirmed that an A unit accounted for 10 mol % of the monomer unit and a B unit accounted for 90 mol % thereof.

(135)

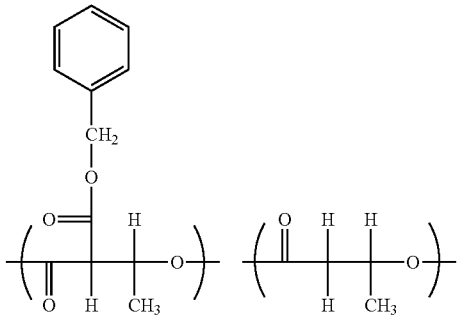

A B

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 325,400 and a weight average molecular weight Mw of 764,700.

5.00 g of the polyhydroxyalkanoate copolymer represented by the chemical formula (135) synthesized here were dissolved into 500 ml of a mixed solvent of dioxane-ethanol (75:25), and 1.10 g of a 5% palladium/carbon catalyst were added to the solution. The inside of the reaction system was filled with hydrogen, and the whole was stirred at room temperature for 1 day. After the completion of the reaction, in order to remove the catalyst, the resultant was filtered through a 0.25-μm membrane filter to collect a reaction solution. After the solution had been concentrated, the concentrate was dissolved into chloroform, and reprecipitated in methanol in an amount 10 times that of chloroform. The resultant polymer was collected and dried under reduced pressure to prepare 3.59 g of a polymer. NMR analysis was performed under the same conditions as those of Preparation Example 2J-1 to determine the structure of the resultant polymer. The analysis confirmed that the polymer was a polyhydroxyalkanoate copolymer containing a unit represented by the following chemical formula (136) as a monomer unit. The analysis also confirmed that a C unit accounted for 10 mol % of the monomer unit and a D unit accounted for 90 mol % thereof.

(136)

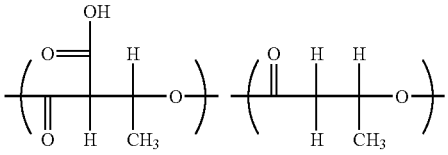

C D

The resultant polyhydroxyalkanoate was evaluated for average molecular weight by means of gel permeation chromatography (GPC; HLC-8220 manufactured by Tosoh Corporation, column; TSK-GEL Super HM-H manufactured by Tosoh Corporation, solvent; chloroform, in terms of polystyrene). As a result, the resultant polyhydroxyalkanoate was found to have a number average molecular weight Mn of 298,000 and a weight average molecular weight Mw of 715,200.

30 mg of the polyhydroxyalkanoate synthesized here were placed in a 100-ml round-bottomed flask. Then, 2.1 ml of chloroform and 0.7 ml of methanol were added to dissolve the polyhydroxyalkanoate. 0.5 ml of a 2 mol/L hexane solution of trimethylsilyldiazomethane was added to the solution, and the whole was stirred at room temperature for 1 hour. After the completion of the reaction, the solvent was distilled off, and then a polymer was collected. The polymer was dried under reduced pressure to prepare 29 mg of a polyhydroxyalkanoate.

The resultant polyhydroxyalkanoate was subjected to NMR analysis in the same manner as in Preparation Example 2J-1. The analysis confirmed that a carboxyl group of the C unit was transformed into methyl carboxylate, and that the resultant polymer can be esterified again.

Preparation Example 2J-3

Under a nitrogen atmosphere, 0.40 g of the polyhydroxyalkanoate copolymer composed of the unit represented by the chemical formula (136) synthesized in Preparation Example 2J-3 (C: 10 mol %, D: 90 mol %) and 0.24 g (1.4 mmol) of 2-aminobenzenesulfonic acid were placed in a 100-ml three-necked flask. 15.0 ml of pyridine were added to the flask, and the mixture was stirred. After that, 0.71 ml (2.7 mmol) of triphenyl phosphite was added, and the whole was heated at 120° C. for 6 hours. After the completion of the reaction, the resultant was reprecipitated in 150 ml of ethanol, followed by collection. The resultant polymer was washed with 1N hydrochloric acid for 1 day, stirred in water for 1 day to wash the polymer, and dried under reduced pressure to prepare 0.35 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature) and Fourier transformation-infrared absorption (FT-IR) spectrum (Nicolet AVATAR 360FT-IR). As a result of IR measurement, a peak at 1,695 cm$^{-1}$ derived from a carboxylic acid reduced, and a peak derived from an amide group was newly observed at 1,658 cm$^{-1}$.

$^1$H-NMR confirmed that the resultant polymer was a polyhydroxyalkanoate containing a unit represented by the following chemical formula (137) as a monomer unit because a peak derived from an aromatic ring of the 2-aminobenzenesulfonic acid structure shifted.

(137)

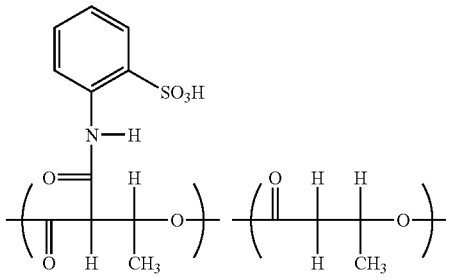

E F

It was also confirmed that the polyhydroxyalkanoate was a copolymer in which an E unit accounted for 10 mol % of the unit of the polyhydroxyalkanoate represented by the chemical formula (137). The resultant polymer was evaluated for average molecular weight by means of gel permeation chromatography (GPC; Tosoh Corporation HLC-8120, column; Polymer Laboratories PLgel 5μ MIXED-C, solvent; DMF/LiBr 0.1% (w/v), in terms of polystyrene). As a result, the resultant polymer was found to have a number average molecular weight Mn of 226,000 and a weight average molecular weight Mw of 497,200.

Preparation Example 2J-4

0.30 g of the polyhydroxyalkanoate copolymer composed of the unit represented by the chemical formula (137) synthesized in Preparation Example 2J-3 was added to a round-bottomed flask. Then, 21.0 ml of chloroform and 7.0 ml of methanol were added to dissolve the polymer, and the solution was cooled to 0° C. 0.93 ml of a 2 mol/L hexane solution of trimethylsilyldiazomethane (manufactured by Aldrich) was added to the solution, and the whole was stirred for 4 hours. After the completion of the reaction, the solvent was distilled off by using an evaporator, and then the polymer was collected. Furthermore, 21.0 ml of chloroform and 7.0 ml of methanol were added to dissolve the polymer again. Then, the solvent was distilled off by using an evaporator. This operation was repeated 3 times. The collected polymer was dried under reduced pressure to prepare 0.30 g of a polymer. The structure of the resultant polymer was determined through analysis according to $^1$H-NMR (FT-NMR: Bruker DPX 400; resonance frequency: 400 MHz; measured nuclear species: $^1$H; solvent used: deuterized DMSO; measurement temperature: room temperature). $^1$H-NMR confirmed that the resultant polymer was a polyhydroxyalkanoate containing a unit represented by the following chemical formula (138) as a monomer unit because a peak derived from methyl sulfonate was observed at 3 to 4 ppm.

(138)

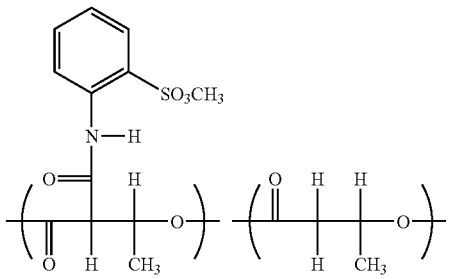

G H

It was also confirmed that a G unit accounted for 10 mol % of the unit of the polyhydroxyalkanoate represented by the chemical formula (138).

Also an acid value titration utilizing a potentiometric titration apparatus AT510 (manufactured by KYOTO ELECTRONICS MANUFACTURING CO., LTD; trade name) did not show a peak attributable to a sulfonic acid, thus clarifying that the sulfonic acid was converted to methyl sulfonate.

The resultant polymer was evaluated for average molecular weight by means of gel permeation chromatography (GPC; Tosoh Corporation HLC-8120, column; Polymer Laboratories PLgel 5 μ MIXED-C, solvent; DMF/LiBr 0.1% (w/v), in terms of polystyrene). As a result, the resultant polymer was found to have a number average molecular weight Mn of 228,000 and a weight average molecular weight Mw of 513,000.

The scales of these procedures were increased to produce a large amount of polyhydroxyalkanoate containing units represented by the formula (138).

The compound was provided as Exemplified Compound PHA (2J).

Preparation Example 2K-1

9.40 g of a polymer were prepared in the same manner as in Preparation Example 2J-2 except that 26.61 g (232.3 mmol) of benzyl bromoacetate were used instead of benzyl chloroformate. The resultant polymer was subjected to NMR analysis under the same conditions as those of Preparation Example 2J-1. The analysis confirmed that the polymer was a polyhydroxyalkanoate containing a unit represented by the following chemical formula (139). The analysis also confirmed that an A unit accounted for 11 mol % of the monomer unit and a B unit accounted for 89 mol % thereof.

(139)

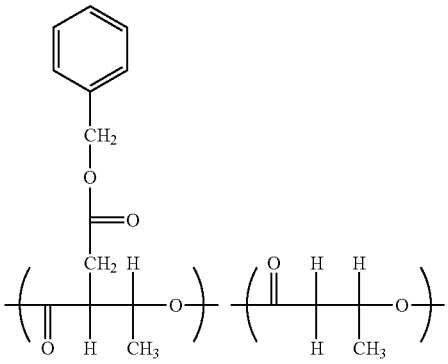

The average molecular weight of the resultant polyhydroxyalkanoate was measured under the same conditions as those of Preparation Example 2J-1. As a result, the resultant polyhydroxyalkanoate was found to have a number average molecular weight Mn of 300,300 and a weight average molecular weight Mw of 723,700.

The above polymer was subjected to hydrogenolysis in the same manner as in Preparation Example 2J-2 to prepare 3.66 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (140) as a monomer unit. The analysis also confirmed that a C unit accounted for 11 mol % of the monomer unit and a D unit accounted for 89 mol % thereof.

(140)

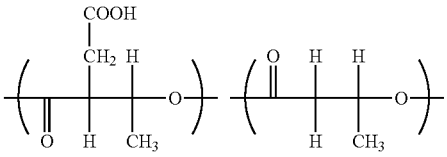

The average molecular weight of the resultant polyhydroxyalkanoate was measured under the same conditions as those of Preparation Example 2J-1. As a result, the resultant polyhydroxyalkanoate was found to have a number average molecular weight Mn of 286,000 and a weight average molecular weight Mw of 700,700.

Preparation Example 2K-2

Under a nitrogen atmosphere, 0.40 g of the polyhydroxyalkanoate copolymer composed of the unit represented by the chemical formula (140) synthesized in Preparation Example 2K-1 (C: 11 mol %, D: 89 mol %) and 0.23 g (1.5 mmol) of 2-amino-2-methylpropanesulfonic acid were placed in a 100-ml three-necked flask. 15.0 ml of pyridine were added to the flask, and the mixture was stirred. After that, 0.78 ml (3.0 mmol) of triphenyl phosphite was added. After that, 0.31 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (141), and that the polyhydroxyalkanoate was a copolymer in which an E unit accounted for 9 mol % of the unit.

(141)

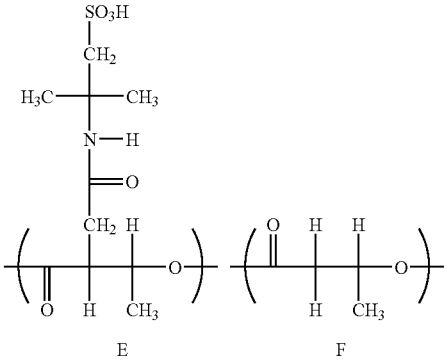

The average molecular weight of the resultant polymer was measured under the same conditions as those of Preparation Example 2J-3. As a result, the resultant polymer was found to have a number average molecular weight Mn of 225,000 and a weight average molecular weight Mw of 540,000.

Preparation Example 2K-3

0.29 g of a polymer was prepared in the same manner as in Preparation Example 2J-4 except that: the polyhydroxyalkanoate represented by the chemical formula (141) synthesized in Preparation Example 2K-2 was used instead of the polyhydroxyalkanoate represented by the chemical formula (137) in Preparation Example 2J-4; and 0.83 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (142), and that the polyhydroxyalkanoate was a copolymer in which a G unit accounted for 9 mol % of the unit.

In addition, an acid value titration in the same manner as in Preparation Example 2J-4 revealed that the sulfonic acid was transformed into methyl sulfonate because no peak derived from the sulfonic acid was observed.

(142)

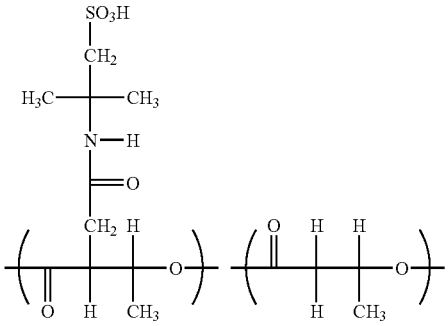

G H

The average molecular weight of the resultant polymer was measured under the same conditions as those of Preparation Example 2J-4. As a result, the resultant polymer was found to have a number average molecular weight Mn of 228,500 and a weight average molecular weight Mw of 548,400.

The scales of these procedures were increased to produce a large amount of polyhydroxyalkanoate containing units represented by the formula (142).

The compound was provided as Exemplified Compound PHA (2K).

Preparation Example 2L-1

8.83 g of a polymer were prepared in the same manner as in Preparation Example 2J-2 except that 29.17 g (232.3 mmol) of ethyl 8-bromooctanoate were used instead of benzyl chloroformate. The resultant polymer was subjected to NMR analysis under the same conditions as those of Preparation Example 2J-1. The analysis confirmed that the polymer was a polyhydroxyalkanoate containing a unit represented by the following chemical formula (143). The analysis also confirmed that an A unit accounted for 9 mol % of the monomer unit and a B unit accounted for 91 mol % thereof.

(143)

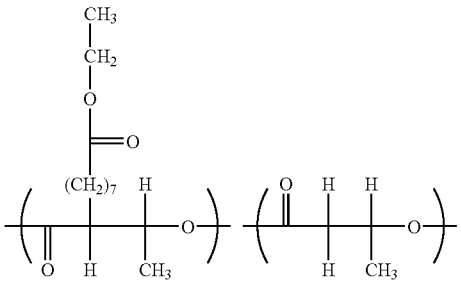

A B

The average molecular weight of the resultant polyhydroxyalkanoate was measured under the same conditions as those of Preparation Example 2J-1. As a result, the resultant polyhydroxyalkanoate was found to have a number average molecular weight Mn of 321,000 and a weight average molecular weight Mw of 776,800.

The above polymer was subjected to hydrogenolysis in the same manner as in Preparation Example 2J-2 to prepare 3.85 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (144) as a monomer unit. The analysis also confirmed that a C unit accounted for 9 mol % of the monomer unit and a D unit accounted for 91 mol % thereof.

(144)

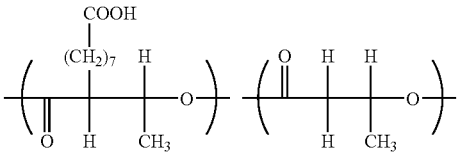

C D

The average molecular weight of the resultant polyhydroxyalkanoate was measured under the same conditions as those of Preparation Example 2J-1. As a result, the resultant polyhydroxyalkanoate was found to have a number average molecular weight Mn of 298,100 and a weight average molecular weight Mw of 715,400.

Preparation Example 2L-2

Under a nitrogen atmosphere, 0.40 g of the polyhydroxyalkanoate copolymer composed of the unit represented by the chemical formula (144) synthesized in Preparation Example 2L-1 (C: 9 mol %, D: 91 mol %) and 0.22 g (1.2 mmol) of p-toluidine-2-sulfonic acid were placed in a 100-ml three-necked flask. 15.0 ml of pyridine were added to the flask, and the mixture was stirred. After that, 0.60 ml (2.3 mmol) of triphenyl phosphite was added. After that, 0.32 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (145), and that the polyhydroxyalkanoate was a copolymer in which an E unit accounted for 8 mol % of the unit.

(145)

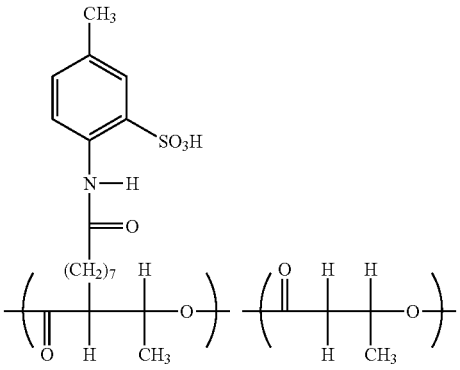

E F

The average molecular weight of the resultant polymer was measured under the same conditions as those of Preparation Example 2J-3. As a result, the resultant polymer was found to have a number average molecular weight Mn of 215,500 and a weight average molecular weight Mw of 538,800.

Preparation Example 2L-3

0.30 g of a polymer was prepared in the same manner as in Preparation Example 2J-4 except that: the polyhydroxyalkanoate represented by the chemical formula (145) synthesized in Preparation Example 2L-2 was used instead of the polyhydroxyalkanoate represented by the chemical formula (137) synthesized in Preparation Example 2J-4; and 0.71 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (146), and that the polyhydroxyalkanoate was a copolymer in which a G unit accounted for 8 mol % of the unit.

In addition, an acid value titration in the same manner as in Preparation Example 2J-4 revealed that the sulfonic acid was transformed into methyl sulfonate because no peak derived from the sulfonic acid was observed.

(146)

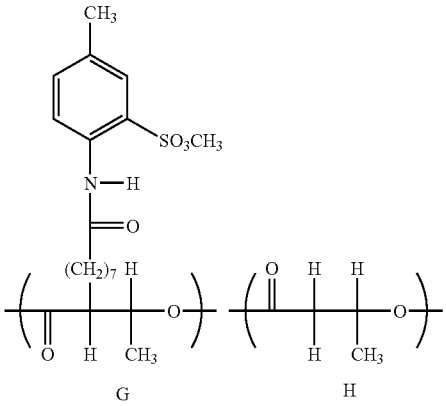

The average molecular weight of the resultant polymer was measured under the same conditions as those of Preparation Example 2J-4. As a result, the resultant polymer was found to have a number average molecular weight Mn of 218,000 and a weight average molecular weight Mw of 555,900.

The scales of these procedures were increased to produce a large amount of polyhydroxyalkanoate containing units represented by the formula (146). The compound was provided as Exemplified Compound PHA (2L).

Preparation Example 2M-1

In this preparation example, a microorganism is used to prepare a polyhydroxyalkanoate. The microorganism used in this preparation example is a *Pseudomonas cichorii* YN2 strain (FERM BP-7375, disclosed in Japanese Patent Application Laid-Open No. 2001-288256). The microorganism is deposited in the National Institute of Advanced Industrial Science and Technology, International Patent Organism.

The inorganic salt medium (M9 medium) and the trace component solution used in this preparation example have the same compositions as those used in Preparation Example 2J-1.

(Synthesis of poly-3-hydroxy-5-phenylvaleric acid Represented by Chemical Formula (147))

(147)

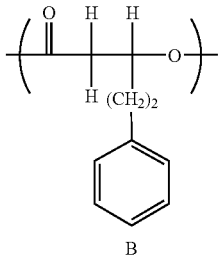

Poly-3-hydroxy-5-phenylvaleric acid represented by the chemical formula (147) was synthesized by means of the method disclosed in Example 1 of Japanese Patent Application Laid-Open No. 2003-319792.

200 mL of an M9 medium containing 0.5% (weight/volume (w/v)) of polypeptone (Wako Pure Chemical Industries, Ltd.) and 0.1% (w/v) of 5-phenylvaleric acid were prepared as a production medium. 1 mL of a culture solution prepared in advance by shake culturing a *Pseudomonas cichorii* YN2 strain in an M9 medium containing 0.5% of polypeptone at 30° C. for 8 hours was added to the production medium, and the whole was cultured in a 500-mL shaking flask at 30° C. for 24 hours. After the culture, cells were recovered by centrifugal separation, washed with methanol, and then freeze-dried. After the dried cells had been weighed, chloroform was added, and the whole was stirred at 50° C. for 24 hours to extract a polymer. After filtrating the extracted chloroform solution through a filter, it was concentrated by means of an evaporator. After that, a portion precipitated and solidified with cold methanol was collected and dried under reduced pressure to prepare 0.60 g of a polymer per 1 L of the production medium. NMR analysis was performed under the same conditions as those of Preparation Example 2J-1 to determine the structure of the resultant polymer. The analysis confirmed that the resultant polymer was substantially a homopolymer of a unit of poly-3-hydroxy-5-phenylvaleric acid represented by the chemical formula (147) as a monomer unit. The average molecular weight of the resultant polyhydroxyalkanoate was measured under the same conditions as those of Preparation Example 2J-1. As a result, the resultant polyhydroxyalkanoate was found to have a number average molecular weight Mn of 91,000 and a weight average molecular weight Mw of 172,900.

60.1 g of the polyhydroxyalkanoate to be used for any subsequent preparation example were prepared from 100 L of the production medium by means of the above method.

Preparation Example 2M-2

8.51 g of a polymer were prepared in the same manner as in Preparation Example 2J-2 except that 10.00 g of the polyhydroxyalkanoate composed of the unit represented by the chemical formula (147) synthesized in Preparation Example 2M-1 were used instead of the polyhydroxyalkanoate composed of the unit represented by the chemical formula (134) in Preparation Example 2J-2, and 28.38 ml (56.8 mmol) of a solution of 2 M of lithium diisopropylamide in THF and 9.68 g (113.5 mmol) of benzyl chloroformate were used. The resultant polymer was subjected to NMR analysis under the same conditions as those of Preparation Example 2J-1. The analysis confirmed that the polymer was a polyhydroxyalkanoate containing a unit represented by the following chemical formula (148). The analysis also confirmed that an A unit accounted for 12 mol % of the monomer unit and a B unit accounted for 88 mol % thereof.

(148)

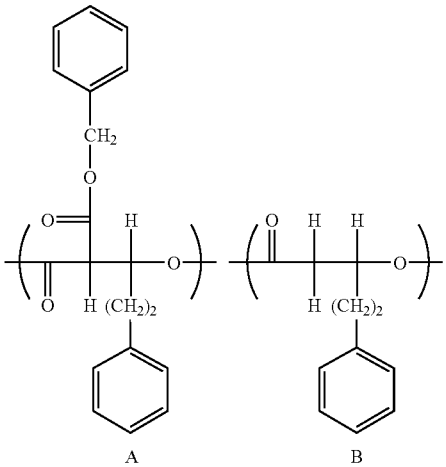

The average molecular weight of the resultant polyhydroxyalkanoate was measured under the same conditions as those of Preparation Example 2J-1. As a result, the resultant polyhydroxyalkanoate was found to have a number average molecular weight Mn of 72,500 and a weight average molecular weight Mw of 141,400.

The above polymer was subjected to hydrogenolysis in the same manner as in Preparation Example 2J-2 to prepare 3.72 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (149) as a monomer unit. The analysis also confirmed that a C unit accounted for 12 mol % of the monomer unit and a D unit accounted for 88 mol % thereof.

(149)

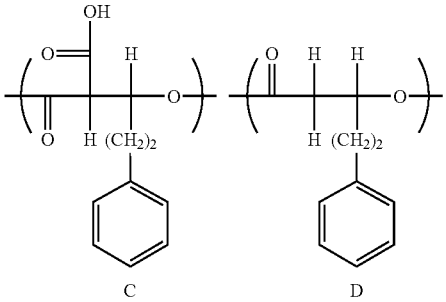

The average molecular weight of the resultant polyhydroxyalkanoate was measured under the same conditions as those of Preparation Example 2J-1. As a result, the resultant polyhydroxyalkanoate was found to have a number average molecular weight Mn of 69,500 and a weight average molecular weight Mw of 139,700.

Preparation Example 2M-3

Under a nitrogen atmosphere, 0.40 g of the polyhydroxyalkanoate copolymer composed of the unit represented by the chemical formula (149) synthesized in Preparation Example 2M-2 (C: 12 mol %, D: 88 mol %) and 0.23 g (1.3 mmol) of 2-aminobenzenesulfonic acid were placed in a 100-ml three-necked flask. 15.0 ml of pyridine were added to the flask, and the mixture was stirred. After that, 0.69 ml (2.6 mmol) of triphenyl phosphite was added. After that, 0.33 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (150), and that the polyhydroxyalkanoate was a copolymer in which an E unit accounted for 11 mol % of the unit.

(150)

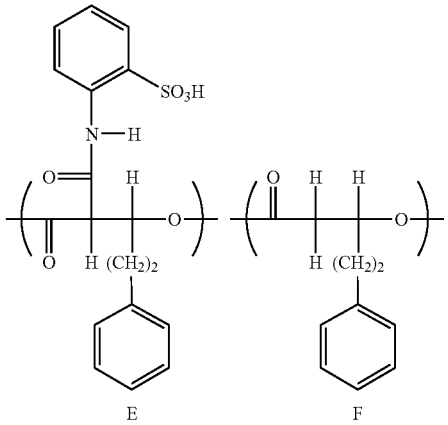

The average molecular weight of the resultant polymer was measured under the same conditions as those of Preparation Example 2J-3. As a result, the resultant polymer was found to have a number average molecular weight Mn of 55,300 and a weight average molecular weight Mw of 113,400.

Preparation Example 2M-4

0.29 g of a polymer was prepared in the same manner as in Preparation Example 2J-4 except that: the polyhydroxyalkanoate represented by the chemical formula (150) synthesized in Preparation Example 2M-3 was used instead of the polyhydroxyalkanoate represented by the chemical formula (137) in Preparation Example 2J-4; and 0.83 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (151), and that the polyhydroxyalkanoate was a copolymer in which a G unit accounted for 11 mol % of the unit.

In addition, an acid value titration in the same manner as in Preparation Example 2J-4 revealed that the sulfonic acid was transformed into methyl sulfonate because no peak derived from the sulfonic acid was observed.

(151)

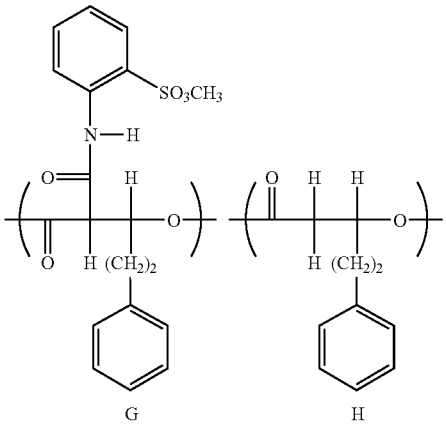

The average molecular weight of the resultant polymer was measured under the same conditions as those of Preparation Example 2J-4. As a result, the resultant polymer was found to have a number average molecular weight Mn of 54,500 and a weight average molecular weight Mw of 114,500.

The scales of these procedures were increased to produce a large amount of polyhydroxyalkanoate containing units represented by the formula (151).

The compound was provided as Exemplified Compound PHA (2M).

Preparation Example 2N-1

7.87 g of a polymer were prepared in the same manner as in Preparation Example 2M-2 except that 12.86 g (113.5 mmol) of ethyl 6-bromohexanoate were used instead of benzyl chloroformate. The resultant polymer was subjected to NMR analysis under the same conditions as those of Preparation Example 2J-1. The analysis confirmed that the polymer was a polyhydroxyalkanoate containing a unit represented by the following chemical formula (152). The analysis also confirmed that an A unit accounted for 8 mol % of the monomer unit and a B unit accounted for 92 mol % thereof.

(152)

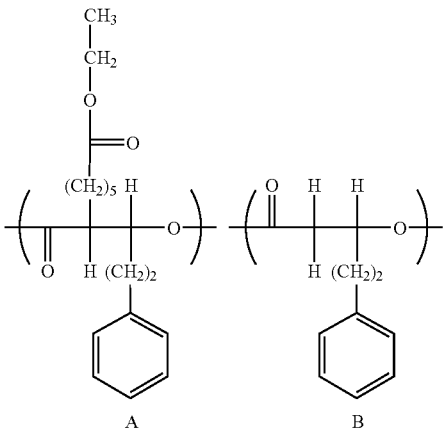

The average molecular weight of the resultant polyhydroxyalkanoate was measured under the same conditions as those of Preparation Example 2J-1. As a result, the resultant polyhydroxyalkanoate was found to have a number average molecular weight Mn of 71,000 and a weight average molecular weight Mw of 134,900.

The above polymer was subjected to hydrogenolysis in the same manner as in Preparation Example 2J-2 to prepare 3.95 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (153) as a monomer unit. The analysis also confirmed that a C unit accounted for 8 mol % of the monomer unit and a D unit accounted for 92 mol % thereof.

(153)

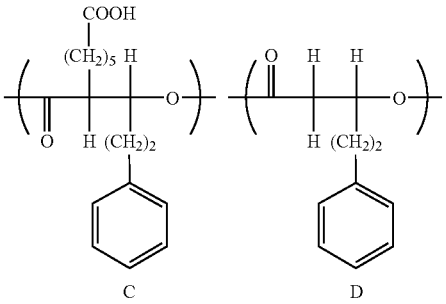

The average molecular weight of the resultant polyhydroxyalkanoate was measured under the same conditions as those of Preparation Example 2J-1. As a result, the resultant polyhydroxyalkanoate was found to have a number average molecular weight Mn of 68,500 and a weight average molecular weight Mw of 133,600.

Preparation Example 2N-2

Under a nitrogen atmosphere, 0.40 g of the polyhydroxyalkanoate copolymer composed of the unit represented by the chemical formula (153) synthesized in Preparation Example 2N-1 (C: 8 mol %, D: 92 mol %) and 0.15 g (0.9 mmol) of 2-aminobenzenesulfonic acid were placed in a 100-ml three-necked flask. 15.0 ml of pyridine were added to the flask, and the mixture was stirred. After that, 0.45 ml (1.7 mmol) of triphenyl phosphite was added. After that, 0.34 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (154), and that the polyhydroxyalkanoate was a copolymer in which an E unit accounted for 7 mol % of the unit.

(154)

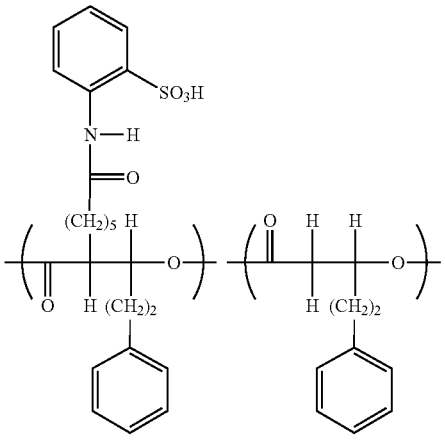

E F

The average molecular weight of the resultant polymer was measured under the same conditions as those of Preparation Example 2J-3. As a result, the resultant polymer was found to have a number average molecular weight Mn of 54,200 and a weight average molecular weight Mw of 108,400.

Preparation Example 2N-3

0.30 g of a polymer was prepared in the same manner as in Preparation Example 2J-4 except that: the polyhydroxyalkanoate represented by the chemical formula (154) synthesized in Preparation Example 2N-2 was used instead of the polyhydroxyalkanoate represented by the chemical formula (137) in Preparation Example 2J-4; and 0.54 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (155), and that the polyhydroxyalkanoate was a copolymer in which a G unit accounted for 7 mol % of the unit.

In addition, an acid value titration in the same manner as in Preparation Example 2J-4 revealed that the sulfonic acid was transformed into methyl sulfonate because no peak derived from the sulfonic acid was observed.

(155)

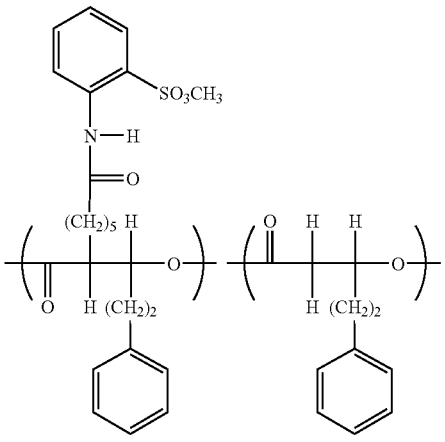

G H

The average molecular weight of the resultant polymer was measured under the same conditions as those of Preparation Example 2J-4. As a result, the resultant polymer was found to have a number average molecular weight Mn of 52,500 and a weight average molecular weight Mw of 110,300.

The scales of these procedures were increased to produce a large amount of polyhydroxyalkanoate containing units represented by the formula (155).

The compound was provided as Exemplified Compound PHA (2N).

Preparation Example 2O-1

(Synthesis of poly-3-hydroxy-5-phenoxyvaleric acid Represented by Chemical Formula (156))

(156)

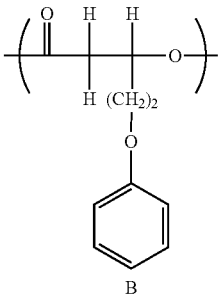

B

Poly-3-hydroxy-5-phenoxyvaleric acid represented by the chemical formula (156) was synthesized by means of the method disclosed in Example 4 of Japanese Patent Application Laid-Open No. 2003-319792.

200 mL of an M9 medium containing 0.5% (w/v) of polypeptone and 0.1% (w/v) of 5-phenoxyvaleric acid were prepared as a production medium. 1 mL of a culture solution prepared in advance by shake culturing a *Pseudomonas cichorii* YN2 strain in an M9 medium containing 0.5% of polypeptone at 30° C. for 8 hours was added to the production medium, and the whole was cultured in a 500-mL shaking flask at 30° C. for 45 hours. After the culture, cells were recovered by centrifugal separation, washed with methanol, and then freeze-dried. After the dried cells had been weighed, chloroform was added, and the whole was stirred at 50° C. for 24 hours to extract a polymer. After filtrating the extracted chloroform solution through a filter, it was concentrated by means of an evaporator. After that, a portion precipitated and solidified with cold methanol was collected and dried under reduced pressure to prepare 0.36 g of a polymer per 1 L of the production medium. NMR analysis was performed under the same conditions as those of Preparation Example 2J-1 to determine the structure of the resultant polymer. The analysis confirmed that the resultant polymer was substantially a homopolymer of a unit of poly-3-hydroxy-5-phenoxyvaleric acid represented by the chemical formula (156) as a monomer unit. The average molecular weight of the resultant polyhydroxyalkanoate was measured under the same conditions as those of Preparation Example 2J-1. As a result, the resultant polyhydroxyalkanoate was found to have a number average molecular weight Mn of 201,000 and a weight average molecular weight Mw of 422,100.

44.8 g of the polyhydroxyalkanoate to be used for any subsequent preparation example were prepared from 125 L of the production medium by means of the above method.

Preparation Example 2O-2

8.29 g of a polymer were prepared in the same manner as in Preparation Example 2J-2 except that 10.00 g of the polyhydroxyalkanoate composed of the unit represented by the chemical formula (156) synthesized in Preparation Example 2O-1 were used instead of the polyhydroxyalkanoate composed of the unit represented by the chemical formula (134) in Preparation Example 2J-2, and 26.01 ml (52.0 mmol) of a solution of 2 M of lithium diisopropylamide in THF and 8.88 g (104.1 mmol) of benzyl chloroformate were used. The resultant polymer was subjected to NMR analysis under the same conditions as those of Preparation Example 2J-1. The analysis confirmed that the polymer was a polyhydroxyalkanoate containing a unit represented by the following chemical formula (157). The analysis also confirmed that an A unit accounted for 11 mol % of the monomer unit and a B unit accounted for 89 mol % thereof.

(157)

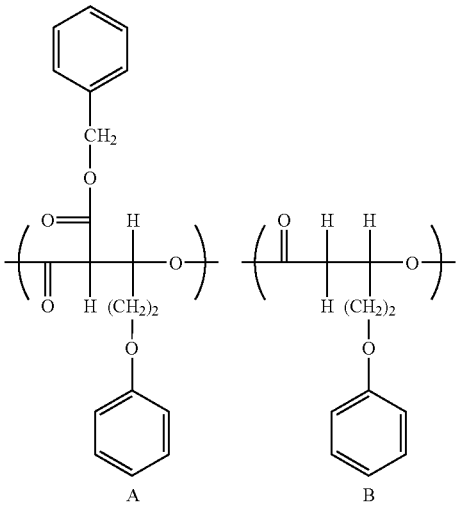

The average molecular weight of the resultant polyhydroxyalkanoate was measured under the same conditions as those of Preparation Example 2J-1. As a result, the resultant polyhydroxyalkanoate was found to have a number average molecular weight Mn of 131,500 and a weight average molecular weight Mw of 282,700.

The above polymer was subjected to hydrogenolysis in the same manner as in Preparation Example 2J-2 to prepare 3.75 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (158) as a monomer unit. The analysis also confirmed that a C unit accounted for 11 mol % of the monomer unit and a D unit accounted for 89 mol % thereof.

(158)

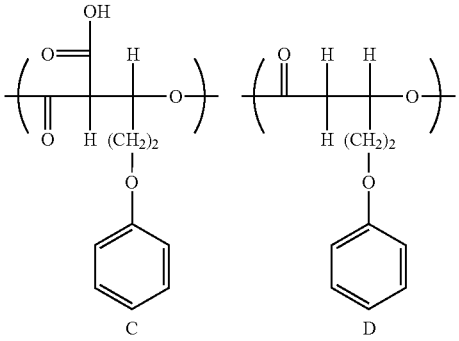

The average molecular weight of the resultant polyhydroxyalkanoate was measured under the same conditions as those of Preparation Example 2J-1. As a result, the resultant polyhydroxyalkanoate was found to have a number average molecular weight Mn of 121,000 and a weight average molecular weight Mw of 260,200.

Preparation Example 2O-3

Under a nitrogen atmosphere, 0.40 g of the polyhydroxyalkanoate copolymer composed of the unit represented by the chemical formula (158) synthesized in Preparation Example 2O-2 (C: 11 mol %, D: 89 mol %) and 0.19 g (1.1 mmol) of 2-aminobenzenesulfonic acid were placed in a 100-ml three-necked flask. 15.0 ml of pyridine were added to the flask, and the mixture was stirred. After that, 0.58 ml (2.2 mmol) of triphenyl phosphite was added. After that, 0.33 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (159), and that the polyhydroxyalkanoate was a copolymer in which an E unit accounted for 10 mol % of the unit.

(159)

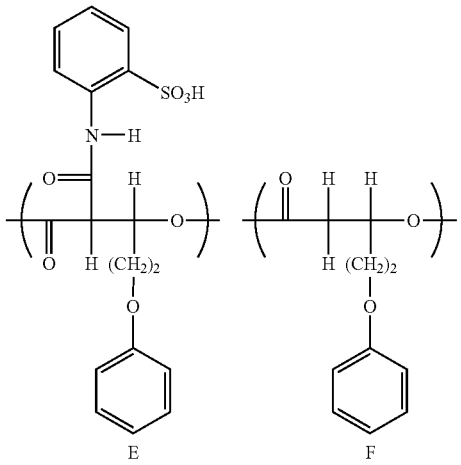

The average molecular weight of the resultant polymer was measured under the same conditions as those of Preparation Example 2J-3. As a result, the resultant polymer was found to have a number average molecular weight Mn of 100,500 and a weight average molecular weight Mw of 221,100.

Preparation Example 2O-4

0.30 g of a polymer was prepared in the same manner as in Preparation Example 2J-4 except that: the polyhydroxyalkanoate represented by the chemical formula (159) synthesized in Preparation Example 2O-3 was used instead of the polyhydroxyalkanoate represented by the chemical formula (137) in Preparation Example 2J-4; and 0.71 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (160), and that the polyhydroxyalkanoate was a copolymer in which a G unit accounted for 10 mol % of the unit.

In addition, an acid value titration in the same manner as in Preparation Example 2J-4 revealed that the sulfonic acid was transformed into methyl sulfonate because no peak derived from the sulfonic acid was observed.

(160)

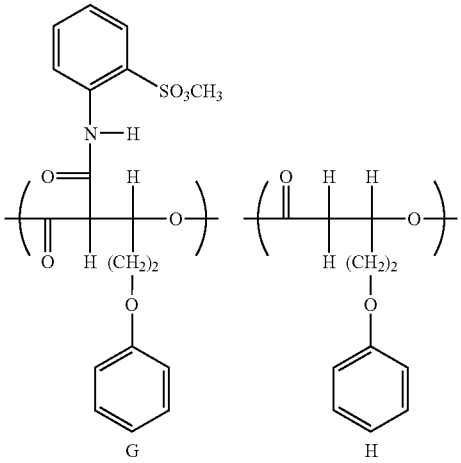

The average molecular weight of the resultant polymer was measured under the same conditions as those of Preparation Example 2J-4. As a result, the resultant polymer was found to have a number average molecular weight Mn of 101,000 and a weight average molecular weight Mw of 227,300.

The scales of these procedures were increased to produce a large amount of polyhydroxyalkanoate containing units represented by the formula (160).

The compound was provided as Exemplified Compound PHA (2O).

Preparation Example 2P-1

(Synthesis of poly-3-hydroxy-4-cyclohexylbutyric Acid Represented by Chemical Formula (161))

(161)

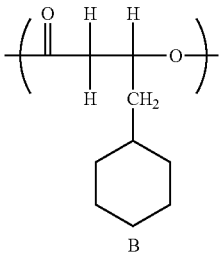

Poly-3-hydroxy-4-cyclohexylbutyric acid represented by the chemical formula (161) was synthesized by means of the method disclosed in Example 9 of Japanese Patent Application Laid-Open No. 2003-319792.

200 mL of an M9 medium containing 0.5% (w/v) of polypeptone and 0.1% (w/v) of 4-cyclohexylbutyric acid were prepared as a production medium. 1 mL of a culture solution prepared in advance by shake culturing a *Pseudomonas cichorii* YN2 strain in an M9 medium containing 0.5% of polypeptone at 30° C. for 8 hours was added to the production medium, and the whole was cultured in a 500-mL shaking flask at 30° C. for 48 hours. After the culture, cells were recovered by centrifugal separation, washed with methanol, and then freeze-dried. After the dried cells had been weighed, chloroform was added, and the whole was stirred at 50° C. for 24 hours to extract a polymer. After filtrating the extracted chloroform solution through a filter, it was concentrated by means of an evaporator. After that, a portion precipitated and solidified with cold methanol was collected and dried under reduced pressure to prepare 0.48 g of a polymer per 1 L of the production medium. NMR analysis was performed under the same conditions as those of Preparation Example 2J-1 to determine the structure of the resultant polymer. The analysis confirmed that the resultant polymer was substantially a homopolymer of poly-3-hydroxy-4-cyclohexylbutyric acid represented by the chemical formula (161) as a monomer unit. The average molecular weight of the resultant polyhydroxyalkanoate was measured under the same conditions as those of Preparation Example 2J-1. As a result, the resultant polyhydroxyalkanoate was found to have a number average molecular weight Mn of 70,500 and a weight average molecular weight Mw of 155,100.

47.9 g of the polyhydroxyalkanoate to be used for any subsequent preparation example were prepared from 100 L of the production medium by means of the above method.

Preparation Example 2P-2

7.66 g of a polymer were prepared in the same manner as in Preparation Example 2J-2 except that 10.00 g of the polyhydroxyalkanoate composed of the unit represented by the chemical formula (161) synthesized in Preparation Example 2P-1 were used instead of the polyhydroxyalkanoate composed of the unit represented by the chemical formula (134) in Preparation Example 2J-2, and 29.72 ml (59.4 mmol) of a solution of 2 M of lithium diisopropylamide in THF and 10.14 g (118.9 mmol) of benzyl chloroformate were used. The resultant polymer was subjected to NMR analysis under the same conditions as those of Preparation Example 2J-1. The analysis confirmed that the polymer was a polyhydroxyalkanoate containing a unit represented by the following chemical formula (162). The analysis also confirmed that an A unit accounted for 10 mol % of the monomer unit and a B unit accounted for 90 mol % thereof.

(162)

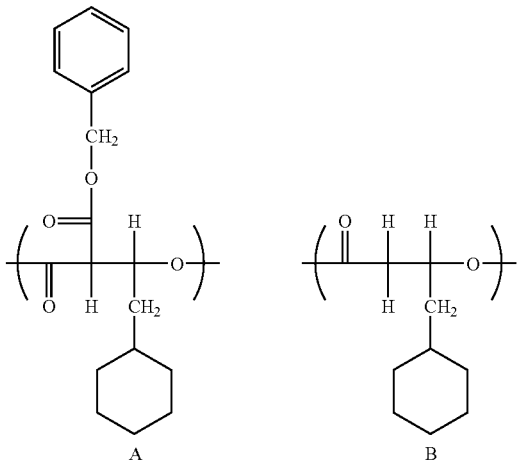

The average molecular weight of the resultant polyhydroxyalkanoate was measured under the same conditions as those of Preparation Example 2J-1. As a result, the resultant polyhydroxyalkanoate was found to have a number average molecular weight Mn of 54,400 and a weight average molecular weight Mw of 110,700.

The above polymer was subjected to hydrogenolysis in the same manner as in Preparation Example 2J-2 to prepare 3.85 g of a polymer. The resultant polymer was subjected to NMR analysis under the same conditions as those of Preparation Example 2J-1. The analysis confirmed that the polymer was a polyhydroxyalkanoate copolymer containing a unit represented by the following chemical formula (163) as a monomer unit. The analysis also confirmed that a C unit accounted for 10 mol % of the monomer unit and a D unit accounted for 90 mol % thereof.

(163)

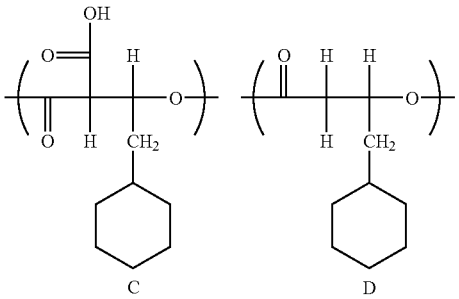

C D

The average molecular weight of the resultant polyhydroxyalkanoate was measured under the same conditions as those of Preparation Example 2J-1. As a result, the resultant polyhydroxyalkanoate was found to have a number average molecular weight Mn of 47,500 and a weight average molecular weight Mw of 103,600.

Preparation Example 2P-3

Under a nitrogen atmosphere, 0.40 g of the polyhydroxyalkanoate copolymer composed of the unit represented by the chemical formula (163) synthesized in Preparation Example 2P-2 (C: 10 mol %, D: 90 mol %) and 0.26 g (1.2 mmol) of 2-amino-1-naphthalenesulfonic acid were placed in a 100-ml three-necked flask. 15.0 ml of pyridine were added to the flask, and the mixture was stirred. After that, 0.60 ml (2.3 mmol) of triphenyl phosphite was added. After that, 0.36 g of a polymer was prepared in the same manner as in Preparation Example 2J-3. The resultant polymer was subjected to NMR analysis and Fourier transformation-infrared absorption spectral analysis under the same conditions as those of Preparation Example 2J-3. As a result, it was confirmed that the resultant polymer was a polyhydroxyalkanoate containing a unit represented by the following chemical formula (164), and that the polyhydroxyalkanoate was a copolymer in which an E unit accounted for 9 mol % of the unit.

(164)

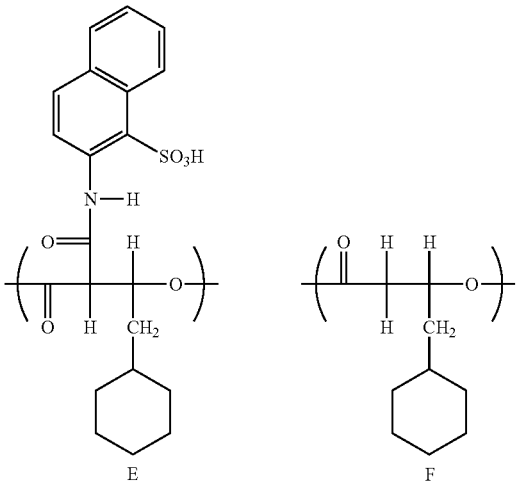

E F

The average molecular weight of the resultant polymer was measured under the same conditions as those of Preparation Example 2J-3. As a result, the resultant polymer was found to have a number average molecular weight Mn of 30,500 and a weight average molecular weight Mw of 65,600.

Preparation Example 2P-4

0.28 g of a polymer was prepared in the same manner as in Preparation Example 2J-4 except that: the polyhydroxyalkanoate represented by the chemical formula (164) synthesized in Preparation Example 2P-3 was used instead of the polyhydroxyalkanoate represented by the chemical formula (137) in Preparation Example 2J-4; and 0.71 ml of a 2 mol/L hexane solution of trimethylsilyldiazomethane (manufactured by Aldrich) was used. The resultant polymer was subjected to NMR analysis under the same conditions as those of Preparation Example 2J-4. The analysis confirmed that the resultant polymer was a polyhydroxyalkanoate containing a unit represented by the following chemical formula (165), and that the polyhydroxyalkanoate was a copolymer in which a G unit accounted for 9 mol % of the unit.

In addition, an acid value titration in the same manner as in Preparation Example 2J-4 revealed that the sulfonic acid was transformed into methyl sulfonate because no peak derived from the sulfonic acid was observed.

(165)

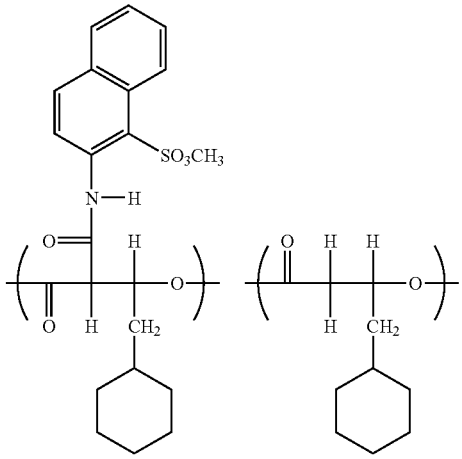

G H

The average molecular weight of the resultant polymer was measured under the same conditions as those of Preparation Example 2J-4. As a result, the resultant polymer was found to have a number average molecular weight Mn of 31,000 and a weight average molecular weight Mw of 68,200.

The scales of these procedures were increased to produce a large amount of polyhydroxyalkanoate containing units represented by the formula (165).

The compound was provided as Exemplified Compound PHA (2P).

Preparation Example 2Z-1

[Synthesis of 3,6-di(3-butenyl)-1,4-dioxane-2,5-dione Represented by Chemical Formula (166) in which m=2 from 2-hydroxy-5-hexenoic acid]

(166)

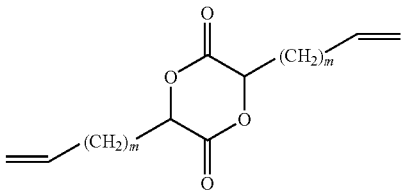

(m represents an integer selected from 2 to 8.)

3,6-di(3-butenyl)-1,4-dioxane-2,5-dione used in Preparation Example A-1 is synthesized as follows.

3.0 g of 2-hydroxy-5-hexenoic acid, 400 ml of toluene, and 30 mg of p-toluenesulfonic acid were placed in a 1-L flask equipped with a reflux condenser and a Dean-Stark trap, and the whole was refluxed under a nitrogen atmosphere. Water accumulating in the trap was removed from time to time. After 72 hours of reflux, the flask was cooled. The resultant was washed with 10 ml of a saturated aqueous solution of sodium hydrogen carbonate twice, and then the resultant crude product was distilled under reduced pressure in the presence of zinc oxide to prepare 1.06 g of 3,6-di(3'-butenyl)-1,4-dioxane-2,5-dione of interest (41% yield).

NMR analysis was performed under the following conditions to determine the structure of the resultant compound.

<Measuring equipment> FT-NMR: Bruker DPX 400

Resonance frequency: $^1$H=400 MHz

<Measurement conditions> Measured nuclear species: $^1$H

Solvent used: DMSO-$d_6$

Measurement temperature: room temperature

The analysis confirmed that the resultant compound was 3,6-di(3-butenyl)-1,4-dioxane-2,5-dione of interest.

Preparation Example 2Z-2

7-(3-butenyl)-2-oxepanone used in Preparation Example B-1 was prepared with reference to the method described in Japanese Patent Application Laid-Open NO. H05-310721. To be specific, 7-(3-butenyl)-2-oxepanone was prepared by using 2-(3-butenyl)cyclohexanone instead of 2-allylcyclohexanone as a raw material described in Example 43 of the patent document.

Preparation Example 2Z-3

[Synthesis of 3-(9-decenyl)-2-oxetanone described in Preparation Example D-1]

3-(9-decenyl)-2-oxetanone can be synthesized by using β-propiolactone instead of γ-butyrolactone and 10-bromo-1-decene instead of allyl bromide in the synthesis of dihydro-3-(2-propenyl)furan-2(3H)-one described in Journal of American Chemical Society 1995, 117, 3705-3716 (the compound (6a) in the document).

To be specific, 7.20 g (100.0 mmol) of β-propiolactone were placed in a round-bottomed flask, and 55 ml of THF were added to dissolve them. The flask was placed under a nitrogen atmosphere, and the solution was stirred at −78° C. Next, 55 ml of a solution of 2 M of lithium diisopropylamide in THF were gradually added to the flask, and the whole was stirred at −78° C. for 20 minutes. Next, 26.30 g (110.0 mmol) of 10-bromo-1-decene dissolved into 38 ml of hexamethylphosphoramide (HMPA) were added to the flask, and the whole was stirred at −30° C. for 3 hours. After the completion of the reaction, the reaction solution was poured into an aqueous solution of ammonium chloride, and dichloromethane was added to extract the organic layer. The extracted organic layer was washed with water 3 times. After that, the organic layer was collected and dried with anhydrous sodium sulfate. After sodium sulfate had been removed, the solvent was distilled off to collect crude 3-(9-decenyl)-2-oxetanone. Next, the crude product was purified by means of silica gel column chromatography, and the purified product was distilled under reduced pressure to prepare 15.14 g of 3-(9-decenyl)-2-oxetanone of interest. NMR analysis was performed under the following conditions to determine the structure of the resultant compound.

<Measuring equipment> FT-NMR: Bruker DPX 400

Resonance frequency: $^1$H=400 MHz

<Measurement conditions> Measured nuclear species: $^1$H

Solvent used: $CDCl_3$

Measurement temperature: room temperature

The analysis confirmed that the resultant compound was 3-(9-decenyl)-2-oxetanone of interest.

Preparation Example 2Z-4

[Synthesis of tetrahydro-3-(2-propenyl)-2H-pyrane-2-One Described in Each of Preparation Examples E-1 and 2B-1]

9.81 g of tetrahydro-3-(2-propenyl)-2H-pyrane-2-one of interest were prepared in the same manner as in Preparation Example 2Z-3 except that 10.01 g (100.0 mmol) of δ-valerolactone and 14.52 g (110.0 mmol) of allyl bromide were used instead of β-propiolactone and 10-bromo-1-decene described in Preparation Example 2Z-3, respectively.

Preparation Example 2Z-5

[Synthesis of 3-(2-propenyl)-2-oxepanone Described in Preparation Example F-1]

10.02 g of 3-(2-propenyl)-2-oxepanone of interest were prepared in the same manner as in Preparation Example 2Z-3 except that 11.41 g (100.0 mmol) of ϵ-caprolactone and 14.52 g (110.0 mmol) of allyl bromide were used instead of β-propiolactone and 10-bromo-1-decene described in Preparation Example 2Z-0.3, respectively.

Example 1

A core material (which may be referred to as a carrier core) was prepared as follows.

First, $Fe_2O_3$, CuO, and ZnO were precisely weighed at molar ratios of 55 mol %, 25 mol %, and 20 mol %, respectively, and they were mixed by means of a ball mill. Next, the mixture was calcined, and the calcined product was pulverized by means of a ball mill. Furthermore, the pulverized product was granulated by means of a spray drier. The resultant was sintered and classified to prepare a core material (a carrier core).

The surface of the resultant core was coated with a resin coating layer as follows.

A styrene-methyl methacrylate-2-ethylhexyl acrylate copolymer (copolymerization ratio=40:50:10) was dissolved into toluene as a solvent to prepare a 10-wt. % solution. Furthermore, Exemplified Compound PHA (A) was added in an amount of 5% by weight with respect to the solid content of the copolymer, and the whole was sufficiently stirred to prepare a resin coating solution.

The resin coating solution was applied to the core material by means of a coating device equipped with a rotary base disk and a stirring blade in a fluid bed for performing coating while forming a swirl flow in such a manner that the weight of a resin coating layer would be 2% by weight with respect to the core material. The resin coating solution was sprayed in a direction perpendicular to the moving direction of the fluid bed in the device, and the spray pressure of the resin coating solution was set to 4 kg/cm$^2$. The resultant resin-coated carrier was dried in the fluid bed at a temperature of 80° C. for 1 hour to prepare a resin-coated carrier.

The resultant resin-coated carrier had an average particle diameter of 41 μm. Observation of the coverage of the resin-coated carrier with the resin coating layer by means of an electron microscope confirmed that a uniform resin coating layer was formed.

The resultant resin-coated carrier and the toner No. 1 were mixed in such a manner that the toner concentration would be 5.5% by weight, to thereby prepare a developer.

In evaluating the developer, image output was performed in an N/N environment (23° C./60% RH) by using a blue developer of a reconstructed device of an analog copying machine NP4835 (trade name) manufactured by CANON Inc. At that time, the evaluation employed a fluctuation in image density, fogging on an image after 50,000 sheets, an environmental fluctuation in charge amount, and image deletion on a photosensitive drum as indices. Table 1 shows the obtained results.

Example 2

The same core material as that of Example 1 was coated with a resin coating layer as follows.

A styrene-methyl methacrylate-2-ethylhexyl methacrylate copolymer (copolymerization ratio=50:45:5) was dissolved into toluene as a solvent to prepare a 10-wt. % solution. Furthermore, Exemplified Compound PHA (B) was added in an amount of 5% by weight with respect to the solid content of the copolymer, and the whole was sufficiently stirred to prepare a resin coating solution. The core material was coated with the resin coating solution in the same manner as in Example 1 to prepare a resin-coated carrier.

The resultant resin-coated carrier had an average particle diameter of 40 μm. Observation of the coverage of the resin-coated carrier with the resin coating layer by means of an electron microscope confirmed that a uniform resin coating layer was formed.

The resultant resin-coated carrier was used to prepare a developer in the same manner as in Example 1. The developer was evaluated in the same manner as in Example 1 Table 1 shows the results.

Examples 3 and 4

The surface of the core material used in Example 1 was coated with a resin coating layer as follows.

A styrene-methyl methacrylate-2-hydroxyethyl methacrylate copolymer (copolymerization ratio=35:57:8, hydroxyl value (KOHmg/g)=35) and a vinylidene fluoride-tetrafluoroethylene copolymer (copolymerization ratio=75:25) were use in an equal amount, and they were dissolved into a mixed solvent of acetone and methyl ethyl ketone (mixing weight ratio=1:1) to prepare a 10-wt. % solution. Furthermore, in Example 3, Exemplified Compound PHA (B) (in Example 4, Exemplified Compound PHA (C)) was added in an amount of 5% by weight with respect to the solid content of the resin, and the whole was sufficiently stirred to prepare a resin coating solution. The core material was coated with each of the resin coating solutions in the same manner as in Example 1 to prepare a resin-coated carrier.

Each of the resultant resin-coated carriers had an average particle diameter of 41 μm. Observation of the coverage of the resin-coated carrier particles with each of the resin coating layers by means of an electron microscope confirmed that a uniform resin coating layer was formed.

Each of the resultant carriers was used to prepare a developer in the same manner as in Example 1. The developers were evaluated in the same manner as in Example 1. Table 1 shows the results.

Examples 5 and 6

A core material was prepared as follows.

First, $Fe_2O_3$, CuO, and ZnO were precisely weighed at molar ratios of 53 mol %, 25 mol %, and 22 mol %, respectively, and they were mixed by means of a ball mill. Next, the mixture was calcined, and the calcined product was pulverized by means of a ball mill. Furthermore, the pulverized product was granulated by means of a spray drier. The resultant was sintered and classified to prepare a core having an average particle diameter of 65 μm.

In Example 5, a resin coating solution was prepared in the same manner as in Example 1. In Example 6, a resin coating solution was prepared in the same manner as in Example 1 except that Exemplified Compound PHA (B) was used instead of Exemplified Compound PHA (A). The core material was coated with each of the resin coating solutions in the same manner as in Example 1 to prepare a resin-coated carrier. Each of the resultant resin-coated carriers had an average particle diameter of 66 μm.

Each of the resultant resin-coated carriers was used to prepare a developer in the same manner as in Example 1. The developers were evaluated in the same manner as in Example 1. Table 1 shows the results.

Comparative Example 1

A resin-coated carrier was prepared in the same manner as in Example 1 except that Exemplified Compound PHA (A) was not used. The resultant resin-coated carrier was used to prepare a developer in the same manner as in Example 1. The developer was evaluated in the same manner as in Example 1. Table 1 shows the results.

Comparative Example 2

A resin-coated carrier was prepared in the same manner as in each of Examples 5 and 6 except that neither Exemplified Compound PHA (A) nor Exemplified Compound PHA (B) was used. The resultant resin-coated carrier was used to prepare a developer in the same manner as in Example 1. The developer was evaluated in the same manner as in Example 1. Table 1 shows the results.

TABLE 1

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 1 | ○ | ○ | ○ | ○ | ○ | ○ | ○ | ○ |
| Example 2 | ○ | ○ | ○ | ○ | ○ | ○ | ○ | ○ |
| Example 3 | ○ | ○ | ○ | ○ | ○ | ○ | ○ | ○ |
| Example 4 | ○ | ○ | ○ | ○ | ○ | ○ | ○ | ○ |
| Example 5 | ○ | ○ | ○ | ○ | ○ | ○ | ○ | ○ |
| Example 6 | ○ | ○ | ○ | ○ | ○ | ○ | ○ | ○ |

TABLE 1-continued

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Comparative Example 1 | Δ | ▲ | ▲ | ▲ | Δ | ▲ | ▲ | x |
| Comparative Example 2 | Δ | ▲ | ▲ | ▲ | Δ | x | ▲ | x |

(Evaluation)

Each developer was evaluated for the occurrence of: a fluctuation in image density; fogging on an image; an environmental fluctuation in charge amount; and image deletion on a photosensitive drum in a 50,000-sheet image output test by means of the following method and according to the following criteria.

1. Image Density

An image was copied under appropriate light exposure conditions, and the image density of a solid portion of the image was measured by means of a Macbeth densitometer. The measured image density was evaluated according to the following criteria.

○: No density unevenness occurs, and an original density is reproduced with very high reproducibility.

Δ: An original density is reproduced (a practically acceptable level).

▲: An image density is nonuniform and has unevenness (a level at which a problem occurs in practical use).

x: An image density is changed greatly as compared to an original density (a practically unacceptable level).

2. Fogging on Image

Toner fogging on a white image was measured by means of a REFLECTOMETER MODEL TC-6DS (trade name) manufactured by TOKYO DENSHOKU CO., LTD, and was evaluated according to the following criteria.

○: Less than 0.5%

Δ: 0.5% or more and less than 1.5%

▲: 1.5% or more and less than 2.5% x: 2.5% or more

3. Environmental Fluctuation in Charge Amount

The charge amount Q (LL) after the developer had been left standing at 15° C. and a humidity of 10% for 1 day and the charge amount Q (HH) after the developer had been left standing at 30° C. and a humidity of 80% for 1 day were calculated by using the method of measuring a charge amount described below. After that, a difference ΔQ (=O (LL)−Q (HH)) between them was determined and evaluated according to the following criteria.

○: ΔQ is less than 10 μC.

Δ: ΔQ is 10 μC or more and less than 15 μC.

▲: ΔQ is 15 μC or more and less than 20 μC.

x: ΔQ is 20 μC or more.

4. Image Deletion on Photosensitive Drum

A halftone image was formed by means of a CLC700 in an environment having a temperature of 30° C. and a humidity of 80%, and was evaluated for image quality according to the following criteria.

○: No image deletion is observed.

Δ: Slight image deletion is observed, but is practically acceptable.

▲: A level at which a problem occurs in practical use.

x: Image deletion is observed on the entire surface, and is not practically acceptable.

Examples 7 to 12

In each of Examples 7 to 12, a developer was prepared in the same manner as in each of Examples 1 to 6 except that the toner No. 2 was used instead of the toner No. 1. Each of the developers was evaluated in the same manner as in each of Examples 1 to 6. Table 2 shows the results.

Comparative Examples 3 and 4

In each of Comparative Examples 3 and 4, a developer was prepared in the same manner as in each of Comparative Examples 1 and 2 except that the toner No. 2 was used instead of the toner No. 1. Each of the developers was evaluated in the same manner as in each of Comparative Examples 1 and 2. Table 2 shows the results.

TABLE 2

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 7 | ○ | ○ | ○ | ○ | ○ | ○ | ○ | ○ |
| Example 8 | ○ | ○ | ○ | ○ | ○ | ○ | ○ | ○ |
| Example 9 | ○ | ○ | ○ | ○ | ○ | ○ | ○ | ○ |
| Example 10 | ○ | ○ | ○ | ○ | ○ | ○ | ○ | ○ |
| Example 11 | ○ | ○ | ○ | ○ | ○ | ○ | ○ | ○ |

TABLE 2-continued

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 12 | ○ | ○ | ○ | ○ | ○ | ○ | ○ | ○ |
| Comparative Example 3 | Δ | ▲ | ▲ | ▲ | Δ | x | ▲ | x |
| Comparative Example 4 | Δ | ▲ | ▲ | x | Δ | x | x | x |

Example 13

Oxides of ferrite raw materials, that is, $Fe_2O_3$, MgO, and SrO were wet-blended by means of a ball mill at molar ratios of 56.3 mol %, 23.0 mol %, and 20.7 mol %, respectively, and the mixture was dried and pulverized. After that, the resultant was calcined at 750° C. for 2 hours, and the calcined product was pulverized by means of a crusher into pieces each having a size of about 0.1 to 1.0 mm. The resultant pieces were additionally wet-ground by means of a ball mill to prepare slurry. Then, 1.0% of polyvinyl alcohol as a binder and 3% of $CaCO_3$ as a hole adjustor were added to the slurry, and the whole was granulated into spherical particles by means of spray drying. The spherical particles were baked at 950° C. in a nitrogen gas atmosphere having an oxygen gas concentration of 0.5%, and were sieved by means of a sieve having an aperture of 250 μm to remove coarse particles. The remaining particles were classified by means of an air classifier (Elbow Jet Labo EJ-L3, manufactured by Nittetsu Mining Co., Ltd.; trade name) to adjust a particle size, thereby preparing a core material.

Next, the mixture of the following compositions was prepared.

| | |
|---|---|
| Mixed solvent of toluene and methyl ethyl ketone (4:1) | 1,000 parts |
| Styrene-methyl methacrylate copolymer (styrene: methyl methacrylate = 4:6, Mw = 50,000) | 50 parts |
| Exemplified Compound PHA (A) | 50 parts |

The above mixture was used to prepare a resin coating solution. Next, the formulation of the solution was adjusted in such a manner that the resin solid content would be 10.0% by weight with respect to the core material, and the solution and the core material were dried under reduced pressure while being stirred and mixed by means of a vacuum kneader to remove the solvent. The remainder was baked at 140° C. for 2 hours, and the resultant was sieved by means of a sieve having an aperture of 74 μm to prepare a resin-coated carrier having an average particle diameter (volume-average 50% particle diameter) of 35.3 μm and a BET specific surface area of 0.182 $m^2/g$.

A developer was prepared in the same manner as in Example 1 except that the carrier prepared here was used. The developer was evaluated in the same manner as in Example 1. Table 3 shows the results.

Examples 14 to 16

In each of Examples 14 to 16, a resin-coated carrier was prepared in the same manner as in Example 13 except that: the amount of the styrene-methyl methacrylate copolymer (styrene:methyl methacrylate=4:6, Mw=50,000) was changed to 80 parts; the amount of Exemplified Compound PHA (A) was changed to 20 parts; and the resin solid content was changed to 15.0%, 20.0%, or 25.0%.

The resultant resin-coated carriers were used to prepare developers in the same manner as in Example 1. The developers were evaluated in the same manner as in Example 1. Table 3 shows the results.

Examples 17 to 20

In each of Examples 17 to 20, a developer was prepared in the same manner as in each of Examples 13 to 16 except that the toner No. 2 was used instead of the toner No. 1. Each of the developers was evaluated in the same manner as in each of Examples 13 to 16. Table 3 shows the results.

TABLE 3

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 13 | ○ | ○ | ○ | ○ | ○ | ○ | ○ | ○ |
| Example 14 | ○ | ○ | ○ | ○ | ○ | ○ | ○ | ○ |

TABLE 3-continued

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 15 | ○ | ○ | ○ | ○ | ○ | ○ | ○ | ○ |
| Example 16 | ○ | ○ | ○ | ○ | ○ | ○ | ○ | ○ |
| Example 17 | ○ | ○ | ○ | ○ | ○ | ○ | ○ | ○ |
| Example 18 | ○ | ○ | ○ | ○ | ○ | ○ | ○ | ○ |
| Example 19 | ○ | ○ | ○ | ○ | ○ | ○ | ○ | ○ |
| Example 20 | ○ | ○ | ○ | ○ | ○ | ○ | ○ | ○ |

Example 21

A resin-coated carrier was prepared in the same manner as in Example 1 except that Exemplified Compound PHA (D) was used instead of Exemplified Compound PHA (A). The resultant resin-coated carrier was used to prepare a developer in the same manner as in Example 1. The developer was evaluated in the same manner as in Example 1. Table 4 shows the results.

Example 22

A resin-coated carrier was prepared in the same manner as in Example 2 except that Exemplified Compound PHA (E) was used instead of Exemplified Compound PHA (B). The resultant resin-coated carrier was used to prepare a developer in the same manner as in Example 1. The developer was evaluated in the same manner as in Example 1. Table 4 shows the results.

Examples 23 and 24

In each of Examples 23 and 24, a resin-coated carrier was prepared in the same manner as in each of Examples 3 and 4 except that Exemplified Compound PHA (E) or Exemplified Compound PHA (F) was used instead of Exemplified Compound PHA (B) or Exemplified Compound PHA (C). The resultant resin-coated carriers were used to prepare developers in the same manner as in Example 1. The developers were evaluated in the same manner as in Example 1. Table 4 shows the results.

Examples 25 and 26

In each of Examples 25 and 26, a resin-coated carrier was prepared in the same manner as in each of Examples 5 and 6 except that Exemplified Compound PHA (D) or Exemplified Compound PHA (E) was used instead of Exemplified Compound PHA (A) or Exemplified Compound PHA (B). The resultant resin-coated carriers were used to prepare developers in the same manner as in Example 1. The developers were evaluated in the same manner as in Example 1. Table 4 shows the results.

TABLE 4

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 21 | ○ | ○ | ○ | ○ | ○ | Δ | ○ | ○ |
| Example 22 | ○ | ○ | ○ | ○ | ○ | ○ | ○ | ○ |
| Example 23 | ○ | ○ | ○ | ○ | ○ | ○ | ○ | ○ |
| Example 24 | ○ | ○ | ○ | ○ | ○ | ○ | ○ | ○ |
| Example 25 | ○ | ○ | ○ | ○ | ○ | Δ | ○ | Δ |
| Example 26 | ○ | ○ | ○ | ○ | ○ | ○ | ○ | ○ |
| Comparative Example 1 | Δ | ▲ | ▲ | ▲ | Δ | ▲ | ▲ | x |
| Comparative Example 2 | Δ | ▲ | ▲ | ▲ | Δ | x | ▲ | x |

Examples 27 to 32

In each of Examples 27 to 32, a developer was prepared in the same manner as in each of Examples 21 to 26 except that the toner No. 2 was used instead of the toner No. 1. Each of the developers was evaluated in the same manner as in each of Examples 21 to 26. Table 5 shows the results.

TABLE 5

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 27 | ○ | ○ | ○ | ○ | ○ | Δ | ○ | Δ |
| Example 28 | ○ | ○ | ○ | ○ | ○ | ○ | ○ | ○ |
| Example 29 | ○ | ○ | ○ | ○ | ○ | ○ | ○ | ○ |
| Example 30 | ○ | ○ | ○ | ○ | ○ | ○ | ○ | ○ |
| Example 31 | ○ | ○ | ○ | ○ | ○ | Δ | ○ | Δ |
| Example 32 | ○ | ○ | ○ | ○ | ○ | ○ | ○ | ○ |
| Comparative Example 3 | Δ | ▲ | ▲ | ▲ | Δ | x | ▲ | x |
| Comparative Example 4 | Δ | ▲ | ▲ | x | Δ | x | x | x |

Example 33

A resin-coated carrier was prepared in the same manner as in Example 13 except that Exemplified Compound PHA (D) was used instead of Exemplified Compound PHA (A). The resultant resin-coated carrier was used to prepare a developer in the same manner as in Example 1. The developer was evaluated in the same manner as in Example 1. Table 6 shows the results.

Examples 34 to 36

In each of Examples 34 to 36, a resin-coated carrier was prepared in the same manner as in Example 13 except that: the amount of the styrene-methyl methacrylate copolymer (4:6, Mw=50,000) was changed to 80 parts; the amount of Exemplified Compound PHA (E) was changed to 20 parts; and the resin solid content was changed to 15.0%, 20.0%, or 25.0%.

The resultant resin-coated carriers were used to prepare developers in the same manner as in Example 1. The developers were evaluated in the same manner as in Example 1. Table 6 shows the results.

Examples 37 to 40

In each of Examples 37 to 40, a developer was prepared in the same manner as in each of Examples 33 to 36 except that the toner No. 2 was used instead of the toner No. 1. Each of the developers was evaluated in the same manner as in each of Examples 33 to 36. Table 6 shows the results.

TABLE 6

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 33 | ○ | ○ | ○ | ○ | ○ | ○ | ○ | ○ |
| Example 34 | ○ | ○ | ○ | ○ | ○ | ○ | ○ | ○ |
| Example 35 | ○ | ○ | ○ | ○ | ○ | ○ | ○ | ○ |
| Example 36 | ○ | ○ | ○ | Δ | ○ | Δ | ○ | ○ |
| Example 37 | ○ | ○ | ○ | ○ | ○ | ○ | ○ | ○ |
| Example 38 | ○ | ○ | ○ | ○ | ○ | ○ | ○ | ○ |
| Example 39 | ○ | ○ | ○ | ○ | ○ | ○ | ○ | ○ |
| Example 40 | ○ | ○ | ○ | Δ | ○ | Δ | ○ | Δ |

Examples 41 to 48

In each of Examples 41 to 48, a resin-coated carrier was prepared in the same manner as in Example 1 except that Exemplified Compound PHA (2A), PHA (2B), PHA (2C), PHA (2D), PHA (2E), PHA (2F), PHA (2G), or PHA (2H) was used instead of Exemplified Compound PHA (A). The resultant resin-coated carriers were used to prepare developers in the same manner as in Example 1. The developers were evaluated in the same manner as in Example 1. Table 7 shows the results.

As described above, the resin-coated carrier for an electrophotographic developer of the present invention has sufficient charge imparting property, is excellent in environmental stability, has sufficient durability, and is capable of providing an image with excellent image quality in which image deletion or the like hardly occurs. Accordingly, the resin-coated carrier is suitably used as a constituent of a two-component developer or of a replenishing developer.

This application claims priority from Japanese Patent Application No. 2004-186453 filed Jun. 24, 2004, which is hereby incorporated by reference herein.

TABLE 7

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 41 | ○ | ○ | ○ | ○ | ○ | ○ | ○ | ○ |
| Example 42 | ○ | ○ | ○ | ○ | ○ | ○ | ○ | ○ |
| Example 43 | ○ | ○ | ○ | ○ | ○ | ○ | ○ | ○ |
| Example 44 | ○ | ○ | ○ | ○ | ○ | Δ | ○ | Δ |
| Example 45 | ○ | ○ | ○ | ○ | ○ | ○ | ○ | ○ |
| Example 46 | ○ | ○ | ○ | ○ | ○ | ○ | ○ | ○ |
| Example 47 | ○ | ○ | ○ | ○ | ○ | Δ | ○ | ○ |
| Example 48 | ○ | ○ | ○ | ○ | ○ | ○ | ○ | ○ |
| Comparative Example 1 | Δ | ▲ | ▲ | ▲ | Δ | ▲ | ▲ | x |

Examples 49 to 56

In each of Examples 49 to 56, a resin-coated carrier was prepared in the same manner as in Example 2 except that Exemplified Compound PHA (2I), PHA (2J), PHA (2K), PHA (2L), PHA (2M), PHA (2N), PHA (2O), or PHA (2P) was used instead of Exemplified Compound PHA (B). The resultant resin-coated carriers were used to prepare developers in the same manner as in Example 1. The developers were evaluated in the same manner as in Example 1. Table 8 shows the results.

What is claimed is:

1. A resin-coated carrier for an electrophotographic developer, comprising:

a core material; and a resin coating layer containing a polyhydroxyalkanoate containing one or more units each represented by the following chemical formula (1) in a molecule, the resin coating layer being placed on the core material:

TABLE 8

| | Copy evaluation results | | | | | | | |
|---|---|---|---|---|---|---|---|---|
| | Image density | | Fogging on image | | Environmental fluctuation in charge amount | | Image deletion on photosensitive drum (30° C., 80%) | |
| | Initial | After 50,000 sheets | Initial | After 50,000 sheets | Initial | After 50,000 sheets | Initial | After 50,000 sheets |
| Example 49 | ○ | ○ | ○ | ○ | ○ | ○ | ○ | ○ |
| Example 50 | ○ | ○ | ○ | ○ | ○ | ○ | ○ | ○ |
| Example 51 | ○ | ○ | ○ | ○ | ○ | Δ | ○ | ○ |
| Example 52 | ○ | ○ | ○ | ○ | ○ | ○ | ○ | ○ |
| Example 53 | ○ | ○ | ○ | ○ | ○ | ○ | ○ | ○ |
| Example 54 | ○ | ○ | ○ | ○ | ○ | ○ | ○ | ○ |
| Example 55 | ○ | ○ | ○ | ○ | ○ | ○ | ○ | ○ |
| Example 56 | ○ | ○ | ○ | ○ | ○ | ○ | ○ | ○ |
| Comparative Example 1 | Δ | ▲ | ▲ | ▲ | Δ | ▲ | ▲ | x |

(1)

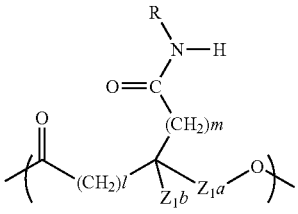

(in the formula:

R represents $-A_1-SO_2R_1$;

$R_1$ represents OH, a halogen atom, ONa, OK, or $OR_{1a}$; and $R_{1a}$ and $A_1$ each independently represent a group having a substituted or unsubstituted aliphatic hydrocarbon structure, a substituted or unsubstituted aromatic ring structure, or a substituted or unsubstituted heterocyclic structure;

in addition, with regard to l, m, $Z_{1a}$, and $Z_{1b}$ in the formula:

l is 0 or an integer from 2-4;

$Z_{1a}$ represents nothing or a methylene group;

when l represents an integer selected from 2 to 4, $Z_{1a}$ represents nothing or a methylene group, $Z_{1b}$ represents a hydrogen atom, and m represents an integer selected from 0 to 8;

when l represents 0 and $Z_{1a}$ represents a methylene group, the methylene group may be substituted by a linear or branched alkyl group, or an alkyl group containing a residue having any one of a phenyl structure, a thienyl structure, and a cyclohexyl structure at a terminal thereof, $Z_{1b}$ represents a linear or branched alkyl group, aryl group, or aralkyl group which may be substituted by an aryl group, and m is 0; and when l represents 0 and $Z_{1a}$ represents nothing, $Z_{1b}$ represents a linear or branched alkyl group, aryl group, or aralkyl group which may be substituted by an aryl group, and m is 0;

in addition, when multiple units exist, R, $R_1$, $R_{1a}$, $A_1$, $Z_{1a}$, $Z_{1b}$, l, and m each independently have the above meaning for each unit).

2. A resin-coated carrier according to claim 1, wherein the one or more units each represented by the chemical formula (1) are each represented by the following chemical formula (3):

(3)

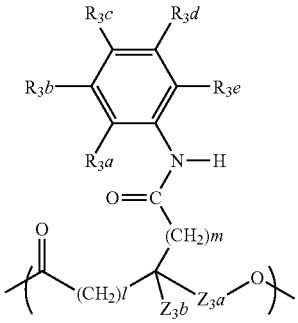

(in the formula, at least one of $R_{3a}$, $R_{3b}$, $R_{3c}$, $R_{3d}$, and $R_{3e}$ represents $SO_2R_{3f}$($R_{3f}$ represents OH, a halogen atom, ONa, OK, or $OR_{3f1}$; and $R_{3f1}$ represents a linear or branched alkyl group having 1 to 8 carbon atoms, or a substituted or unsubstituted phenyl group), and the others each independently represent a hydrogen atom, a halogen atom, an alkyl group having 1 to 20 carbon atoms, an alkoxy group having 1 to 20 carbon atoms, an OH group, an $NH_2$ group, an $NO_2$ group, $COOR_{3g}$ ($R_{3g}$ represents an H atom, an Na atom, or a K atom), an acetamide group, an OPh group(Ph indicating a phenyl group), an NHPh group, a $CF_3$ group, a $C_2F_5$ group, or a $C_3F_7$ group;

in addition, with regard to l, m, $Z_{3a}$, and $Z_{3b}$ in the formula:

when l represents an integer selected from 2 to 4, $Z_{3a}$ represents nothing or a methylene group, $Z_{3b}$ represents a hydrogen atom, and m represents an integer selected from 0 to 8;

when l represents 0 and $Z_{3a}$ represents a methylene group, the methylene group may be substituted by a linear or branched alkyl group, or an alkyl group containing a residue having any one of a phenyl structure, a thienyl structure, and a cyclohexyl structure at a terminal thereof, $Z_{3b}$ represents a linear or branched alkyl group, aryl group, or aralkyl group which may be substituted by an aryl group, and m is 0; and when l represents 0 and $Z_{3a}$ represents nothing, $Z_{3b}$ represents a linear or branched alkyl group, aryl group, or aralkyl group which may be substituted by an aryl group, and m is 0;

in addition, when multiple units exist, $R_{3a}$, $R_{3b}$, $R_{3c}$, $R_{3d}$, $R_{3e}$, $R_{3f}$, $R_{3f1}$, $R_{3g}$, $Z_{3a}$, $Z_{3b}$, l, and m each independently have the above meaning for each unit).

3. A resin-coated carrier according to any one of claims 1 or 2, wherein the polyhydroxyalkanoate further contains a unit represented by the following chemical formula (7):

(7)

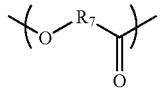

(in the formula, $R_7$ represents a linear or branched alkylene group having 1 to 11 carbon atoms, an alkyleneoxyalkylene group each alkylene of which has 1 to 2 carbon atoms, or an alkylidene group having 1 to 5 carbon atoms which may be substituted by aryl as desired; in addition, when multiple units exist, $R_7$'s each independently have the above meaning for each unit).

4. A resin-coated carrier according to claim 1, wherein the polyhydroxyalkanoate has a number average molecular weight of 1,000 to 1,000,000.

5. A two-component developer, comprising:

a resin-coated carrier; and a toner containing at least a binder resin and a colorant, wherein the resin-coated carrier comprises the resin-coated carrier according to claim 1.

6. A replenishing developer, comprising:

1 part by weight of a carrier; and 2 to 50 parts by weight of toner, wherein the carrier comprises the resin-coated carrier according to claim 1.

* * * * *